United States Patent [19]

Nakamura et al.

[11] Patent Number: 4,886,736

[45] **Date of Patent: * Dec. 12, 1989**

[54] SILVER HALIDE COLOR PHOTOGRAPHIC MATERIAL

[75] Inventors: Koki Nakamura; Kei Sakanoue; Seiji Ichijima, all of Kanagawa, Japan

[73] Assignee: Fuji Photo Film Co., Ltd., Kanagawa, Japan

[ * ] Notice: The portion of the term of this patent subsequent to Nov. 8, 2005 has been disclaimed.

[21] Appl. No.: 65,194

[22] Filed: Jun. 12, 1987

[30] Foreign Application Priority Data

Jun. 12, 1986 [JP] Japan ..... 61-136947

[51] Int. Cl.[4] ..... G03C 7/18; G03C 7/32

[52] U.S. Cl. ..... 430/359; 430/223; 430/380; 430/543; 430/544; 430/549; 430/955; 430/958; 430/542

[58] Field of Search ..... 430/203, 233, 955, 856, 430/957, 958, 959, 549, 544, 359, 543, 380, 376, 542

[56] References Cited

U.S. PATENT DOCUMENTS

| | | | |
|---|---|---|---|
| 3,980,479 | 9/1976 | Fields et al. | 430/223 |
| 4,139,379 | 2/1979 | Chasman et al. | 430/223 |
| 4,199,355 | 4/1980 | Hinshaw et al. | 430/223 |
| 4,248,962 | 2/1981 | Lau | 430/957 |
| 4,555,477 | 11/1985 | Washburn | 430/359 |
| 4,711,837 | 12/1987 | Ichijima et al. | 430/553 |
| 4,783,396 | 11/1988 | Nakamura et al. | 430/223 |

*Primary Examiner*—Richard L. Schilling
*Attorney, Agent, or Firm*—Sughrue, Mion, Zinn, Macpeak & Seas

[57] ABSTRACT

A silver halide color photographic material comprising (1) at least one coupler and (2) at least one compound represented by formula (I)

(I)

wherein EAG represents a group capable of accepting an electron from a reducing substance; $R^1$ and $R^2$ each represents a chemical bond or a divalent substituent, or $R^1$ and $R^2$ are linked together to form a cyclic structure when linked with $(Time)_t$PUG; or $R^1$ and $R^2$ each represents a substituent, or $R^1$ and $R^2$ are linked together to form a cyclic structure when not linked with $(Time)_t$-PUG; Time represents a group capable of releasing PUG, which is released by the cleavage of the single bond between the oxygen atom and the nitrogen atom in the compound; t represents 0 or 1; PUG represents a photographically useful group; and the dotted lines mean that at least one of them forms a chemical bond, and a method for forming an image using the material.

16 Claims, No Drawings

SILVER HALIDE COLOR PHOTOGRAPHIC MATERIAL

FIELD OF THE INVENTION

The present invention relates to silver halide color photographic materials with high sensitivity which have excellent color reproductivity and other image-producing characteristics. More specifically, the present invention relates to silver halide color photographic materials containing (1) a compound capable of releasing a photographically useful group, which is released by the cleavage of a single bond between a nitrogen atom and an oxygen atom in the compound, when the compound is reduced, and (2) one or more couplers.

BACKGROUND OF THE INVENTION

A variety of studies have heretofore been made on color photographic materials in order to improve the image-producing characteristics including the color reproductivity and the graininess and to intensify the sensitivity. One study involves the development of compounds that can release a photographically useful group by the reaction with an oxidized form of a developing agent. Typical examples of such compounds are couplers for releasing a development inhibitor (DIR couplers), couplers for releasing a dye (colored couplers), etc. The fundamental functions of these couplers are described in, for example, *Photographic Science and Engineering,* Vol. 13, pages 74 and 214 (1969) and *PSA Journals,* Vol. 13, page 94 (1947).

As taught in the above-cited publications, the conventional compounds which have the property of improving the image characteristics react with an oxidized form of a developing agent to release a photographically useful group. Specifically, a chemical reaction occurs in the compound corresponding to the image of the exposed silver halide in the photographic light-sensitive materials, whereby a development inhibitor is formed in the compound or a dye is released therefrom.

However, such compounds have been desired as generate the chemical reaction countercorresponding to the image of the exposed silver halide. A complete solution of the various problems which heretofore have not been completely solved is expected by the development of such compounds. For instance, the release of a development inhibitor from the compound countercorresponding to the image of the exposed silver halide will be effective for the reduction of the increase in fog which is often troublesome in the use of a high speed coupler. This is because no development inhibitor is released in the image part and, therefore, the fog in the non-exposed part can be reduced without lowering the color density in the image part.

In the azo dyes which are temporarily short-waved because of a group linked with the auxochrome of the dye, the cleavage of the linked group countercorresponding to the image of the exposed silver halide for color reproduction, if possible, will be effective for using the dyes as a masking agent which is preferable to the conventional masking agents. The conventional masking method using general colored couplers is accompanied by a decrease in sensitivity, which is caused by the addition of a colored compound to a light-sensitive layer. For instance, a magenta-colored cyan coupler is generally added to a red-sensitive layer so as to compensate for the side-absorption of green light by the colored dye from a cyan coupler. In this example, however, the red-sensitive layer should lack the amount of light in the side of the short wavelength because of the absorption of light in the side of the long wavelength by the magenta-colored cyan coupler used. In particular, when phenol type cyan couplers, as illustrated, e.g., in U.S. Pat. Nos. 4,333,999 and 4,451,559, are used as the cyan coupler, the use of the magenta-colored cyan coupler is essential since the colored dye formed from the couplers have noticeable side-absorption as mentioned above and, thus, the decrease in sensitivity of the red-sensitive layer is extreme.

For the same reason as above, the use of a yellow-colored magenta coupler in a green-sensitive layer results in an insufficient amount of light in the side of the short wavelength for the green-sensitive layer and, as a result, a decrease in sensitivity of the green-sensitive layer occurs. One method for solving the above problem, as described in U.S. Pat. No. 4,427,763, involved temporarily short-waving a colored coupler by blocking the auxochrome of the coupler with an alkali-hydrolyzable group. Further, U.S. Pat. No. 4,555,477 has proposes couplers which are able to release a ligand. However, with such couplers, the coloring speed of the couplers themselves is insufficient and, therefore, they cannot be satisfactorily employed to solve the outstanding problems.

The necessity for the generation of a chemical reaction countercorresponding to the image of the exposed silver halide in the compounds to be incorporated into the photographic materials is understood from the above explanation. In this connection, some compounds which generate a chemical reaction countercorresponding to the image of an exposed silver halide (hereinafter referred to as "positive responsive compounds") have been proposed in the field of a diffusion transfer color photography. For instance, some positive-forming compounds are described in U.S. Pat. Nos. 4,199,354, 3,980,479, 4,139,379 and 4,278,598. These compounds are immobile or photographically inactive but can release a mobile and photographically useful group by an intramolecular nucleophilic substitution reaction or intramolecular electron transfer reaction. These known compounds have some efficiency in diffusion transfer color photographic materials. However, when these compounds are used in coupler-containing color photographic materials as an image-forming agent, they are insufficient in the reaction speed and are almost functionless. Accordingly, positive responsive compounds that are functional with a desired reaction speed to the speed of the coupling reaction between a general coupler and the oxidized form of a general developing agent are desired in the art.

SUMMARY OF THE INVENTION

Accordingly, an object of the present invention is to provide color photographic materials with high sensitivity which are excellent in the properties of the image formed such as the color reproductivity and the graininess.

The above and other objects of the present invention are attained by a silver halide color photographic material comprising (1) at least one coupler and (2) at least one compound represented by formula (I):

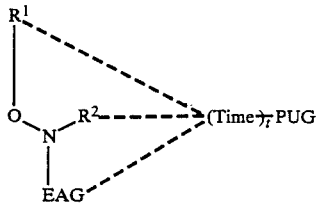

(I)

wherein EAG represents a group capable of accepting an electron from a reducing substance; $R^1$ and $R^2$ each represents a chemical bond or a divalent substituent, or $R^1$ and $R^2$ are linked together to from a cyclic structure when linked with $(Time)_t$PUG; or $R^1$ and $R^2$ each represents a substituent, or $R^1$ and $R^2$ are linked together to form a cyclic structure when not linked with $(Time)_t$-PUG; Time represents a group capable of releasing PUG, which is released by the cleavage of the single bond between the oxygen atom and the nitrogen atom in the compound; t represents 0 or 1; PUG represents a photographically useful group; and the dotted lines mean that at least one of them forms a chemical bond.

DETAILED DESCRIPTION OF THE INVENTION

In formula (I), when $R^1$ or $R^2$ represents a substituent, examples thereof include an alkyl group (such as a methyl group, an ethyl group, a t-butyl group, an octadecyl group, a cyclohexyl group, a phenethyl group, a carboxymethyl group, etc.), an aryl group (such as a phenyl group, a 3-nitrophenyl group, a 4-methoxyphenyl group, a 4-acetylaminophenyl group, a 4-methanesulfonylphenyl group, a 2,4-dimethylphenyl group, a 4-tetradecylphenyl group, a 3-chlorophenyl group, a 3-methylphenyl group, etc.), and a heterocyclic group (such as a 2-pyridyl group, a 2-furyl group, a 3-pyridyl group, etc.).

The compounds of formula (I) above were discovered in the present invention by selecting compounds which have a nitrogen-oxygen bond which is stable to acids, alkalis and heat but can easily be cleaved by reduction. While it is known that the stability of the nitrogen-oxygen single bond against acids, alkalis or heat largely varies depending upon the substituents in the compounds, it has been found in the present invention that the compounds of the present invention are sufficiently stable in a photographic system when pertinent substituents are introduced thereinto. Further, it has been found in the present invention that the reductive cleavage of the nitrogen-oxygen single bond using compounds which are known as photographic reducing agents is attained by linking an electron-accepting group to the nitrogen atom.

In the compounds of formula (I), the cleavage of the nitrogen-oxygen single bond is substantially irreversible and, therefore, the cleavage reaction proceeds at a surprisingly higher speed than expected in an oxidation reduction equilibrium system. Accordingly, any stable reducing agents which are sufficiently resistant to the oxidation by oxygen in the air can be used for the compounds of the present invention, which is one remarkable advantage of the present invention.

Although the detailed mechanism in the cleavage reaction of the nitrogen-oxygen bond in the compounds of formula (I) of the present invention is not clear at present, it is presumed that the cleavage reaction proceeds in accordance with a mechanism which is similar to the series of the reactions described in *Angewante Chemie International Edition,* Vol. 14 (1975), No. 11, page 734.

Specifically, the compound of formula (I) of the present invention accepts one electron from a reducing substance to become an anion radical, whereupon the reducing substance becomes a one-electron-oxidized form. This reaction is presumed to be an equilibrium one. However, the formation of the anion radical intermediate proceeds irreversibly to the direction of the cleavage of the nitrogen-oxygen single bond and, therefore, the total reaction is considered to proceed easily to the direction of the release of the photographically useful group from the compound of formula (I).

In the compounds of formula (I), an electron-accepting group is linked to the nitrogen-oxygen single bond and the nitrogen-oxygen single bond is cleaved when the electron-accepting group has accepted an electron. In the cleavage of this bond, the nitrogen atom or oxygen atom, while the bond therebetween is cleaved (deblocked), acts as a trigger to release the photographically useful group from the compound of formula (I).

The releasing speed is quite pertinent when the compound is used together with a coupler. Specifically, the compounds of formula (I) can release the photographically useful group therefrom at a speed which is appropriate for the image-forming speed in the reaction of the coupler and the oxidized form of a developing agent. The desired speed for releasing the photographically useful group varies depending upon the kind of the photographically useful groups introduced into the compounds as well as the kinds of couplers used therewith. In the compounds of formula (I), however, the substituents of EAG, $R^1$, and $R^2$ can be selected from broad ranges and, therefore, the desired releasing speed can properly be regulated by the pertinent selection of the substituents for these groups in formula (I). Thus, the present invention includes a series of compounds of formula (I) which can be used for various purposes by various means as well as a series of couplers which can be used for image formation.

The couplers and the compounds of formula (I) which can be used in the present invention further include polymerized ones. In the couplers, any substituent can be polymerized; and in the compounds of formula (I), any substituent of $R^1$, $R^2$, EAG, and $(Time)_t$PUG can be polymerized.

In order to elevate the tolerance and the freedom of the compounds of formula (I) for the characteristics of positive responsive compounds as well as for the synthetic planning thereof, the compounds are further preferred to be those represented by formula (II):

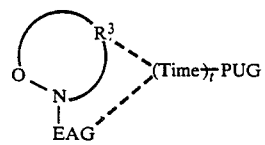

(II)

wherein $R^3$ represents an atomic group which is required for the formation of a 3- to 8-membered, monocyclic or condensed heterocyclic ring, which is linked to the nitrogen atom or oxygen atom in the compound; and the others have the same meanings as given in formula (I).

The substituents in formulae (I) and (II) are described in detail hereinafter.

EAG represents a group for accepting an electron, and is preferably one represented by formula (A) or (B) below:

(A)

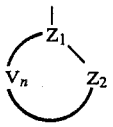

n = 3, 4, 5, 6, 7, 8;

(B)

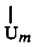

m=an integer of 1 to 6.

In formula (A), $Z_1$ represents

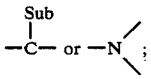

$V_n$ represents an atomic group to form a 3- to 8-membered ring together with $Z_1$ and $Z_2$; n represents an integer of 3 to 8; that is, $V_3$ represents $—Z_3—$; $V_4$ represents $—Z_3—Z_4—$; $V_5$ represents $—Z_3—Z_4—Z_5—$; $V_6$ represents $—Z_3—Z_4—Z_5—Z_6$; $V_7$ represents $—Z_3—Z_4—Z_5—Z_6—Z_7—$; and $V_8$ represents $—Z_3—Z_4—Z_5—Z_6—Z_7—Z_8—$. $Z_2$ through $Z_8$ each represents

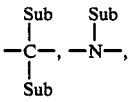

—O—, —S— or $—SO_2—$; Sub represents a chemical bond ($\pi$-bond) or a substituent as mentioned below. Sub groups may be the same or different or may be linked together to form a 3- to 8-membered, saturated or unsaturated, carbon ring or hetero ting. The total of the Hammett's substituent constant $\sigma_p$ of these substituents is +0.09 or more, preferably +0.3 or more, most preferably +0.45 or more.

Examples of the substituents for Sub are given below, where the number of carbon atoms is preferably 0 to 40.

A hydrogen atom, a substituted or unsubstituted alkyl group (such as a methyl group, an ethyl group, a sec-butyl group, a t-octyl group, a benzyl group, a cyclohexyl group, a chloromethyl group, a dimethylaminomethyl group, an n-hexadecyl group, a trifluoromethyl group, a 3,3,3-trichloropropyl group, a methoxycarbonylmethyl group, etc.), a substituted or unsubstituted alkenyl group (such as a vinyl group, a 2-chlorovinyl group, a 1-methylvinyl group, etc.), a substituted or unsubstituted alkinyl group (such as an ethinyl group, a 1-propinyl group, etc.), a cyano group, a nitro group, a halogen atom (such as a fluorine atom, a chlorine atom, a bromine atom, and an iodine atom), a substituted or unsubstituted heterocyclic group (such as a 2-pyridyl group, a 1-imidazolyl group, a benzothiazol-2-yl group, a morpholino group, a benzoxazol-2-yl group, etc.), a sulfo group, a carboxyl group, a substituted or unsubstituted aryloxycarbonyl or alkoxycarbonyl group (such as a methoxycarbonyl group, an ethoxycarbonyl group, a tetradecyloxycarbonyl group, a 2-methoxyethylcarbonyl group, a phenoxycarbonyl group, a 4-cyanophenylcarbonyl group, a 2-chlorophenoxycarbonyl group, etc.), a substituted or unsubstituted carbamoyl group (such as a carbamoyl group, a methylcarbamoyl group, a diethylcarbamoyl group, a methylhexadecylcarbamoyl group, a methyloctadecylcarbamoyl group, a phenylcarbamoyl group, a 2,4,6-trichlorophenylcarbamoyl group, an N-ethyl-N-phenylcarbamoyl group, a 3-hexadecylsulfamoylphenylcarbamoyl group, etc.), a hydroxyl group, a substituted or unsubstituted azo group (such as a phenylazo group, a p-methoxyphenylazo group, a 2-cyano-4-methanesulfonylphenylazo group, etc.), a substituted or unsubstituted aryloxy or alkoxy group (such as a methoxy group, an ethoxy group, a dodecyloxy group, a benzyloxy group, a phenoxy group, a 4-methoxyphenoxy group, a 3-acetylaminophenoxy group, a 3-methoxycarbonylpropyloxy group, a 2-trimethylammonioethoxy group, etc.), a sulfino group, a sulfeno group, a mercapto group, a substituted or unsubstituted acyl group (such as an acetyl group, a trifluoroacetyl group, an n-butyroyl, group, an i-butyroyl group, a benzoyl group, a 2-carboxybenzoyl group, a 3-nitrobenzoyl group, a formyl group, etc.), a substituted or unsubstituted arylthio or alkylthio group (such as a methylthio group, an ethylthio group, a t-octylthio group, a hexadecylthio group, a phenylthio group, a 2,4,5-trichlorothio group, a 2-methoxy-5-t-octylphenylthio group, a 2-acetylaminophenylthio group, etc.), a substituted or unsubstituted aryl group (such as a phenyl group, a naphthyl group, a 3-sulfophenyl group, a 4-methoxyphenyl group, a 3-lauroylaminophenyl group, etc.), a substituted or unsubstituted sulfonyl group (such as a methylsulfonyl group, a chloromethylsulfonyl group, an n-octylsulfonyl group, an n-hexadecylsulfonyl group, a sec-octylsulfonyl group, a p-toluenesulfonyl group, a 4-chlorophenylsulfonyl group, a 4-dodecylphenylsulfonyl group, a 4-dodecyloxyphenylsulfonyl group, a 4-nitrophenylsulfonyl group, etc.), a substituted or unsubstituted sulfinyl group (such as a methylsulfinyl group, a dodecylsulfinyl group, a phenylsulfinyl group, a 4-nitrophenylsulfinyl group, etc.), a substituted or unsubstituted amino group (such as a methylamino group, a diethylamino group, a methyloctadecylamino group, a phenylamino group, an ethylphenylamino group, a 3-tetradecylsulfamoylphenylamino group, an acetylamino group, a trifluoroacetylamino group, an N-hexadecylacetylamino group, an N-methylbenzoylamino group, a methoxycarbonylamino group, a phenoxycarbonylmethylamino group, an N-methoxyacetylamino group, an amidinoamino group, a phenylaminocarbonylamino group, a 4-cyanophenylaminocarbonylamino group, an N-ethylethoxycarbonylamino group, an N-methyldodecylsulfonylamino group, an N-(2-cyanoethyl)-p-toluenesulfonylamino group, a hexadecylsulfonylamino group, etc.), a substituted or unsubstituted sulfamoyl group (such as a dimethylsulfamoyl group, a hexadecylsulfamoyl group, a sulfamoyl group, a methyloctadecylsulfamoyl group, a methylhexadecylsulfamoyl group, a 2-cyanoethylhexadecylsulfamoyl group, a phenylsulfamoyl group, an N-(3,4-dimethylphenyl)-N-octylsulfamoyl group, a dibutylsulfamoyl group, a bis(2-methoxycarbonylethyl)sulfamoyl group, etc.), a substituted or unsubstituted acyloxy group (such as an acetoxy group, a benzoyloxy group, a decyloyloxy group, a chloroacetoxy group, etc.), a substituted or unsubstituted sulfonyloxy group (such as a methylsulfonyloxy group, a p-toluenesulfonyloxy group, a p-chlorophenylsulfonyloxy group, etc.). In formula (B), m represents an integer of 1 to 6; $U_1$ represents $-Y_2$, $U_2$ represents $-Y_1-Y_2$, $U_3$ represents $-Y_1-Y_2-Y_3$, . . . $U_6$ represents $-Y_1-Y_2-Y_3-Y_4-Y_5-Y_6$. $Y_1$ through $Y_6$ each represents

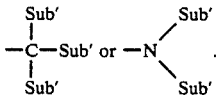

Sub' represents a chemical bond ($\sigma$-bond, $\pi$-bond) or represents a substituent of Sub as mentioned in formula (A). In the case that Sub' represents a substituent, the total of the Hammett's substituent constant $\sigma_p$ of the Sub' groups is +0.09 or more, preferably +0.3 or more, most preferably +0.45 or more.

Specific examples of the group EAG include an aryl group substituted by at least one electron-attractive group (such as a 4-nitrophenyl group, a 2-nitro-4-N-methyl-N-octadecylsulfamoylphenyl group, a 2-N,N-dimethylsulfamoyl-4-nitrophenyl group, a 2-cyano-4-octadecylsulfonylphenyl group, a 2,4-dinitrophenyl group, a 2,4,6-tricyanophenyl group, a 2-nitro-4-N-methyl-N-octadecylcarbamoylphenyl group, a 2-nitro-5-octylthiophenyl group, a 2,4-dimethanesulfonyl phenyl group, a 3,5-dinitrophenyl group, a 2-chloro-4-nitro-5-methylphenyl group, a 2-nitro-3,5-dimethyl-4-tetradecylsulfonylphenyl group, a 2,4-dinitronaphthyl group, a 2-ethylcarbamoyl-4-nitrophenyl group, a 2,4-bisdodecylsulfonyl-5-trifluoromethylphenyl group, a 2,3,4,5,6-pentafluorophenyl group, a 2-acetyl-4-nitrophenyl group, a 2,4-diacetylphenyl group, a 2-nitro-4-trifluoromethylphenyl group, etc.), a substituted or unsubstituted heterocyclic group (such as a 2-pyridyl group, a 2-pyrazyl group, a 5-nitro-2-pyridyl group, a 5-N-hexadecylcarbamoyl-2-pyridyl group, a 4-pyridyl group, a 3,5-dicyano-2-pyridyl group, a 5-dodecylsulfonyl-2-pyridyl group, a 5-cyano-2-pyrazyl group, a 4-nitrothiophen-2-yl group, a 5-nitro-1,3-dimethylimidazol-4-yl group, a 3,5-diacetyl-2-pyridyl group, a 1-dodecyl-5-carbamoylpyridinium-2-yl group, etc.), a substituted or unsubstituted quinone residue (such as a 1,4-benzoquinon-2-yl group, a 3,5,6-trimethyl-1,4-benzoquinon-2-yl group, a 3-methyl-1,4-naphthoquinon-2-yl group, a 3,6-dimethyl-5-hexadecylthio-1,4-benzoquinon-2-yl group, a 5-pentadecyl-1,2-benzoquinon-4-yl group, etc.), as well as vinylogs of the above-mentioned groups and nitroalkanes and $\alpha$-diketo compounds.

$R^3$ represents, as mentioned above, an atomic group which is required for the formation of a 3- to 8-membered heterocyclic ring together with the nitrogen atom in the compound. Examples of the heterocyclic rings are given below.

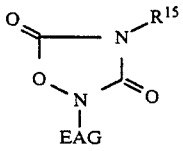

-continued

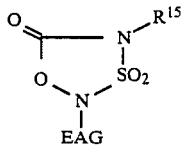

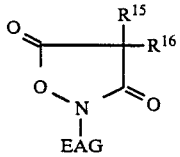

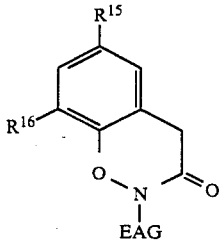

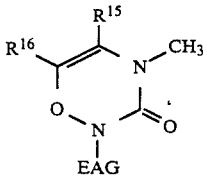

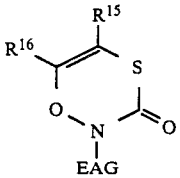

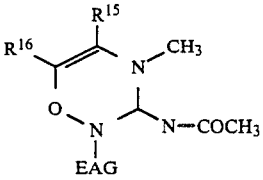

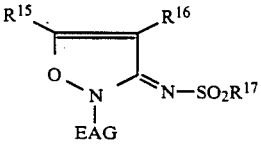

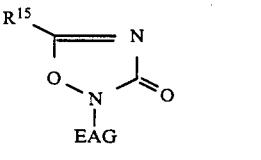

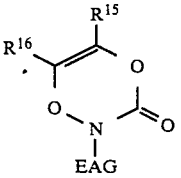

-continued

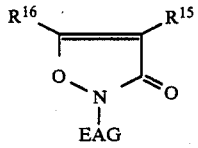

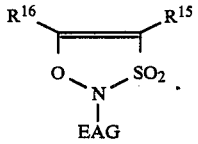

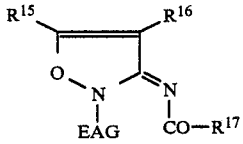

In the above formulae, $R^{15}$, $R^{16}$ and $R^{17}$ each represents a hydrogen atom, an aliphatic group, an aromatic group, a heterocyclic group, or $-(Time)_t-PUG$.

Among the compounds represented by formula (II), those represented by formula (III) below are particularly preferred because they have more sufficient characteristics as a positive responsive compound.

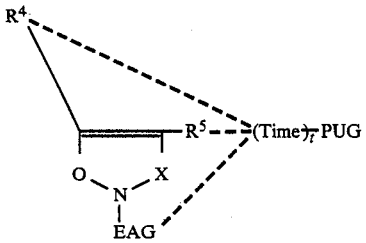

(III)

wherein EAG, Time, t, and PUG have the same meanings as mentioned above; X represents a divalent linking group, and is especially preferably

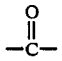

or $-SO_2-$; $R^4$ and $R^5$ each represents a chemical bond, a hydrogen atom, or a substituent, or $R^4$ and $R^5$ are linked together to form a saturated or unsaturated carbon or heterocyclic ring when linked with $(Time)_t$-PUG; or $R^4$ and $R^5$ each represents a hydrogen atom, or a substituent, or $R^4$ and $R^5$ are linked together to form a saturated or unsaturated carbon or heterocyclic ring when not linked with $(Time)_t$PUG; and the dotted lines means that at least one of them forms a chemical bond.

Preferred examples of $R^4$ include a hydrogen atom, a substituted or unsubstituted alkyl group (such as a methyl grup, an ethyl group, a t-butyl group, an octadecyl group, a cyclohexyl group, a phenethyl group, a carboxymethyl group, etc.), a substituted or unsubstituted aryl group (such as a phenyl group, a 3-nitrophenyl group, a 4-methoxyphenyl group, a 4-acetylaminophenyl group, a 4-methanesulfonylphenyl group, a 2,4-dimethylphenyl group, a 4-tetradecyloxyphenyl group, a

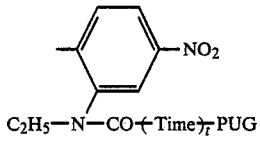

group, etc.), a substituted or unsubstituted heterocyclic group (such as a 2-pyridyl group, a 2-furyl group, a 3-pyridyl group, etc.).

Preferred examples of $R^5$ include a hydrogen atom, a substituted or unsubstituted alkyl group (such as a methyl group, a hydroxymethyl group, a $-CH_2-(Time)_t$PUG group, etc.), a substituted or unsubstituted aryl group (such as a phenyl group, a 4-chlorophenyl group, a 2-methylphenyl group, a

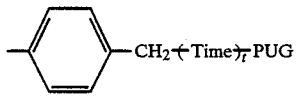

group, a

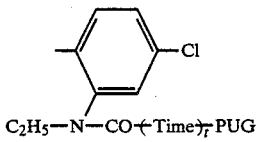

group, etc.), a substituted or unsubstituted heterocyclic group (such as a 4-pyridyl group, etc.).

In the case that $R^4$ and $R^5$ together form a ring, examples of the condensed rings include the following groups;

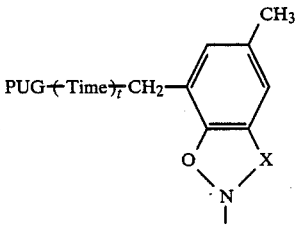

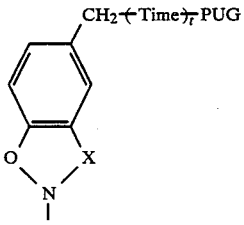

-continued

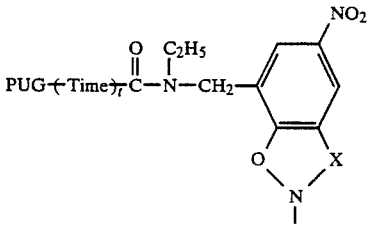

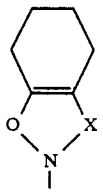

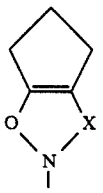

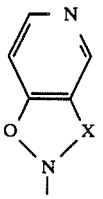

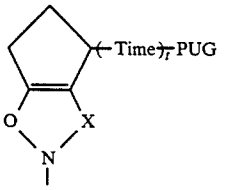

The above formulae each shows the complete structure of the condensed ring, where the free bond shows the position with which the EAG group is to be linked.

Next, the group of $\text{-}(\text{Time})_t\text{PUG}$ is explained hereunder.

Time represents a group capable of releasing PUG which is released by the cleavage of the nitrogen-oxygen single bond in the compound; and t represents 0 or 1.

As the group represented by Time, the following formulae (T-1) through (T-10) are mentioned to be preferable, where (*) shows the position which is bonded to the side of the dotted line in the above-mentioned formula (III), and (*)(*) shows the position with which PUG is to be linked.

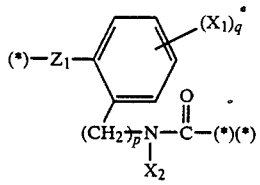

(T-1)

In formula (T-1), $Z_1$ represents

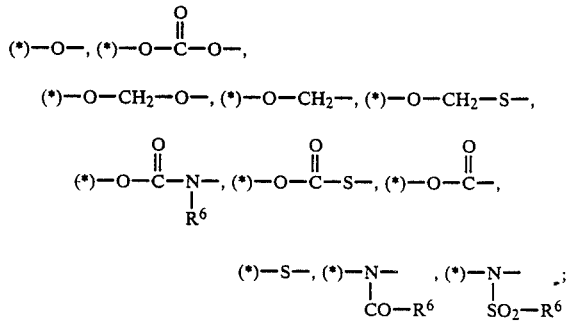

wherein $R^6$ represents a hydrogen atom, an aliphatic group, an aromatic group, or a heterocyclic group; $X_1$ represents a hydrogen atom, an aliphatic group, an aromatic group, a heterocyclic group,

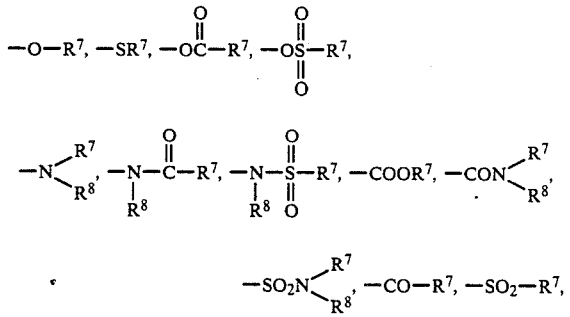

a cyano group, a halogen atom (such as a fluorine atom, a chlorine atom, a bromine atom, an iodine atom) or a nitro group; wherein $R^7$ and $R^8$ may be the same or different and each has the same meaning as $R^6$; $X_2$ has the same meaning as $R^6$; q represents an integer of 1 to 4; when q is 2 or more, $X_1$ groups may be the same or different; or when q is 2 or more, $X_1$ groups may be linked together to form a ring; p represents 0, 1 or 2.

The groups represented by formula (T-1) are described, e.g., in U.S. Pat. No. 4,248,962.

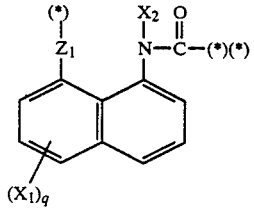

(T-2)

In formula (T-2), $X_1$, $X_2$, and q have the same meanings as defined in formula (T-1).

(T-3)

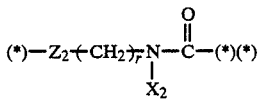

In formula (T-3), $Z_2$ represents

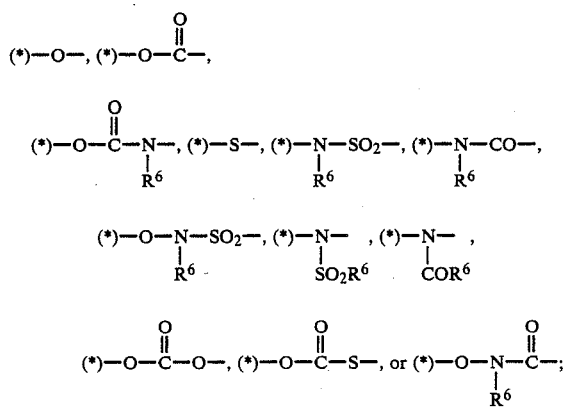

r represents an integer of 1 to 4, preferably 1, 2 or 3; $R^6$ and $X_2$ have the same meanings as given in formula (T-1).

(T-4)

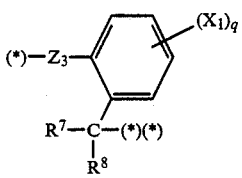

In formula (T-4), $Z_3$ represents

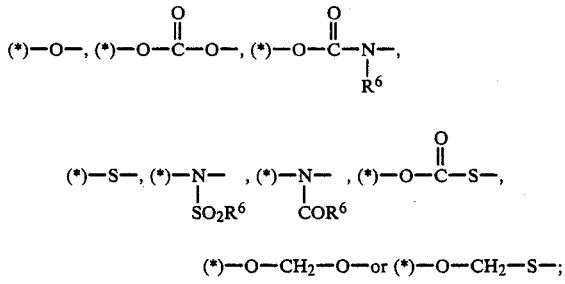

$R^6$, $R^7$, $R^8$, $X_1$ and q have the same meanings as given in formula (T-1).

The groups represented by formula (T-4) are timing groups as described, e.g., in U.S. Pat. No. 4,409,323.

(T-5)

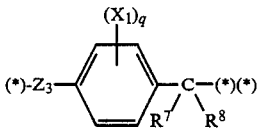

In formula (T-5), $Z_3$, $R^7$, $R^8$, $X_1$, and q have the same meanings as given in formula (T-4).

(T-6)

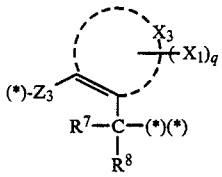

In formula (T-6) $X_3$ represents an atomic group necessary for the formation of a 5- to 7-membered heterocyclic ring, which comprises a combination of at least one or more atoms selected from a carbon, nitrogen, oxygen and/or sulfur atom; and the heterocyclic ring may further be condensed with a benzene ring or a 5- or 7-membered heterocyclic ring. Preferred examples of these heterocyclic rings include pyrrole, pyrazole, imidazole, triazole, furan, oxazole, thiophene, thiazole, pyridine, pyridazine, pyrimidine, pyrazine, acepine, oxepine, indole, benzofuran, and quinoline rings; $Z_3$, $X_1$, q, $R^7$ and $R^8$ have the same meanings as given in formula (T-4).

The groups represented by formula (T-6) are, for example, timing groups as described, e.g., in British Pat. No. 2,096,783.

(T-7)

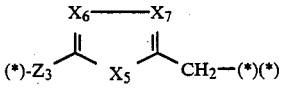

In formula (T-7) , $X_5$ represents an atomic group necessary for the formation of a 5- to 7-membered heterocyclic ring, which comprises a combination of at least one or more atoms as selected from a carbon, nitrogen, oxygen or sulfur atom; $X_6$ and $X_7$ each represents

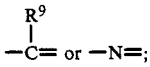

wherein $R^9$ represents a hydrogen atom, an aliphatic group or an aromatic group; wherein the heterocyclic ring may further be condensed with a benzene ring or a 5- to 7-membered heterocyclic ring.

Preferred examples of these heterocyclic rings include pyrrole, imidazole, triazole, furan, oxazole, oxadiazole, thiophene, thiazole, thiadiazole, pyridine, pyridazine, pyrimidine, pyrazine, azepine, oxepine, and isoquinoline rings. $Z_3$, $X_1$, and q have the same meanings as defined in formula (T-4).

(T-8)

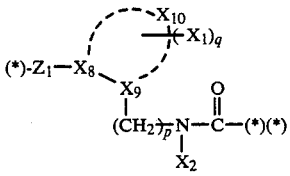

In formula (T-8), $X_{10}$ represents an atomic group necessary for the formation of a 5- to 7-membered heterocyclic ring, which comprises a combination of at least one or more atoms as selected from a carbon, nitrogen, oxygen and/or sulfur atom; $X_8$ and $X_9$ each represents

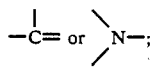

wherein the heterocyclic ring may further be condensed with a benzene ring or a 5- to 7-membered heterocyclic ring; $Z_1$, $X_1$, $X_2$, p, and q have the same meanings as defined in formula (T-1).

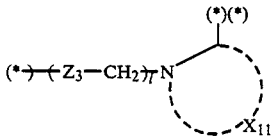

(T-9)

In formula (T-9), $X_{11}$ has the same meaning as $X_{10}$ as defined in formula (T-8); $Z_3$ has the same meaning as defined in formula (T-4); l represents 0 or 1.

Examples of preferred heterocyclic rings are given hereunder.

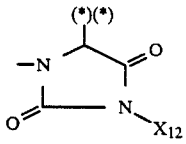

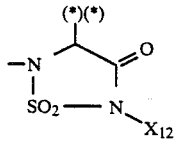

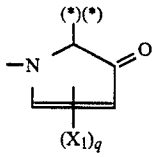

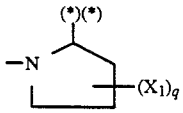

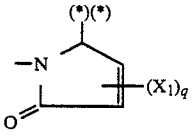

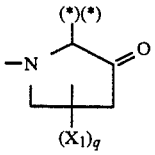

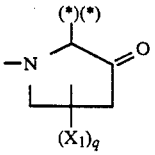

-continued

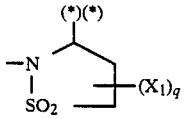

In these formulae, $X_1$ and q have the same meanings as defined in formula (T-1); $X_{12}$ represents a hydrogen atom, an aliphatic group, an aromatic group, an acyl group, a sulfonyl group, an alkoxycarbonyl group, a sulfamoyl group, a heterocyclic group, or a carbamoyl group.

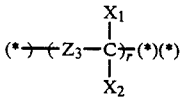

(T-10)

In formula (T-10), $X_1$ and $X_2$ have the same meanings as defined in formula (T-1); $Z_3$ has the same meaning as defined in formula (T-4); r has the same meaning as defined in formula (T-3), and is preferably 1 or 2.

In the above-mentioned formulae (T-1) through (T-10), when $X_1$, $X_2$, $R^6$, $R^7$, $R^8$ and $R^9$ contain a part of an aliphatic group, the aliphatic group is preferably one having from 1 to 20 carbon atoms and may be a saturated or unsaturated, substituted or unsubstituted, linear or cyclic, or straight linear, or branched one. When $X_1$, $X_2$, $R^6$, $R^7$, $R^8$ and $R^9$ in the formulae contain a part of an aromatic group, the aromatic group has from 6 to 20 carbon atoms, preferably from 6 to 10 carbon atoms, and more preferably, the group is a substituted or unsubstituted phenyl group. When $X_1$, $X_2$, $R^6$, $R^7$, $R^8$ and $R^9$ in the formulae contain a part of a heterocyclic group, the heterocyclic group is a 5- or 6-membered one having at least one hetero atom selected from a nitrogen atom, an oxygen atom and/or a sulfur atom. In particular, preferred heterocyclic groups are a pyridyl group, a furyl group, a thienyl group, a triazolyl group, an imidazolyl group, a pyrazolyl group, a thiadiazolyl group, an oxazolyl group, and a pyrrolidinyl group.

As the timing groups, the following groups are preferably mentioned:

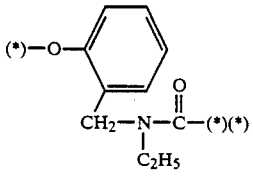

(1)

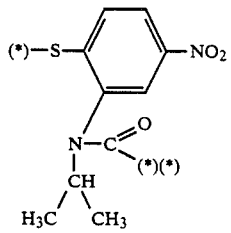

(2)

-continued
(3)
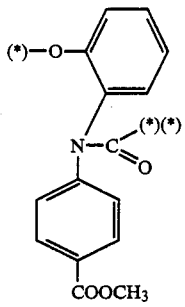
(4)
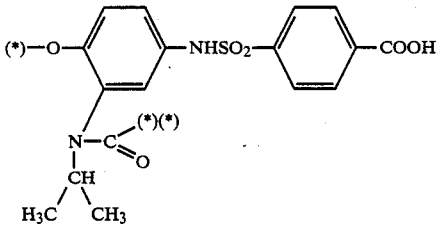
(5)
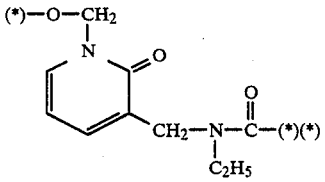
(6)
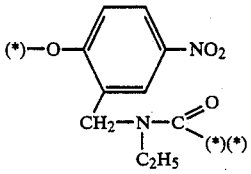
(7)
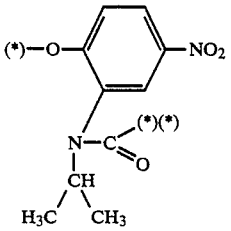
(8)
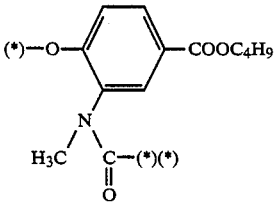
(9)
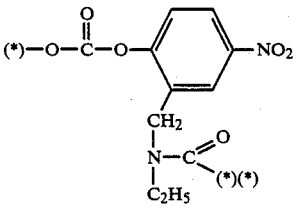
-continued
(10)
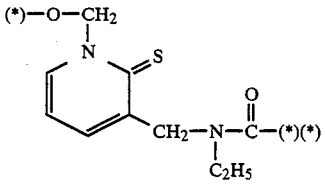
(11)
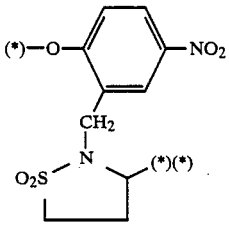
(12)
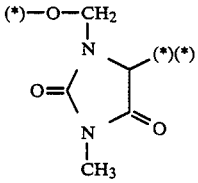
(13)
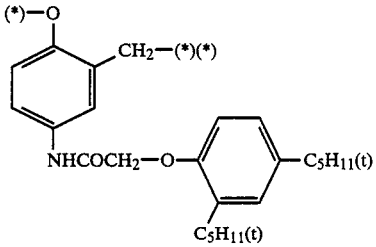
(14)
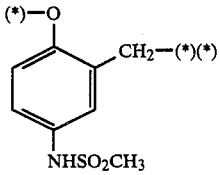
(15)
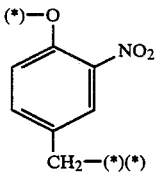
(16)
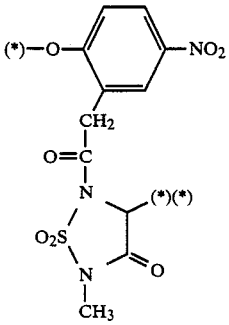

-continued
(17)
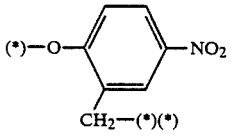
(18)
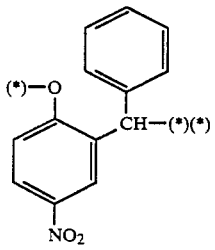
(19)
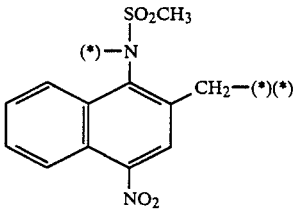
(20)
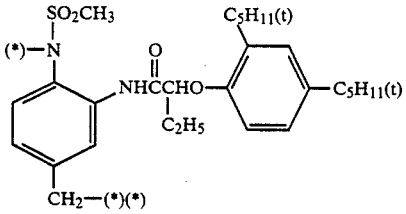
(21)
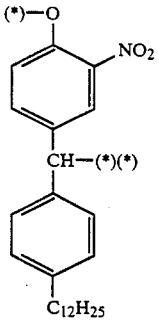
(22)
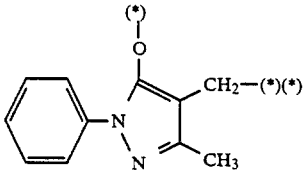
(23)
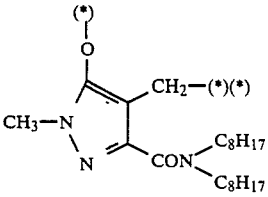
-continued
(24)
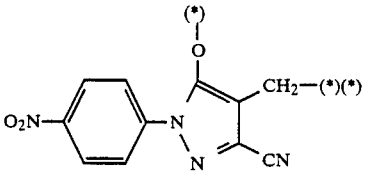
(25)
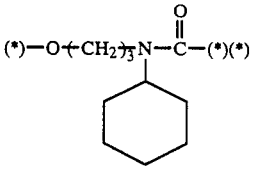
(26)
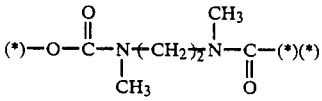
(27)
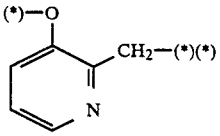
(28)
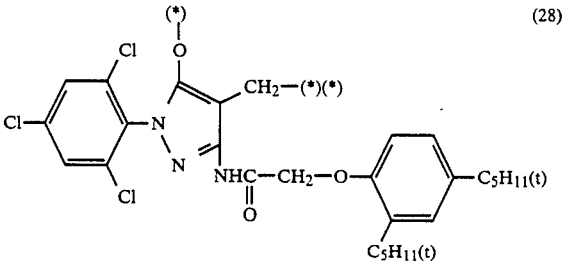
(29)
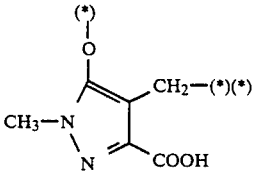
(30)
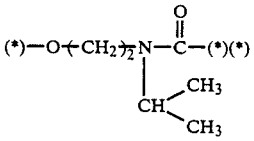
(31)
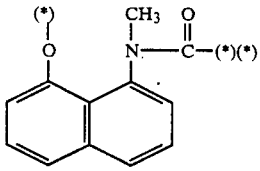
(32)
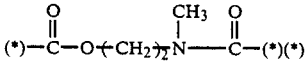
(33)
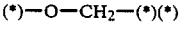
(34)
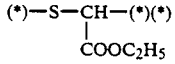

-continued

(35) 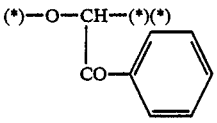

(36) 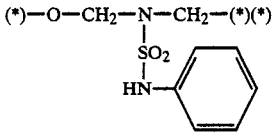

(37) 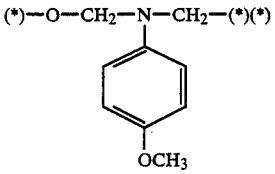

(38) 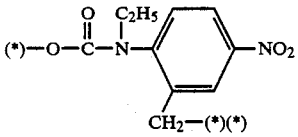

(39) 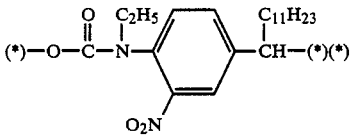

(40) 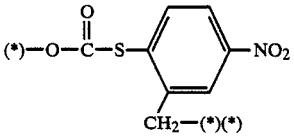

(41) 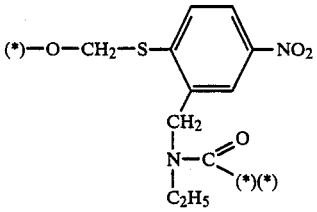

(42) 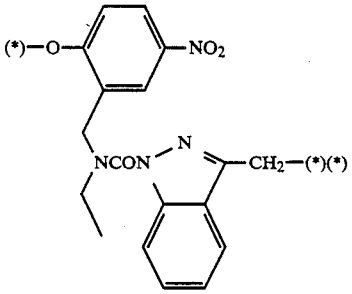

(43) 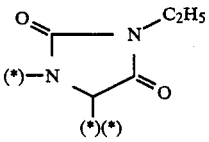

PUG represents a photographically useful group in the form of Time-PUG or PUG.

In formulae (I) to (III), PUG is preferably connected to $\text{-(Time)}_T$ via a hetero atom contained in PUG, more preferably via a sulfur atom, a nitrogen atom, or an oxygen atom contained in PUG.

The photographically useful groups include, for example, residual groups of a development inhibitor, a development accelerator, a nucleating agent, a coupler, a diffusible or nondiffusible dye, a desilvering accelerator, a desilvering inhibitor, a silver halide solvent, a competing compound, a developer, a development auxiliary, a fixation accelerator, a fixation inhibitor, an image stabilizer, a color image stabilizer, a photographic dye, a desensitizer, a ligand capable of forming a dye by complex formation with a metal ion, a fluorescent whitening agent as well as precursors thereof.

Most of these photographically useful groups overlap with each other in the point of the useful characteristics thereof, and typical examples of such groups are mentioned below.

Examples of the development inhibitors include compounds having a mercapto group linked with a heterocyclic ring, for example, substituted or unsubstituted mercaptoazoles (for example, 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[3-(3-methylureido)phenyl]-5-mercaptotetrazole, 1-(4-nitrophenyl)-5-mercaptotetrazole, 5-(2-ethylhexanoylamino)-2-mercaptobenzimidazole, etc.), substituted or unsubstituted mercaptoazaindenes (for example, 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, 4,6-dimethyl-2-mercapto-1,3,3a,7-tetraazaindene, etc.), substituted or unsubstituted mercaptopyrimidines (for example, 2-mercaptopyrimidine, 2-mercapto-4-methyl-6-hydroxypyrimidine, 2-mercapto-4-propylpyrimidine, etc.). Further, there may be mentioned heterocyclic compounds capable of forming an iminosilver, for example, including substituted or unsubstituted benzotriazoles (for example, benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, etc.), substituted or unsubstituted indazoles (for example, indazole, 5-nitroindazole, 3-nitroindazole, 3-chloro-5-nitroindazole, 3-cyanoindazole, 3-n-butylcarbamoylindazole, 5-nitro-3-methanesulfonylindazole, etc.), substituted or unsubstituted benzimidazoles (for example, 5-nitrobenzimidazole, 4-nitrobenzimidazole, 5,6-dichlorobenzimidazole, 5-cyano-6-chlorobenzimidazole, 5-trifluoromethyl-6-chlorobenzimidazole, etc.).

The development inhibitors may be such that they may become a compound having a development inhibiting activity after having been released from the redox mother nucleus of formula (I) by the reaction to follow the oxidation reduction reaction in the step of the development treatment, and that the thus-released compound having development inhibiting property may further be converted into a compound which does not substantially have the development inhibiting activity or which has an extremely reduced development inhibiting activity.

Examples thereof include 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-(phenoxycarbonyl)benzotriazole, 5-(p-cyanophenoxycarbonyl)benzotriazole, 2-phenoxycarbonylmethylthio-5-mercapto-1,3,4-thiadiazole, 5-nitro-3-phenoxycarbonylindazole, 5-phenoxycarbonyl-2-mercaptobenzimidazole, 5-(2,3-dichloropropyloxycarbonyl)benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonylethoxycarbonyl)-2-mercaptobenzothiazole, 1-[4-(2-chloroethoxycarbonyl)phenyl]-2-mercaptoimidazole, 2-[3-(thiophen-2-ylcarbonyl)propyl]thio-5-mercapto-1,3,4-thiadiazole, 5-cinnamoylaminobenzotriazole, 1-(3-vinylcarbonylphenyl)-5-mercaptotetrazole, 5-succinimidomethylbenzotriazole, 2-(4-succinimidophenyl)-5-mercapto-1,3,4-oxadiazole, 3-[4-(benzo-1,2-isothiazol-3-oxo-1,1-dioxy-2-yl)phenyl]-5-mercapto-4-methyl-1,2,4-triazole, 6-phenoxycarbonyl-2-mercaptobenzoxazole, etc.

In the case that PUG is a silver halide solvent, examples thereof include meso-ionic compounds as described, e.g., in Japanese patent application (OPI) No. 163042/85 (the term "OPI" as used herein refers to a "published unexamined Japanese patent application"), U.S. Pat. Nos. 4,003,910 and 4,378,424; and mercaptoazoles or azolethiones having an amino group as a substituent as described, e.g., in Japanese patent application (OPI) No. 20253/82; and more specifically the compounds as described in Japanese patent application (OPI) No. 71768/85.

In the case that PUG is a nucleating agent, examples thereof include the parts of the removing groups released from the couplers described in Japanese patent application (OPI) No. 170840/84.

In the case that PUG is a dye, examples of the dyes include azo dyes, azomethine dyes, indoaniline type dyes, indophenol type dyes, anthraquinone type dyes, triarylmethane type dyes, alizarins, nitro type dyes, quinoline type dyes, indigo type dyes, phthalocyanine type dyes, etc. In addition, there may be mentioned the leuco forms of the dyes as well as those having a temporarily shifted absorption wavelength and dye precursors. Further, dyes capable of chelating may also be mentioned.

The above-mentioned dyes are described, for example, in the following references.

Specifically, the dyes can be selected from those (as well as nondiffusible analogs thereof) as described in U.S. Pat. Nos. 3,880,658, 3,931,144, 3,932,380, 3,932,381, 3,942,987 and J. Fabian & H. Hartmann, *Light Absorption of Organic Colorants* (published by Springer-Verlag). However, these dyes are not whatsoever limitative.

In the case that PUG is a dye, this is preferably a dye having a temporarily shifted absorption wavelength to short wavelength, where the auxochrome is blocked with a cleavable group. Specifically, such compounds are preferred that may reproduce the original dye after the compound of formula (I) has been reacted with a reducing agent and released the PUG via the series of the succeeding reactions. In the case of azo dyes, for example, the temporary shifting to short wavelength is attained by blocking the hydroxyl group, mercapto group or amino group, which is auxochrome of the dyes. Examples of the dyes which are short wavelength-shifted with a blocking group include the compounds as described in U.S. Pat. Nos. 4,234,672, 4,310,612, 3,579,334, 3,999,991, 3,994,731 and 3,230,085.

In the case that PUG is a dye, this is also preferably a dye which masks to correct sub-absorption of a dye formed from the image forming coupler. Such dye masking sub-absorption preferably has a temporarily shifted absorption wavelength to short wavelength.

In the practice of the present invention, the use of the compounds of formula (I) having a temporarily short-waved dye (or a temporarily short-waved magenta dye) as the PUG, which dye has a maximum absorption between 500 nm and 600 nm when color reproduced (or when the dye has been released by the cleavage of the O—N single bond in formula (I)), in combination with a cyan coupler is preferred; and the use of the compounds of formula (I) having a temporarily short-waved dye (or a temporarily short-waved yellow dye) as the PUG, which dye has a maximum absorption between 400 nm and 500 nm when color reproduced, in combination with a magenta coupler is also preferred.

Especially preferred examples of the temporarily short-waved dyes for PUG are those of the following formulae:

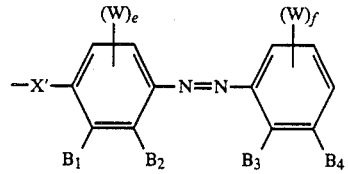

(D-1)

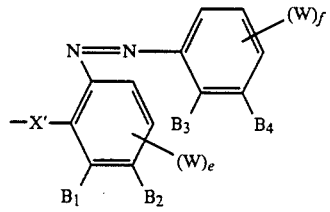

(D-2)

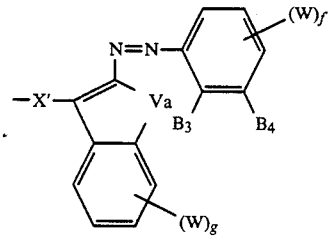

(D-3)

-continued (D-4)

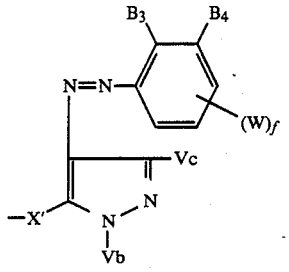

(D-5)

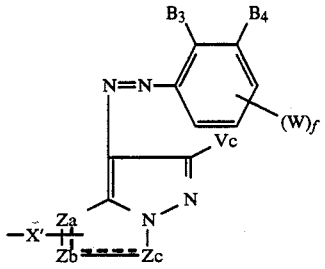

(D-6)

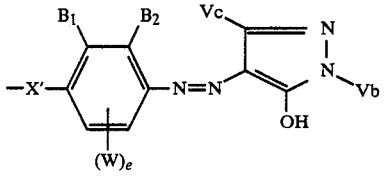

(D-7)

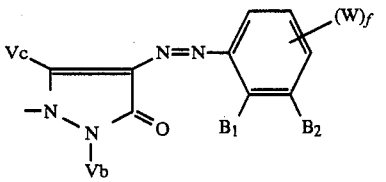

In the above formulae, X' represents —O—, —S— or —NH—, and the free bond is linked with $\text{-(Time)}_T$ in formula (I); e represents an integer of 0 to 2; f represents an integer of 0 to 3; g represents an integer of 0 to 4; Va represents an imino group which may optionally have a substituent such as a sulfur atom, an oxygen atom, or an aliphatic group; W represents an aliphatic group (for example, a methyl group, an ethyl group), an aromatic group (for example, a phenyl group, a naphthyl group), an acyl group (for example, an acetyl group, a benzoyl group), an alkoxycarbonyl group (for example, a methoxycarbonyl group, a dodecyloxycarbonyl group), an aryloxycarbonyl group (for example, a phenoxycarbonyl group, a naphthyloxycarbonyl group), an acylamino group (for example, a tetradecanamido group, a benzamido group, a 2,2-dimethylpropanamido group), an alkylthio group (for example, a methylthio group, an octylthio group), an arylthio group (for example, a phenylthio group, a p-t-butylphenylthio group), a sulfonyl group (for example, a methanesulfonyl group, a benzenesulfonyl group), a halogen atom (for example, a chlorine atom, a fluorine atom, a bromine atom), a nitro group, a nitroso group, a cyano group, a carboxyl group, a hydroxyl group, a sulfonamido group (for example, a methanesulfonamido group, a benzenesulfonamido group, a hexadecylsulfonamido group), an alkoxy group (for example, a methoxy group, a dodecyloxy group), an aryloxy group (for example, a phenoxy group, a p-nonylphenoxy group), an acyloxy group (for example, an acetoxy group, a benzoyloxy group), a carbamoyl group (for example, a dodecylcarbamoyl group, an N,N-dihexylcarbamoyl group), an amino group (for example, an N,N-dioctylamino group, a pyrrolidino group), a ureido group (for example, a 3-phenylureido group, a 3-dodecylureido group), a sulfamoyl group (for example, an N-methyl-N-octadecylsulfamoyl group, an N-[3-(2,4-di-t-amylphenoxy)propyl]-sulfamoyl group), or a heterocyclic group (e.g., a 3- to 7-membered heterocyclic group having hetero atom(s) selected from a nitrogen atom, an oxygen atom, and/or a sulfur atom; for example, a pyridyl group, an imidazolyl group, a furyl group, etc.); $B_1$, $B_2$, $B_3$ and $B_4$ each represents a hydrogen atom or the substituent as mentioned for group W; or $B_1$ and $B_2$, and $B_3$ and $B_4$ may be linked together to form a benzene-condensed ring. In the case of the benzene-condensed rings, the part of the rings may optionally be substituted by the substituent(s) as mentioned for group W.

In the formulae, when e, f or g is an integer of 2 or more, W groups may be the same or different.

Vb represents an aliphatic hydrocarbon residual group, an aryl group or a heterocyclic group. In the case that Vb represents an aliphatic hydrocarbon residual group, this may be saturated or unsaturated, and linear, branched or cyclic. Preferably, this is an alkyl group having from 1 to 22 carbon atoms (for example, a methyl group, an ethyl group, an isopropyl group, a butyl group, a dodecyl group, an octadecyl group, or a cyclohexyl group) or an alkenyl group (for example, an allyl group or an octenyl group).

As the aryl group, a phenyl group and a naphthyl group are preferred; and as the heterocyclic group, a pyridinyl group, a quinolyl group, a thienyl group, a piperidyl group, and an imidazolyl group are preferred.

Examples of the substituents which can be introduced into the aliphatic hydrocarbon residual group, the aryl group, and the heterocyclic group are those as mentioned for the abovesaid W.

Vc represents a linear or branched alkyl, alkenyl, cyclic alkyl, aralkyl or cyclic alkenyl group having from 1 to 32, preferably from 1 to 22, carbon atoms, or an aryl group, a heterocyclic group or an alkoxycarbonyl group (for example, a methoxycarbonyl group, a stearyloxycarbonyl group), an aryloxycarbonyl group (for example, a phenoxycarbonyl group, a naphthoxycarbonyl group, etc.), an aralkyloxycarbonyl group (for example, a benzyloxycarbonyl group, etc.), an alkoxy group (for example, a methoxy group, an ethoxy group, a heptadecyloxy group, etc.), an arylamino group (such as an anilino group, a 2-chloroanilino group), an aryloxy group (for example, a phenoxy group, a tolyloxy group, etc.), an acylamino group (for example, an acetylamino group, a 3-[(2,4-di-tert-amylphenoxy)acetamido]benzamido group, etc.), a diacylamino group, an N-alkylacylamino group (for example, an N-methylpropionamido group), an N-arylacylamino group (for example, an N-phenylacetamido group), a ureido group (for example, a ureido group, an N-arylureido group, an N-alkylureido group, etc.), an alkylamino group (for example, an n-butylamino group, a methylamino group, a cyclohexylamino group, etc.), a cycloamino group (for example, a piperidino group, a pyridino group, etc.), a sulfonamido group (for example, an alkylsulfonamido group, an arylsulfonamido group, etc.). These groups may optionally be substituted by the substituent(s) as mentioned for the aforesaid group W.

Vc may further be a halogen atom (for example, a chlorine atom, a bromine atom, etc.) or a cyano group.

Za, Zb and Zc each represents a methine group, a substituted methine group, =N— or —NH—; and one of the Za—Zb bond and the Zb—Zc bond is a double bond and the other is a single bond; with the proviso that all of these Za, Zb and Zc must not be hydrogens at the same time. In the case that the Zb—Zc is a carbon-carbon double bond, this may be a part of an aromatic ring, which may further be substituted by the substituent(s) as mentioned for the aforesaid group W.

In addition, either of Za, Zb, and Zc is linked with X' to form a structure of

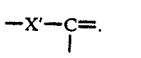

The photographically useful group may be a ligand capable of forming a dye by the complex-forming reaction with a metal ion. Preferred ligands are such that may coordinate with a metal ion (for example, $Fe^{2+}$, $Co^{2+}$, $Cu^{2+}$, $Cu^{+}$, $Ru^{2+}$, preferably $Fe^{2+}$), after having been released from the compound of formula (I) during the development procedure, to form a complex compound, which has a desired hue or a desired molecular extinction coefficient. In the practice of the present invention, the use of the compound of formula (I) which has a ligand capable of having an absorption maximum in 500 nm to 600 nm when coordinated with a metal ion, as PUG, in combination with a cyan coupler is preferred; and the use of the compound of formula (I) which has a ligand capable of having an absorption maximum in 400 to 500 nm when coordinated with a metal ion, as PUG, in combination with a magenta coupler is also preferred. More preferred ligands are those represented by the following formula (L-I) or (L-II), where (*) shows the position to be linked with $\text{-(Time)}_T$.

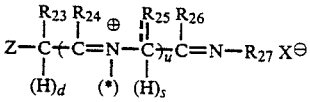

(L-I)

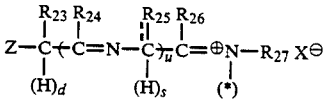

(L-II)

In formulae (L-I) and (L-II), u represents an integer of 0 to 3; d and s each represents 0 or 1; ▬▬▬ shows a double bond when s is 0, or a single bond when s is 1; Z represents $R_{28}$—N=, O=, S=, $R_{28}$—P=, $(R_{28})_2P$—, $(R_{28})_3P$=; with the proviso that when Z is $(R_{28})_2P$—, d is 1; and that when Z is the other group, d is 0; $R_{23}$ through $R_{28}$ each represents a hydrogen atom, an amino group, a substituted amino group, a mercapto group, an alkoxy group (preferably having from 1 to 30 carbon atoms, for example, a methoxy group, a chloromethoxy group, an ethoxy group, and an octyloxy group), an alkyl group (preferably having from 1 to 30 carbon atoms, for example, a methyl group, an ethyl group, a chloromethyl group, an isopropyl group, a t-butyl group, and a heptyl group), an aryl group (preferably having from 6 to 14 carbon atoms, for example, a phenyl group, a naphthyl group, a xylyl group, and a p-methoxyphenyl group), a heterocyclic group (preferably having from 3 to 20 carbon atoms and containing hetero atom(s) selected from a nitrogen atom, a sulfur atom, and/or an oxygen atom, for example, a pyridyl group, a pyrimidyl group, a thiazolyl group, an imidazolyl group, and a thienyl group).

In formulae (L-I) and (L-II), when u is 0, $R_{28}$ and $R_{23}$, $R_{23}$ and $R_{26}$, and $R_{26}$ and $R_{27}$ are linked together to form a non-metallic atomic group necessary for completing a substituted or unsubstituted 5- to 20-membered monocyclic or condensed cyclic carbon ring or heterocyclic ring. Preferred examples of these rings are a pyridine ring, a quinoline ring, a triazine ring, a phenanthroline ring, a pyrimidine ring, etc.

In formulae (L-I) and (L-II), when u is 1, 2 or 3, $R_{28}$ and $R_{23}$, $R_{24}$ and $R_{25}$, and $R_{26}$ and $R_{27}$ are linked together to form a non-metallic atomic group necessary for completing a substituted or unsubstituted 5- to 20-membered monocyclic or condensed cyclic carbon ring or heterocyclic ring. Preferred examples of these rings are those mentioned above for the case of u is 0.

$X^{\ominus}$ represents a counter anion (for example, $Cl^{\ominus}$, $Br^{\ominus}$, $CH_3SO_3^{\ominus}$,

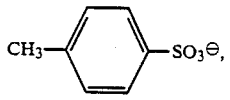

$BF_4^{\ominus}$, $PF_6^{\ominus}$, etc.).

Next, preferred examples of the ligands represented by formula (L-I) or (L-II) are given below, which, however, are not whatsoever limitative.

Lig-1

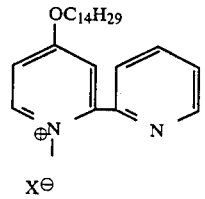

Lig-2

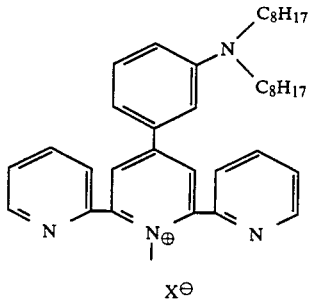

Lig-3

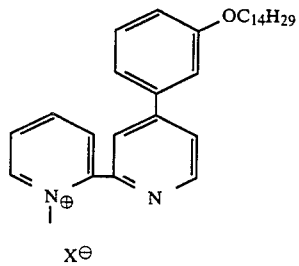

-continued

Lig-4

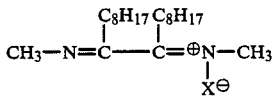

Lig-5

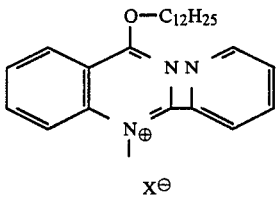

Lig-6

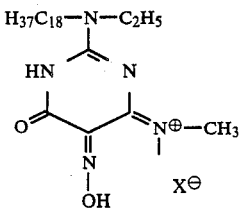

Lig-7

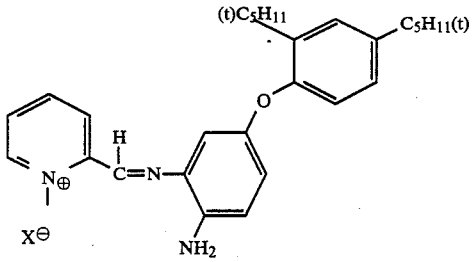

Lig-8

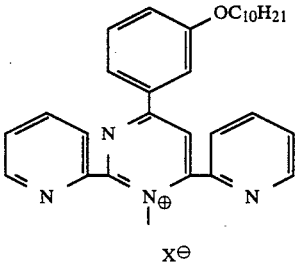

Lig-9

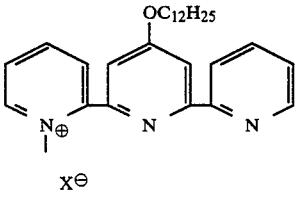

Lig-10

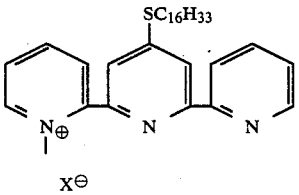

-continued

Lig-11

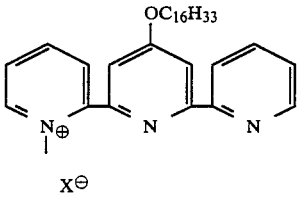

Lig-12

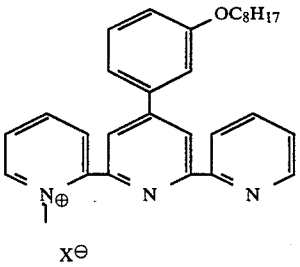

As the metal ion which may react with the above-mentioned ligand to form a dye, there may be mentioned Fe(II), Co(II), Cu(II), Cu(I), Ru(II), Os(II), etc.; and Fe(II) is most preferred among them.

The metal ion may be added to a bath which is provided before and/or after the desilvering step or between the bleaching bath and the fixation bath.

In addition, the metal ion can be added to a bath having a bleaching function, whereby a sufficient complex formation can be attained. In this case, the use of $Fe^{2+}$ is most preferred for the complex formation.

In this embodiment of the present invention, the concentration of the Fe(II) ion-containing bath or the concentration of Fe(II) in the bleaching bath is preferred to be high. The lowest concentration of the Fe(II) ion, which is sufficient for coloration, to be added to the treating bath varies depending upon the stability coefficient of the Fe(II) salt added to the bath and, in general, the Fe(II) ion concentration of from $1\times10^{-6}$ to 1 mol/liter is effective for attaining the sufficient color density. Preferably, the Fe(II) ion concentration is from $1\times10^{-4}$ to 1 mol/liter, more preferably from $1\times10^{-3}$ to 1 mol/liter.

The amount of the Fe(II) ion in the bleaching bath can be determined by the use of a metal indicator such as o-phenanthroline.

Other examples of PUG in formula (I) of the present invention are described in U.S. Pat. No. 4,248,962 and U.S. patent application Ser. No. 813,308 filed on Dec. 24, 1985.

Next, the couplers to be used in the present invention will be explained in detail hereinafter.

Various couplers can be used in the present invention, for example, as given below. There may be image-forming couplers, DIR couplers (for example, those described, e.g., in U.S. Pat. Nos. 3,227,554, 4,146,396, 4,248,962, 4,409,323, 4,421,845, 4,477,563, and 3,148,062), weakly diffusible dye-forming couplers (for example, those described, e.g., in U.S. Pat. Nos. 4,522,915 and 4,420,556), development accelerator-releasing or fogging agent-releasing couplers (for example, those described, e.g., in U.S. Pat. No. 4,390,618), colored couplers (for example, those described, e.g., in U.S. Pat. Nos. 4,004,929, 4,138,258, and 4,070,191), competing couplers (for example, those described, e.g., in U.S. Pat. No. 4,130,427), polyvalent couplers (for example, those described, e.g., in U.S. Pat. Nos. 4,283,472, 4,338,393, and 4,310,618), DIR redox compound-releasing couplers (for example, those described, e.g., in Japanese Patent Application (OPI) No. 185950/85), couplers for releasing such dyes as re-coloring after being released (for example, those described, e.g., in European Patent Application 173,302A) as well as other various kinds of polymer couplers (for example, those described, e.g., in U.S. Pat. Nos. 3,767,412, 3,623,871, 4,367,282, and 4,474,870).

The dyes to be formed or released from the couplers may be any one of yellow, magenta and cyan. For instance, there may be acylacetamido type couplers and malondiamido type couplers as the yellow couplers; there may be, for example, 5-pyrazolone type couplers, pyrazoloimidazole type couplers and pyrazolotriazole type couplers as the magenta couplers; and there may be, for example, phenol type couplers and naphthol type couplers as the cyan couplers. All of them may be either 4-equivalent or 2-equivalent couplers. Further, such couplers that do not substantially form any dye can be used in the present invention, for example, those described in U.S. Pat. Nos. 3,958,993, 3,961,959, 4,315,070, 4,183,752 and 4,171,223 can be used.

Typical examples of the couplers which are preferably used in the present invention are those of the following formulae (Cp-1), (Cp-2), (Cp-3), (Cp-4), (Cp-5), (Cp-6), (Cp-7) and (Cp-8):

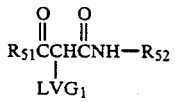
(Cp-1)

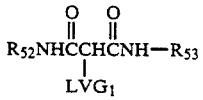
(CP-2)

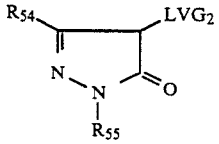
(Cp-3)

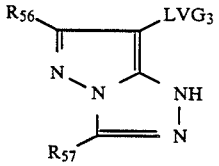
(Cp-4)

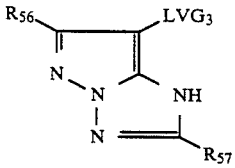
(Cp-5)

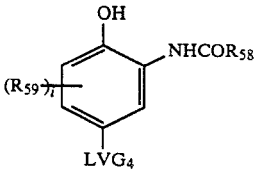
(Cp-6)

-continued

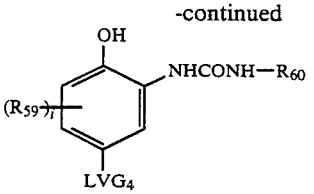
(Cp-7)

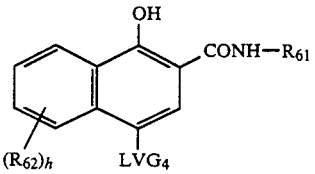
(Cp-8)

$R_{51}$ through $R_{62}$, $LVG_1$ through $LVG_4$ and i and h in the above formulae are explained hereunder.

In the case that $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $LVG_1$, $LVG_2$, $LVG_3$, or $LVG_4$ in the above-mentioned formulae contains an antidiffusible group, the group is selected so as to have a total carbon number of from 8 to 40, preferably from 12 to 32; and in the other cases, the total carbon number is preferably 15 or less. In the case of bis type, telomer type or polymer type couplers, either of the above-mentioned sbustituents is a divalent group for combining the repeating units. In this case, the limitation on the above-mentioned carbon number in the substituents is not necessarily adopted thereto.

In the following explanation, $R_{41}$ represents an aliphatic group, an aromatic group or a heterocyclic group; $R_{42}$ represents an aromatic group or a heterocyclic group; $R_{43}$, $R_{44}$ and $R_{45}$ each represents a hydrogen atom, an aliphatic group, an aromatic group or a heterocyclic group.

$R_{51}$ has the same meaning as $R_{41}$. $R_{52}$ and $R_{53}$ each has the same meaning as $R_{42}$. $R_{54}$ has the same meaning as $R_{41}$ or represents an

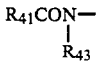

group, an

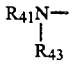

group, an

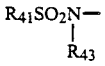

group, an $R_{41}S$— group, an $R_{43}O$— group, an

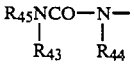

group, an $R_{41}OOC$— group, an

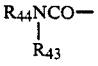

group, or an N≡C— group. $R_{55}$ has the same meaning as $R_{41}$. $R_{56}$ and $R_{57}$ each has the same meaning as $R_{43}$, or each represents an $R_{41}S$— group, an $R_{43}O$— group, an $$R_{41}CON(R_{42})-$$

group, an $$R_{41}N(R_{43})-$$

group, an $$R_{41}OCON(R_{43})-$$

group, an $$R_{43}N(R_{44})-CO-N(R_{45})-$$

group, or an $$R_{41}SO_2N(R_{43})-$$

group. $R_{58}$ has the same meaning as $R_{41}$. $R_{59}$ has the same meaning as $R_{41}$ or represents an $$R_{41}CON(R_{43})-$$

group, an $$R_{41}OCON(R_{43})-$$

group, an $$R_{41}SO_2N(R_{43})-$$

group, an $$R_{43}N(R_{44})-CO-N(R_{45})-$$

group, an $$R_{43}NSO_2N(R_{44})(R_{45})-$$

group, an $R_{41}O$— group, an $R_{41}S$— group, a halogen atom, or an $$R_{41}N(R_{43})-$$

group. i represents 0 to 3. When i is 2 or 3, the plural $R_{59}$ groups may be the same substituent or different substituents. In addition, the $R_{59}$ groups may be a divalent group and linked together to form a cyclic structure. Examples of the divalent groups for forming such cyclic structures include:

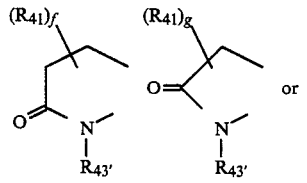

or

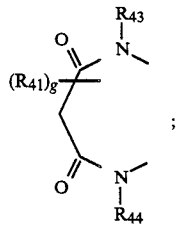

;

wherein f represents an integer of from 0 to 4, g represents an integer of from 0 to 2. $R_{60}$ has the same meaning as $R_{41}$. $R_{61}$ has the same meaning as $R_{41}$. $R_{62}$ has the same meaning as $R_{41}$, or represents an $R_{41}CONH$— group, an $R_{41}OCONH$— group, an $R_{41}SO_2NH$— group, an $$R_{43}N(R_{44})-CO-N(R_{45})-$$

group, an $$R_{43}N(R_{44})-SO_2-N(R_{45})-$$

group, an $R_{43}O$— group, an $R_{41}S$— group, a halogen atom, or an $$R_{41}N(R_{43})-$$

group. h represents an integer of 0 to 4. In the case that the compounds have 2, 3, or 4 $R_{62}$ groups, these substituents may be the same or different.

In the above groups, the aliphatic group includes a saturated or unsaturated, linear or cyclic, straight or branched, substituted or unsubstituted aliphatic hydrocarbon residual group having from 1 to 40 carbon atoms, preferably from 1 to 22 carbon atoms. Typical examples of such residual group include a methyl group, an ethyl group, a propyl group, an isopropyl group, a butyl group, a t-butyl group, an i-butyl group, a t-amyl group, a hexyl group, a cyclohexyl group, a 2-ethylhexyl group, an octyl group, a 1,1,3,3-tetramethylbutyl group, a decyl group, a dodecyl group, a hexadecyl group, or an octadecyl group.

The aromatic group preferably includes a substituted or unsubstituted phenyl group or a substituted or unsubstituted naphthyl group having from 6 to 20 carbon atoms.

The heterocyclic group preferably includes a 3-membered to 8-membered, substituted or unsubstituted heterocyclic group having from 1 to 20 carbon atoms, preferably from 1 to 7 carbon atoms, and having hetero atom(s) selected from a nitrogen atom, an oxygen atom, and/or a sulfur atom. Typical examples of the heterocyclic group include a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group, or a 1-pyrazolyl group.

In the case that the above-mentioned aliphatic hydrocarbon group, aromatic group, and heterocyclic group have substituent(s), the substituents may be selected from a halogen atom, an $R_{47}O$— group, an $R_{46}S$— group, an

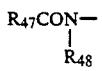

group, an

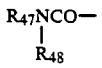

group, an

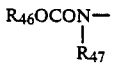

group, an

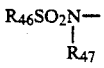

group, an

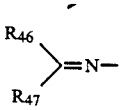

group, an

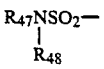

group, an $R_{46}SO_2$—group, an $R_{47}OCO$— group, an

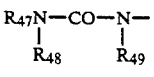

group an

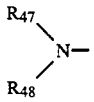

group, a group having the same meaning as $R_{46}$, an

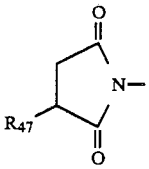

group, an $R_{46}COO$— group, an $R_{47}OSO_2$— group, a cyano group, and a nitro group. In these groups, $R_{46}$ represents an aliphatic group, an aromatic group, or a heterocyclic group; $R_{47}$, $R_{48}$ and $R_{49}$ each represents an aliphatic group, an aromatic group, a heterocyclic group, or a hydrogen atom. The aromatic group and the heterocyclic group each has the same definition as given hereinbefore.

The following explanation gives preferred ranges of $R_{51}$ through $R_{62}$, i, and h.

$R_{51}$ is preferably an aliphatic group or an aromatic group. $R_{52}$, $R_{53}$ and $R_{55}$ each is preferably an aromatic group. $R_{54}$ is preferably an $R_{41}CONH$— group or an

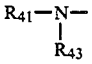

group. $R_{56}$ and $R_{57}$ each is preferably an aliphatic group, an $R_{41}O$— group, or an $R_{41}S$— group. $R_{58}$ is preferably an aliphatic group or an aromatic group. In formula (Cp-6), $R_{59}$ is preferably a chlorine atom, an aliphatic group, or an $R_{41}CONH$— group. i is preferably 1 or 2. $R_{60}$ is preferably an aromatic group. In formula (Cp-7), $R_{59}$ is preferably an $R_{41}CONH$— group. In formula (Cp-7), h is preferably 1. $R_{61}$ is preferably an aliphatic group or an aromatic group. In formula (Cp-8), h is peferably 0 or 1. $R_{62}$ is preferably an $R_{41}O$-CONH— group, an $R_{41}CONH$— group, or an $R_{41}SO_2NH$— group, and the position of the substituent is preferably the 5-position of the naphthol ring in the molecule.

Next, typical examples of the substituents $R_{51}$ through $R_{62}$ are given hereunder.

Examples of $R_{51}$ include a t-butyl group, a 4-methoxyphenyl group, a phenyl group, a 3-[2-(2,4-di-t-amylphenoxy)butanamido]phenyl group, a 4-octadecyloxyphenyl group, or a methyl group. Examples of $R_{52}$ and $R_{53}$ include a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-t-amylphenoxy)butanamido]phenyl group, a 2-chloro-5-[2-(2,4-di-t-amylphenoxy)-butanamido]phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(1-dodecyloxycarbonylethoxycarbonyl)phenyl group, a 2-chlorophenyl group, or a 2-ethoxyphenyl group. Examples of $R_{54}$ include a 3-[2-(2,4-di-t-amylphenoxy)butanamido]benzamido group, a 3-[4-(2,4-di-t-amylphenoxy)butanamido]benzamido group, a 2-chloro-5-tetradecanamidoanilino group, a 5-(2,4-di-t-amylphenoxyacetamido)benzamido group, a 2-chloro-5-dodecenylsuccinimidoanilino group, a 2-chloro-5-[2-(3-t-butyl-4-hydroxyphenoxy)tetradecanamido]anilino group, a 2,2-dimethylpropanimido group, a 2-(3-pentadecylphenoxy)butanamido group, a pyrrolidino group, or an N,N-dibutylamino group. Examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-t-amylphenoxy)butanamido]phenyl group, or a 2,6-dichloro-4-methanesulfonylphenyl group. Examples of $R_{56}$ include a methyl group, an ethyl group, an isopropyl group, a methoxy group, an ethoxy group, a methylthio group, an ethylthio group, a 3-phenylureido group, a 3-butylureido group, or a 3-(2,4-di-t-amylphenoxy)propyl group. Examples of $R_{57}$ include a 3-(2,4-di-t-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)phenylsulfonamido]phenylsulfonamido}ethyl group, a 3-[4-(4-dodecyloxyphenylsulfonamido}phenyl]propyl group, a 1,1-dimethyl-2-[2-octyloxy-5-(1,1,3,3-tetramethylbutyl)phenylsulfonamido]ethyl group, or a dodecylthio group. Examples of $R_{58}$ include a 2-chlorophenyl group, a pentafluorophenyl group, a heptafluoropropyl group, a 1-(2,4-di-t-amylphenoxy)propyl group, a 3-(2,4-di-t-amylphenoxy)propyl group, a 2,4-di-t-amylmethyl group, or a furyl group. Examples of $R_{59}$ include a chlorine atom, a methyl group, an ethyl group, a propyl group, a butyl group, an isopropyl group, a 2-(2,4-di-t-amylphenoxy)butanamido group, a 2-(2,4-di-t-amylphenoxy)hexanamido group, a 2-(2,4-di-t-octylphenoxy)octanamido group, a 2-(2-chlorophenoxy)tetradecanamido group, a 2,2-dimethylpropanamido group, a 2-[4-(4-hydroxyphenylsulfonyl)phenoxy]tetradecanamido group, or a 2-[2-(2,4-di-t-amylphenoxyacetamido)phenoxy]butanamido group. Examples of $R_{60}$ include a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, or a 3-methoxycarbonylphenyl group. Examples of $R_{61}$ include a dodecyl group, a hexadecyl group, a cyclohexyl group, a butyl group, a 3-(2,4-di-t-amylphenoxy)propyl group, a 4-(2,4-di-t-amylphenoxy)butyl group, a 3-dodecyloxypropyl group, a 2-tetradecyloxyphenyl group, a t-butyl group, a 2-(2-hexyldecyloxy)phenyl group, a 2-methoxy-5-dodecyloxycarbonylphenyl group, a 2-butoxyphenyl group, or a 1-naphthyl group. Examples of $R_{62}$ include an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, or an acetamido group.

Next, the substituents of $LVG_1$ through $LVG_4$ are explained hereinafter.

$LVG_1$, $LVG_2$, $LVG_3$ and $LVG_4$ each represents a group capable of being removed by coupling, or represents a hydrogen atom. Preferred examples of these substituents are given below.

$LVG_1$ preferably represents an $R_{65}O$— group, an imido group as linked with the coupling position via the nitrogen atom (for example, a 2,4-dioxo-1,3-imidazolidin-3-yl group, a 2,4-dioxo-1,3-oxazolidin-3-yl group, a 3,5-dioxo-1,2,4-triazin-4-yl group, a succinimido group, a phthalimido group, or a 2,4-dioxo-1,3-imidazolidin-1-yl group, etc.), an unsaturated nitrogen-containing heterocyclic group as linked with the coupling position via the nitrogen atom (for example, a 1-imidazolyl group, a 1-pyrazolyl group, a 1,2,4-triazol-2(or -4)-yl group, a benzotriazol-1-yl group, or a 3-pyrazolin-5-on-2-yl group, etc.), or $R_{66}S$— group.

$LVG_2$ preferably represents, for example, an $R_{66}S$— group, an unsaturated nitrogen-containing heterocyclic group as linked with the coupling position via the nitrogen atom (for example, a 1-pyrazolyl group, a 1-imidazolyl group, a 1,2,4-triazol-2(or -4)-yl goup, a benzotriazol-1-yl group, a benzimidazolyl group, or a benzindazolyl group, etc.), an $R_{65}O$— group, or a hydrogen atom.

$LVG_3$ preferably represents, for example, an $R_{66}S$— group, an unsaturated nitrogen-containing heterocyclic group as linked with the coupling position via the nitrogen atom (for example, a 1-pyrazolyl group, a 1-imidazolyl group, or a benzotriazol-1-yl group, etc.), or a hydrogen atom.

$LVG_4$ preferably represents, for example, a halogen atom, an $R_{66}O$— group, an $R_{66}S$— group, or a hydrogen atom.

In these substituents, $R_{65}$ represents an aromatic group or a heterocyclic group; $R_{66}$ represents an aliphatic group, an aromatic group or a heterocyclic group. The aromatic group, heterocyclic group and aliphatic group have the same meanings as defined in the above-mentioned $R_{41}$.

In the case that $LVG_1$, $LVG_2$ and $LVG_3$ each represents the above-mentioned heterocyclic group, the group may have substituent(s) in any substitutable positions; and the substituents may be any one as typically mentioned in the heterocyclic group of the above-mentioned $R_{41}$.

Next, typical examples of $LVG_1$, $LVG_2$, $LVG_3$, and $LVG_4$ are given hereinafter.

$LVG_1$ include a 1-benzyl-5-ethoxy-2,4-dioxo-1,3-imidazolidin-3-yl group, a 1-methyl-5-hexyloxy-2,4-dioxo-1,3-imidazolidin-3-yl group, a 1-phenyl-5-benzyl-2,4-dioxo-1,3,5-triazin-3-yl group, a 5,5-dimethyl-2,4-dioxo-1,3-oxazolidin-3-yl group, a 1-pyrazolyl group, a 4,5-bis(methoxycarbonyl)imidazol-1-yl) group, a 2-phenylcarbamoyl-1,3-imidazolyl-1-yl group, a 4-phenylcarbamoyl-1,3-imidazolyl-1-yl group, a 6-methylxanthin-1-yl group, a 4-(4-hydroxyphenylsulfonyl)phenoxy group, a 4-isopropoxyphenoxy group, a 4-cyanophenoxy group, a 2-chloro-4-(2-chloro-4-hydroxyphenylsulfonyl)phenoxy group, a 5-phenoxycarbonyl-1-benzotriazolyl group, a 4-carboxyphenoxy group, or a 4-(4-benzyloxyphenylsulfonyl)phenoxy group. $LVG_2$ include a hydrogen atom, a 1-pyrazolyl group, a 3-chloro-5-methyl-1,2,4-triazol-2-yl group, a 5-phenoxycarbonyl-1-benzotriazolyl group, a 2-butoxy-5-(1,1,3,3-tetramethylbutyl)phenylthio group, a 4-chloro-1-pyrazolyl group, a 4-[3-(2-decyl-4-methylphenoxycarbonyl)propyl]pyrazol-1-yl group, a dodecyloxycarbonylmethylthio group, a 1-phenyltetrazolyl-5-thio group, or a 4-dodecylsulfamoylphenoxy group. $LVG_3$ include a chlorine atom, a hydrogen atom, a 4-methylphenoxy group, a 4-cyanophenoxy group, a 2-butoxy-5-(1,1,3,3-tetramethylbutyl)phenylthio group, a 1-pyrazolyl group, or a 2-(2-phenoxyethoxy)-5-(1,1,3,3-tetramethylbutyl)phenylthio group. $LVG_4$ include a chlorine atom, a hydrogen atom, a 4-methoxyphenoxy group, a 4-(1,1,3,3-tetramethylbutyl)phenoxy group, a 2-carboxyethylthio group, a 2-(2-carboxyethylthio)ethoxy group, a 1-phenyltetrazolyl-5-thio group, a 1-ethyltetrazolyl-5-thio group, a 3-carboxypropoxy group, a 5-phenoxycarbonylbenzotriazol-1-methoxy group, a 2,3-dihydroxy-4-(1-phenyltetrazolyl-5-thio)-5-propylcarbamoylphenoxy group, a 2-(1-carboxytridecylthio)ethoxy group, a 2-(2-methoxyethylcarbamoyl)ethoxy group, or a 2-[4-(8-acetamido-1-hydroxy-3,6-disulfonaphthyl-2-azo)phenoxy]ethoxy disodium salt group.

The compounds of formula (I) of the present invention and the couplers to be used in the present invention include polymers. Specifically, the polymers are those which are derived from the monomers of the following formula (IV) and which have the repeating units of the following formula (V), or copolymers with one or more non-coloring monomers which do not have an ability of coupling with an oxidized form of an aromatic primary amine developing agent but which contain at least one ethylene group. In the formation of the polymers, two or more kinds of the monomers of formula (IV) can be copolymerized.

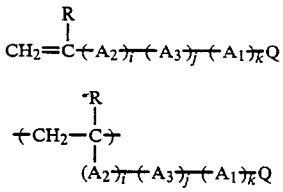

In formulae (IV) and (V), R represents a hydrogen atom, a lower alkyl group having from 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —N— or —O—; $A_2$ represents —CONH— or —COO—; $A_3$ represents an unsubstituted or substituted alkylene group having from 1 to 10 carbon atoms, an aralkylene group, or an unsubstituted or substituted arylene group, where the alkylene group may be linear or branched. (Examples of the alkylene groups include methylene, methylmethylene, dimethylmethylene, dimethylene, trimethylene, tetramethylene, pentamethylene, hexamethylene, and decylmethylene groups; examples of the aralkylene group include a benzylidene group; and examples of the arylene group include phenylene and naphthylene groups.) Q represents a residual group of the compound of formula (I) or a coupler residual group, and this may be linked to the molecule in any position of the substituents which have previously been explained in the above description. i, j, and k each represents 0 or 1; with the proviso that all of these i, j, and k must not be 0 at the same time.

Examples of the substituents to be introduced into the alkylene group, the aralkylene group, or the arylene group as represented by $A_3$ include an aryl group (such as a phenyl group), a nitro group, a hydroxyl group, a cyano group, a sulfo group, an alkoxy group (such as a methoxy group), an aryloxy group (such as a phenoxy group), an acyloxy group (such as an acetoxy group), an acylamino group (such as an acetylamino group), a sulfonamido group (such as a methanesulfonamido group), a sulfamoyl group (such as a methylsulfamoyl group), a halogen atom (such as a fluorine atom, a chlorine atom, a bromine atom), a carboxyl group, a carbamoyl group (such as a methylcarbamoyl group), an alkoxycarbonyl group (such as a methoxycarbonyl group, etc.), a sulfonyl group (such as a methylsulfonyl group), etc. In the case that the group has two or more of these substituents, these may be the same or different.

Examples of the non-coloring ethylenic monomers which are not coupled with an oxidation product of an aromatic primary amine developing agent include acrylic acid, α-chloroacrylic acid, α-alkylacrylic acids and esters or amides as derived from the acrylic acids, as well as methylenebisacrylamide, vinyl esters, acrylonitrile, aromatic vinyl compounds, maleic acid derivatives, vinylpyridines, etc. In the formation of the copolymers of the present invention, two or more kinds of the above-mentioned non-coloring ethylenic unsaturated monomers can be used.

Typical examples of the compounds of formula (I) are given below, which, however, are not whatsoever limitative.

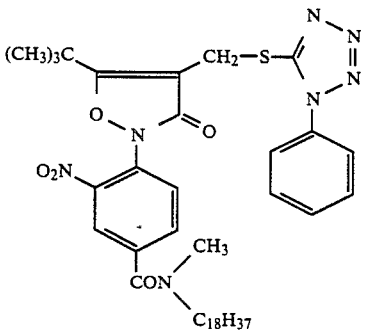

(1)

-continued
(2)
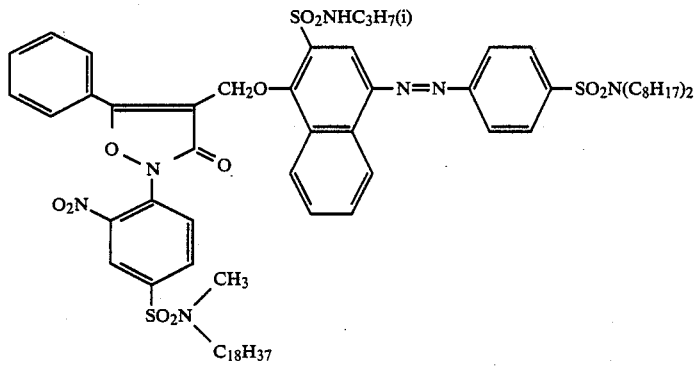
(3)
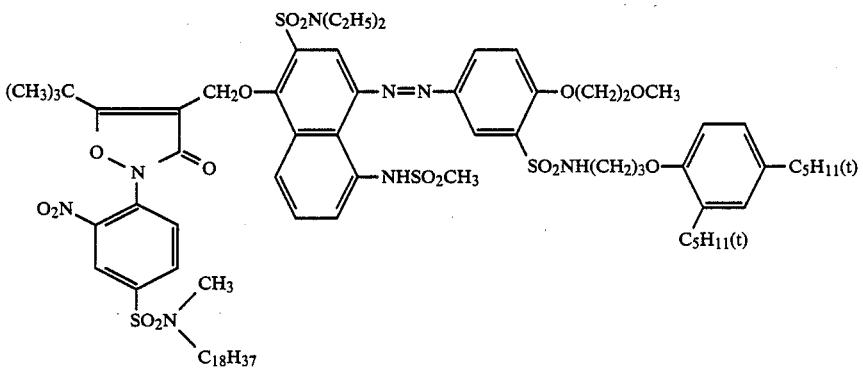
(4)
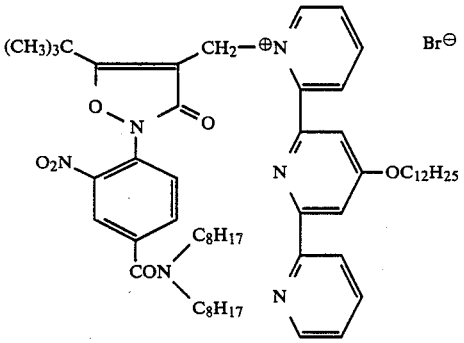
(5)
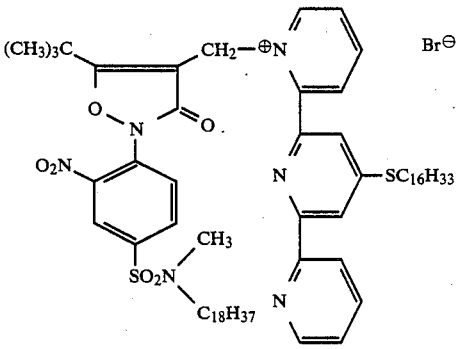

-continued
(6)
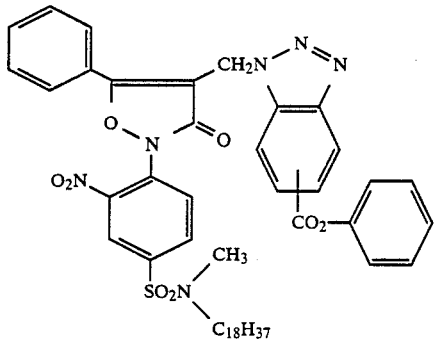
(7)
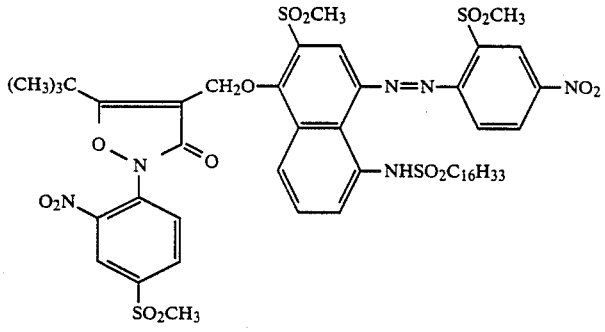
(8)
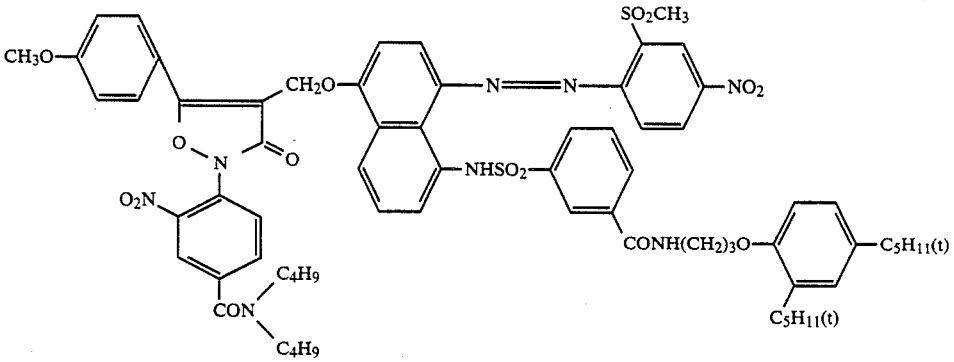
(9)
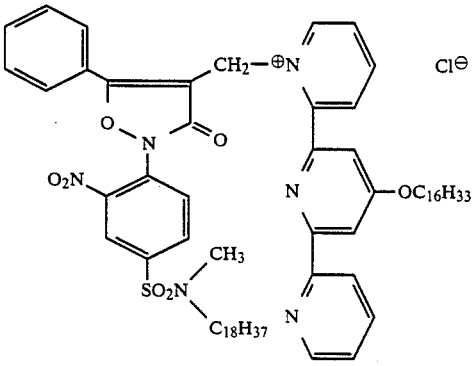

-continued
(10)
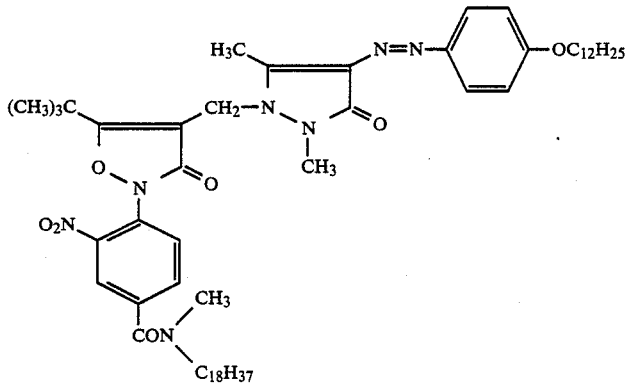
(11)
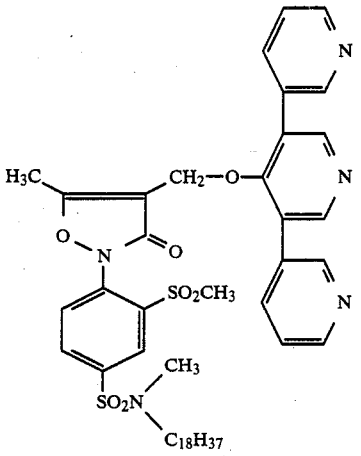
(12)
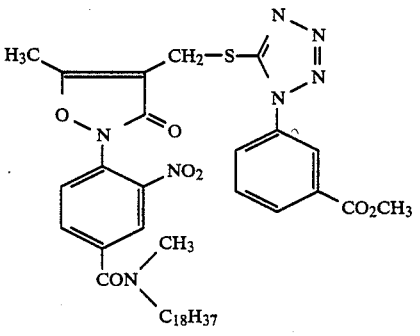
(13)
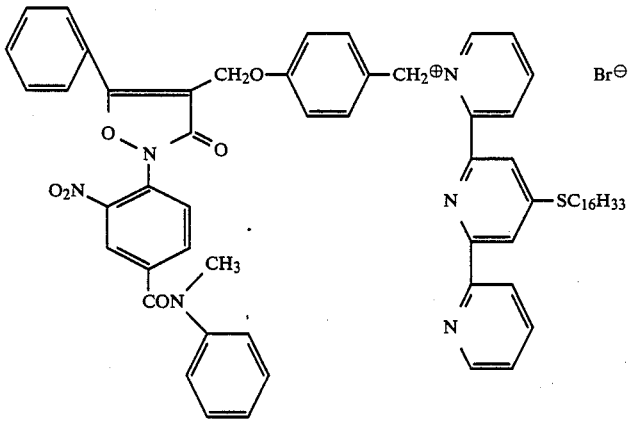

-continued
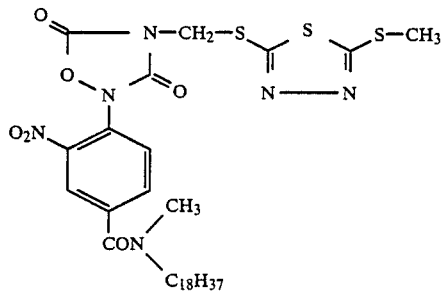
(14)
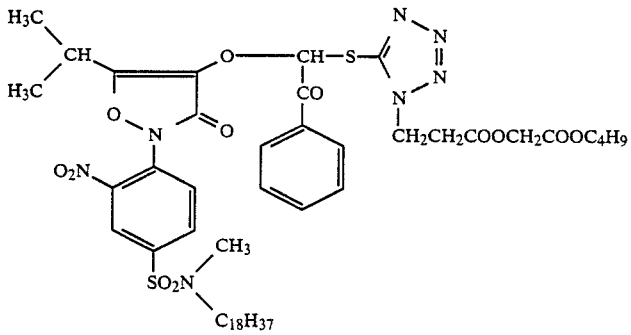
(15)
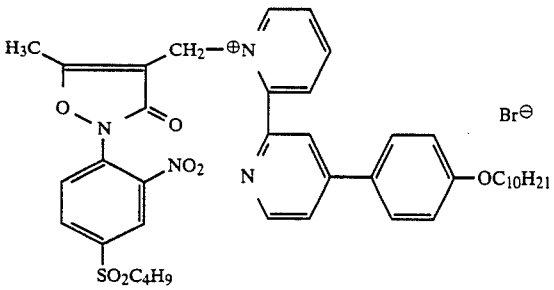
(16)
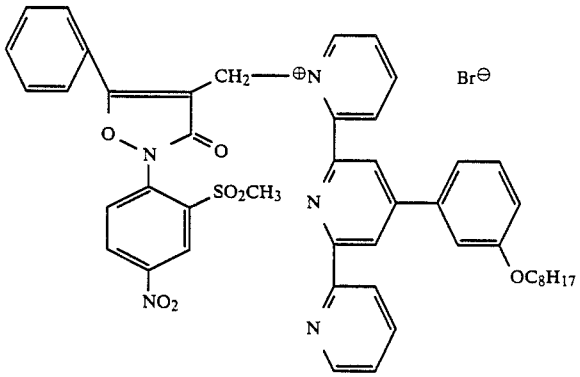
(17)

-continued
(18)
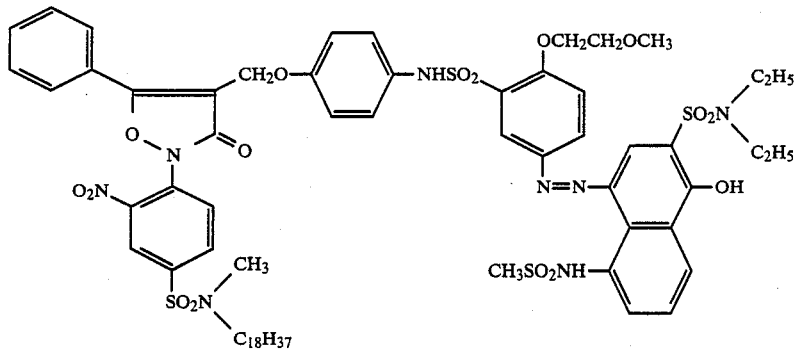
(19)
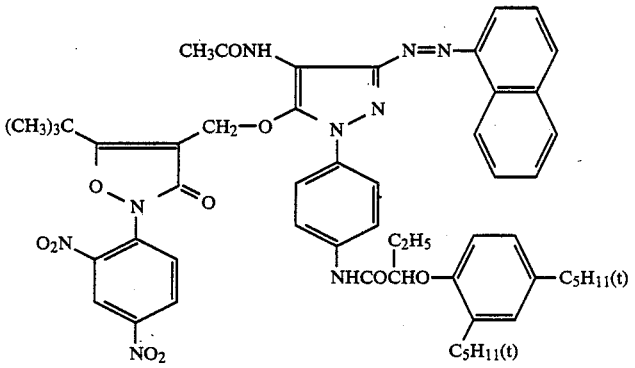
(20)
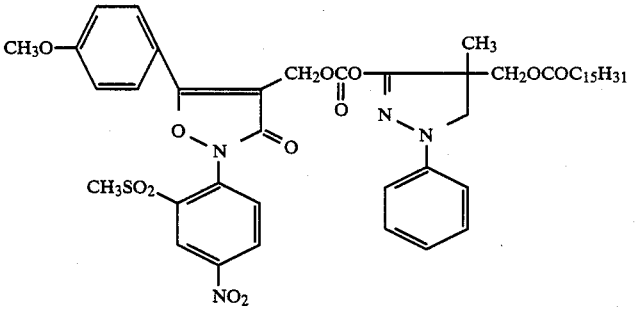
(21)
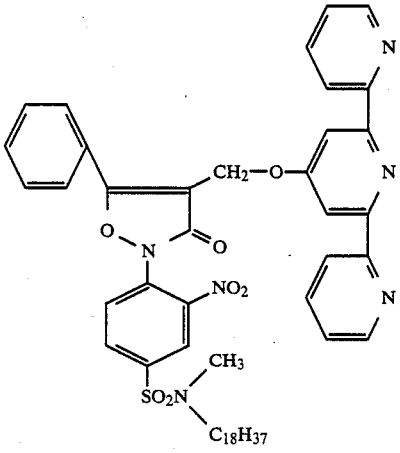

-continued
(22)
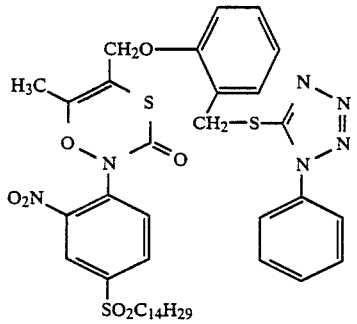
(23)
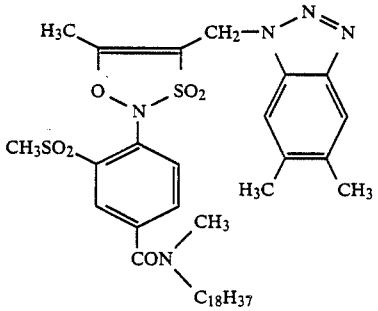
(24)
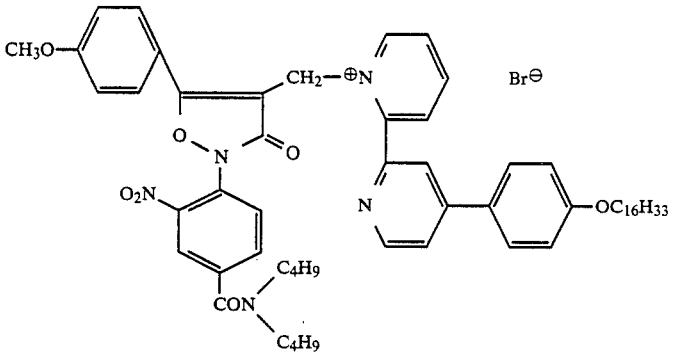
(25)
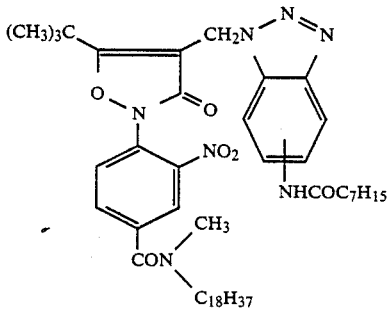
(26)
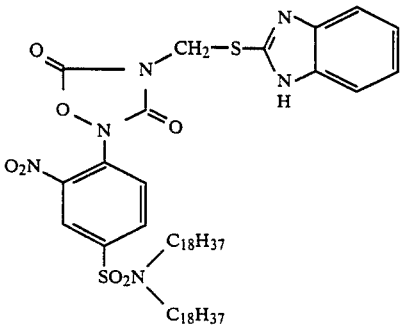

-continued
(27)
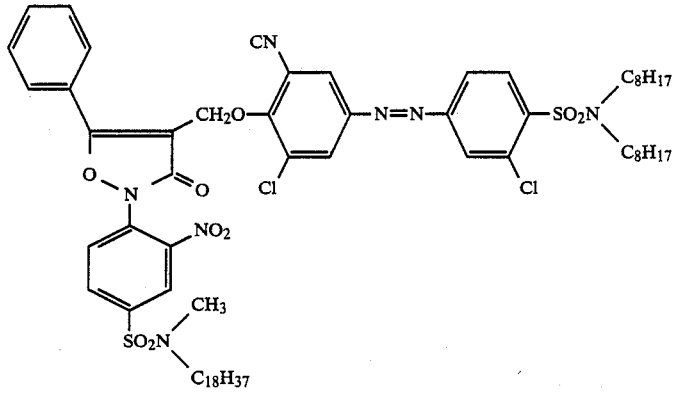
(28)
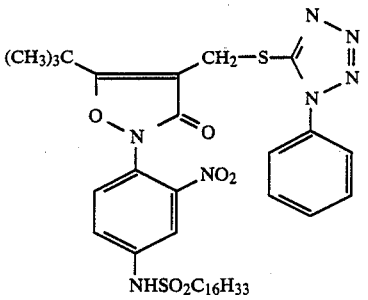
(29)
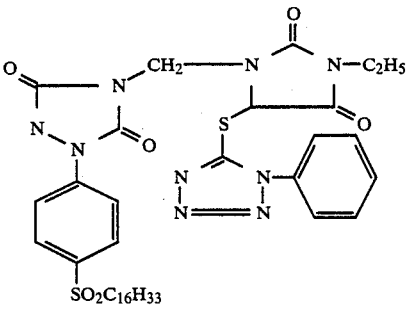
(30)
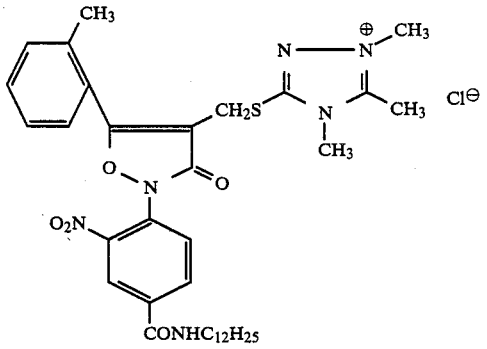
(31)
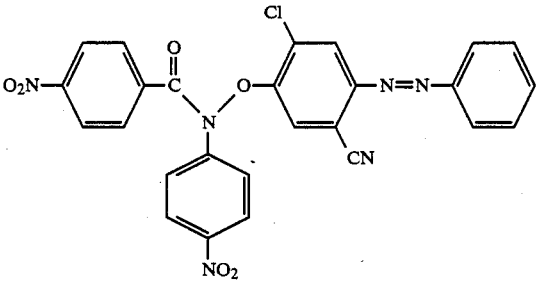

-continued
(32)
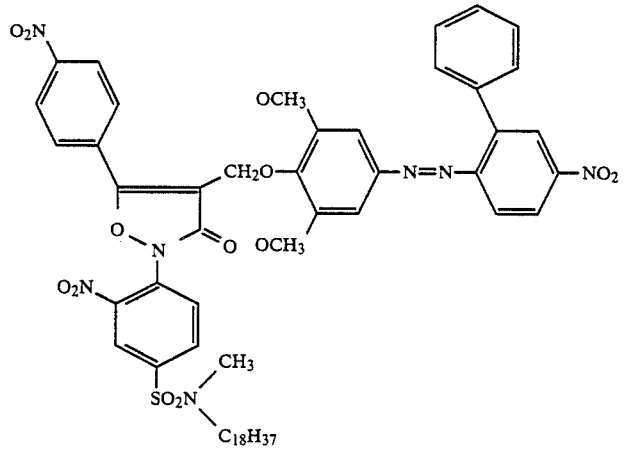
(33)
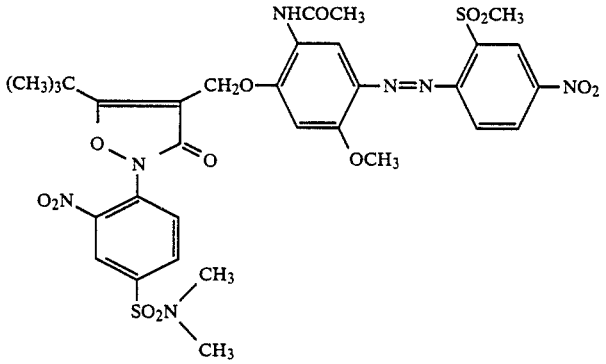
(34)
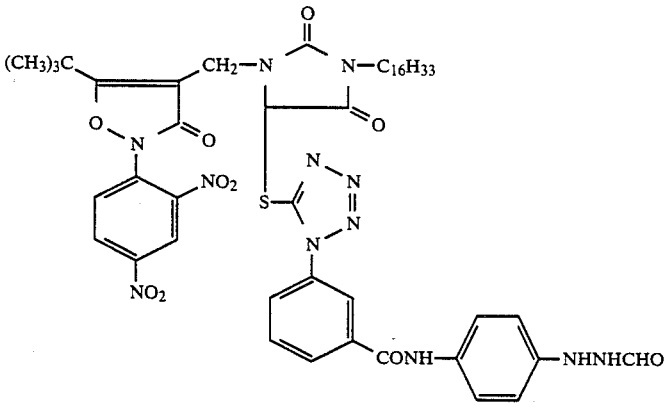
(35)
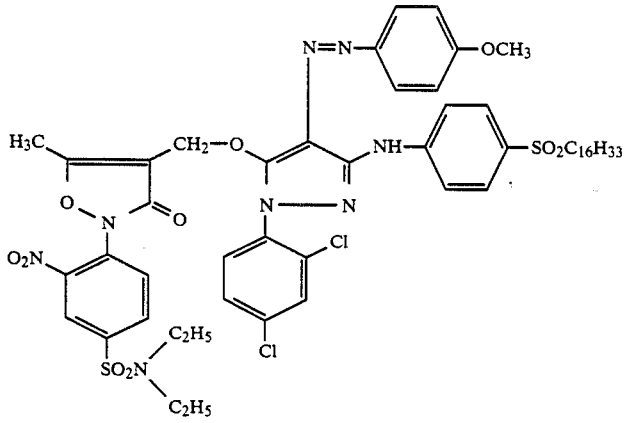

-continued
(36)
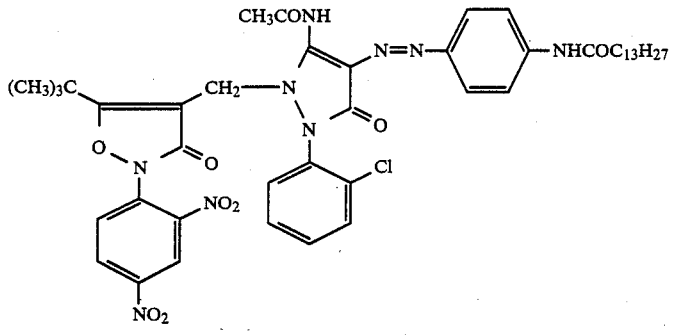
(37)
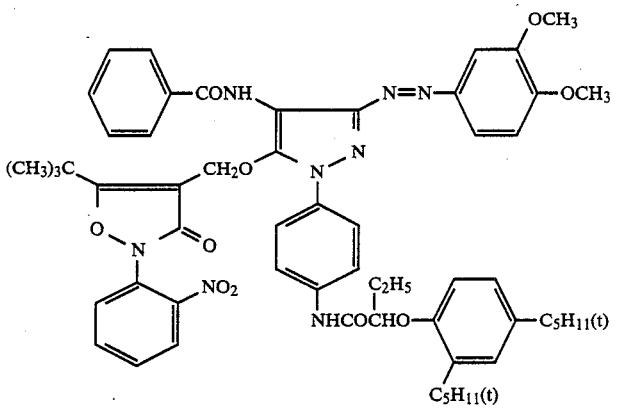
(38)
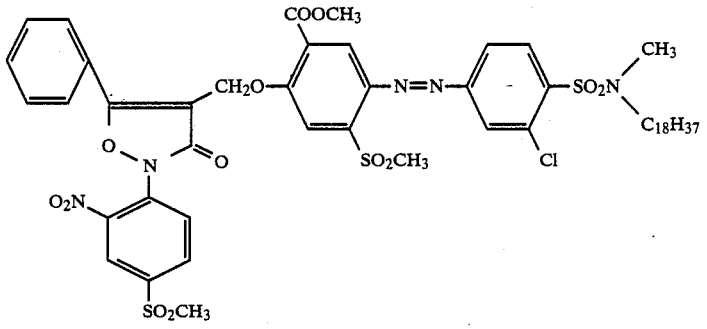
Typical examples of the couplers to be used in the present invention are given below, which, however, are not whatsoever limitative.
(C-1)
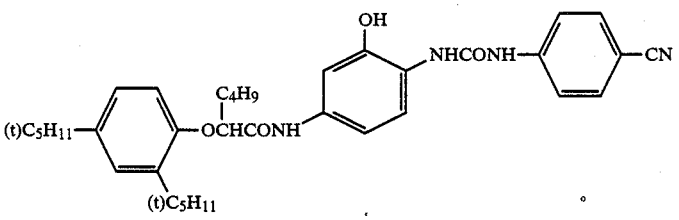
(C-2)
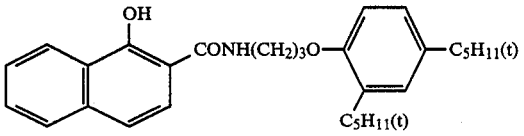

-continued
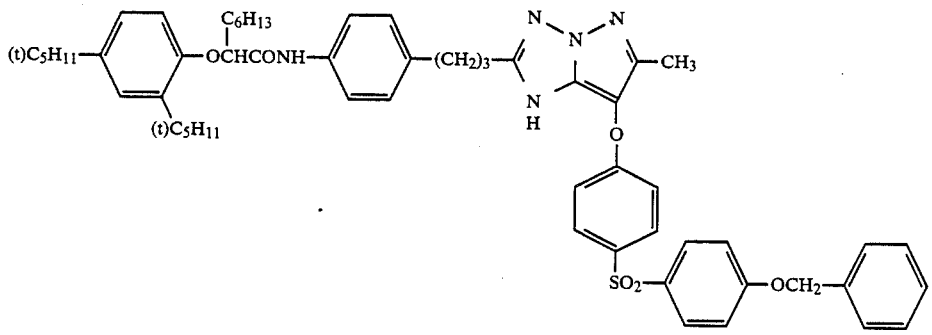
(C-3)
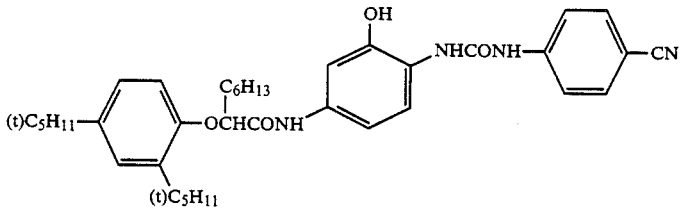
(C-4)
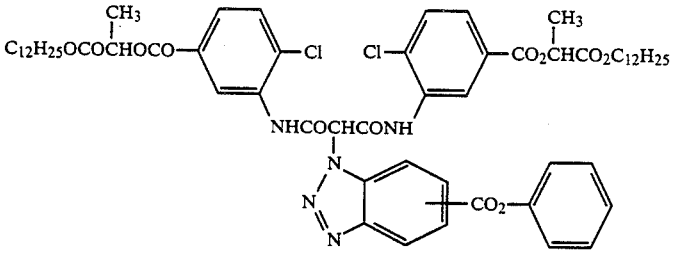
(C-5)
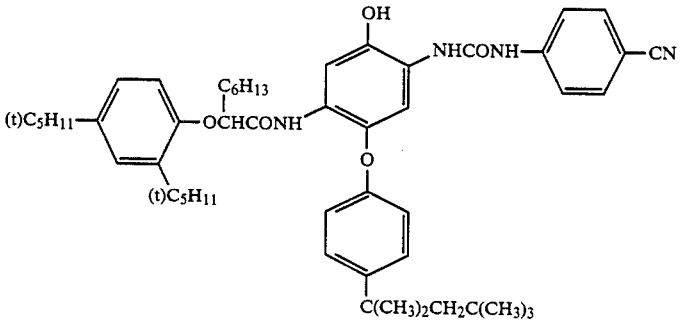
(C-6)
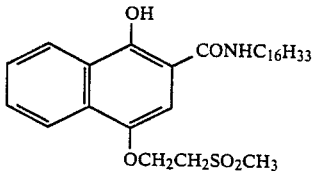
(C-7)

-continued
(C-8)
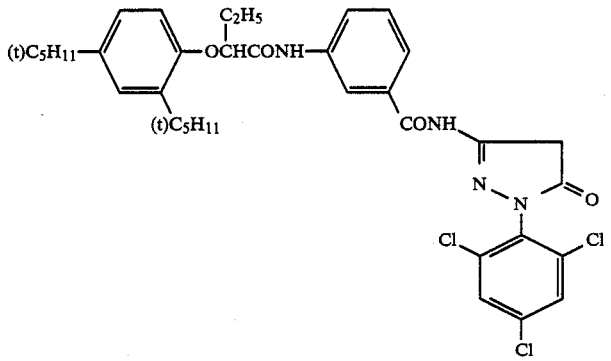
(C-9)
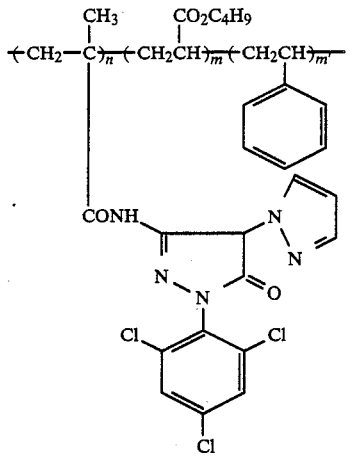
n/m/m' = 50/25/25 (% by weight)
Average molecular weight: about 20,000
(C-10)
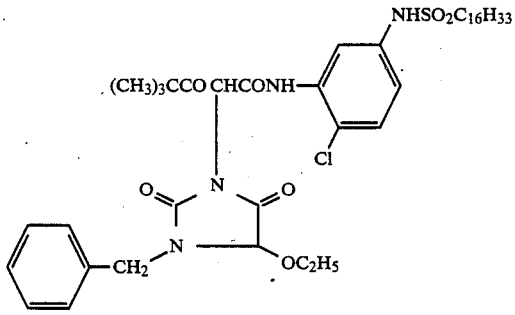
(C-11)
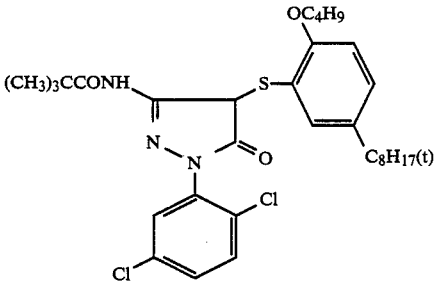

-continued
(C-12)
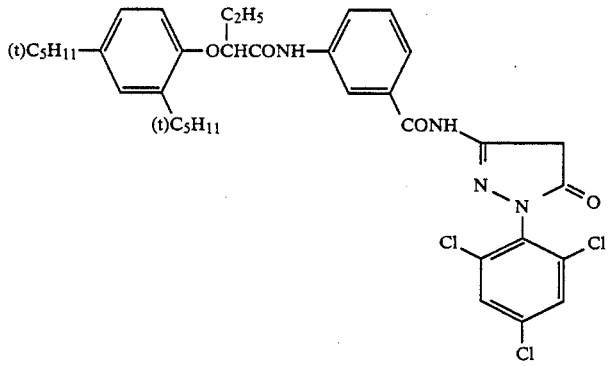
(C-13)
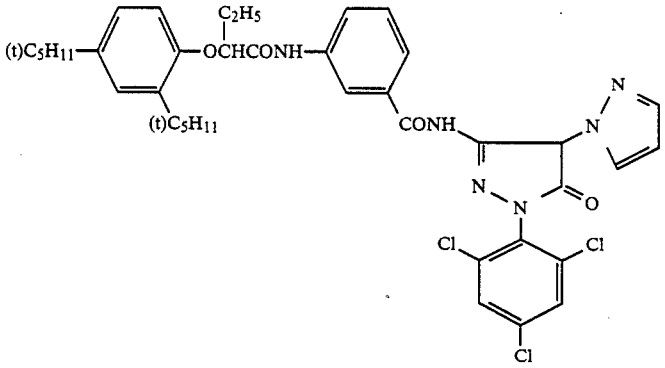
(C-14)
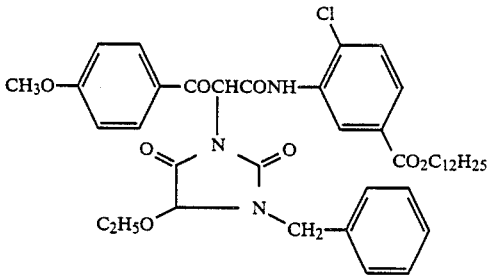
(C-15)
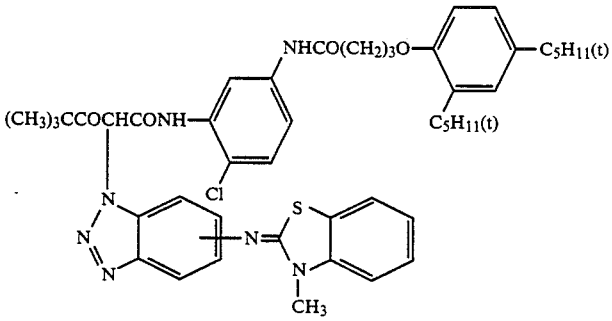
(C-16)
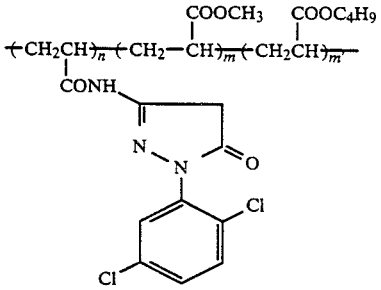

-continued
n/(m + m') = 1, m/m' = 1 (ratio by weight)
Molecular weight: about 40,000
(C-17)
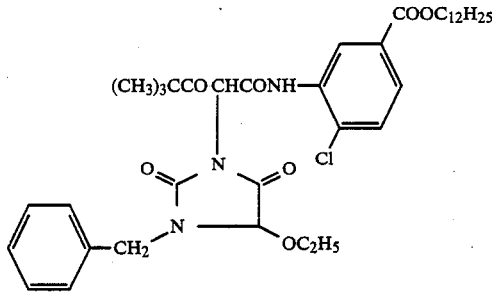
(C-18)
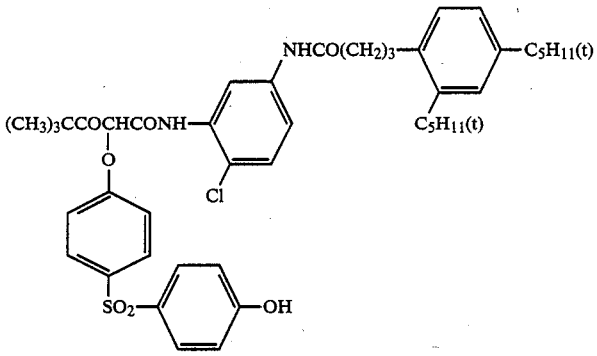
(C-19)
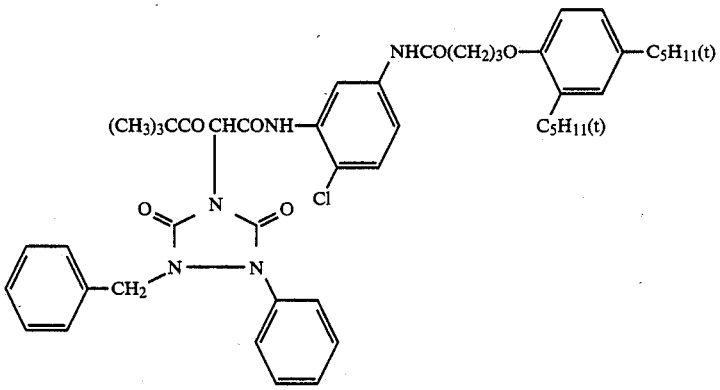
(C-20)
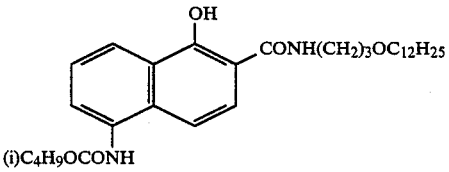
(C-21)
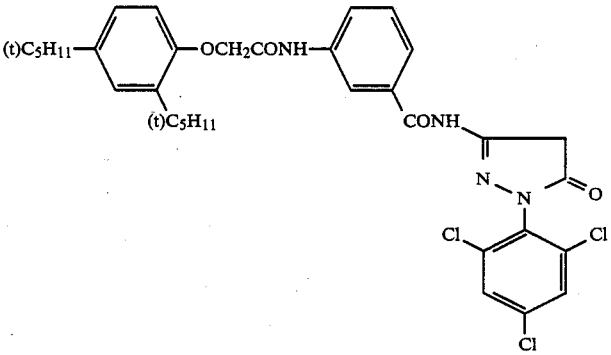

-continued
(C-22)
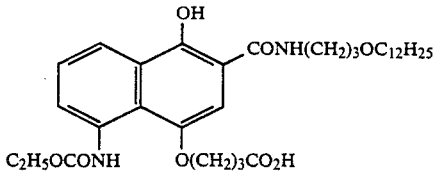
(C-23)
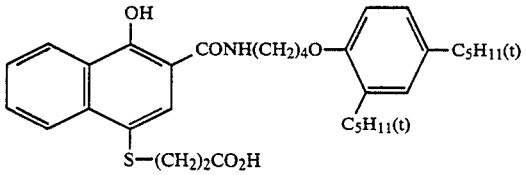
(C-24)
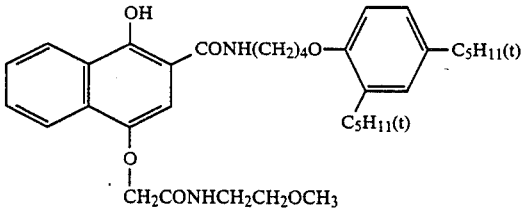
(C-25)
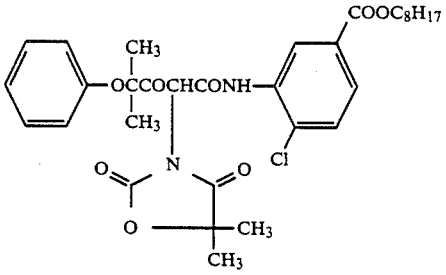
(C-26)
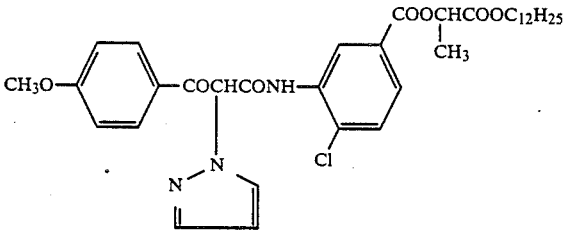
(C-27)
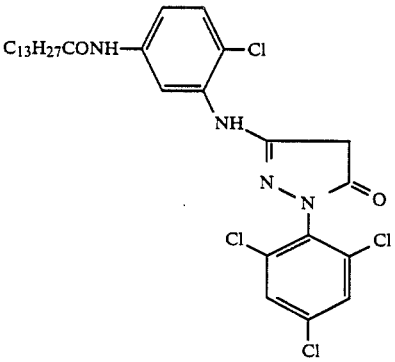

-continued
(C-28)
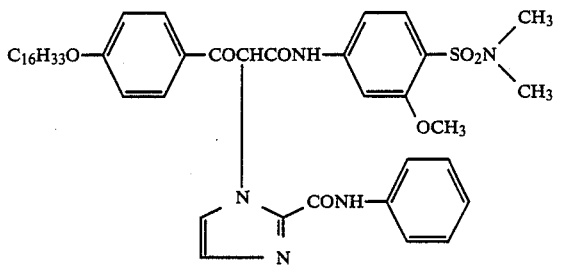
(C-29)
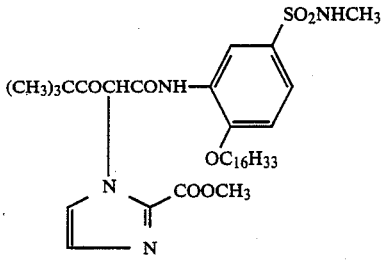
(C-30)
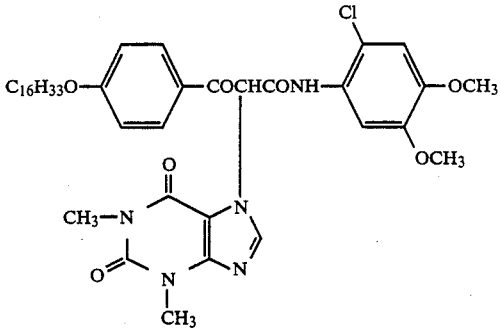
(C-31)
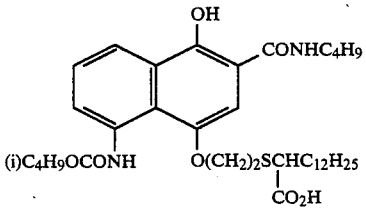
(C-32)
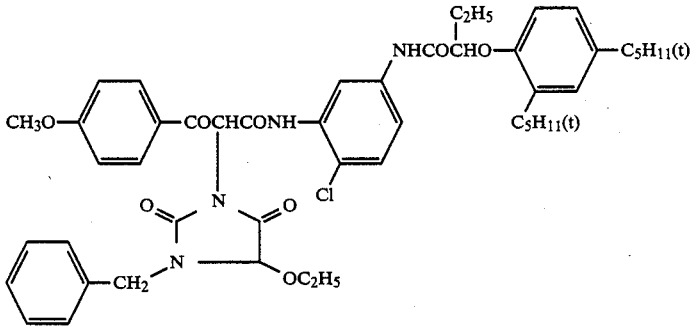
(C-33)
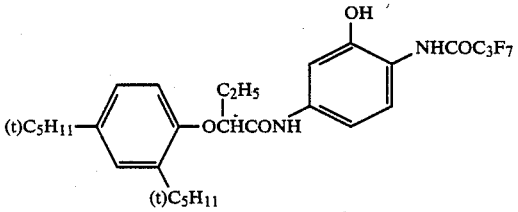

-continued
(C-34)
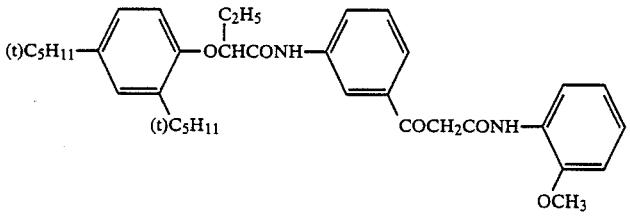
(C-35)
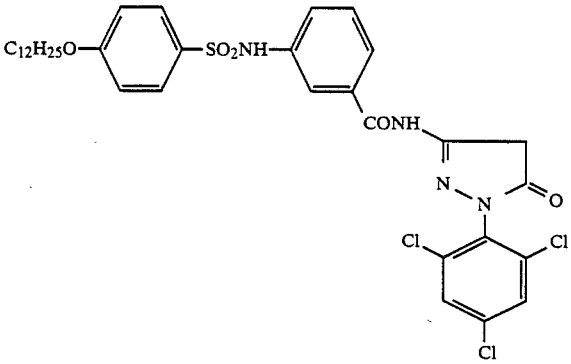
(C-36)
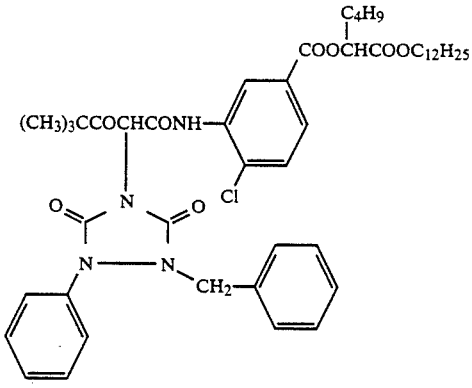
(C-37)
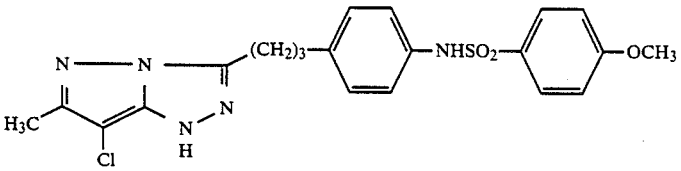
(C-38)
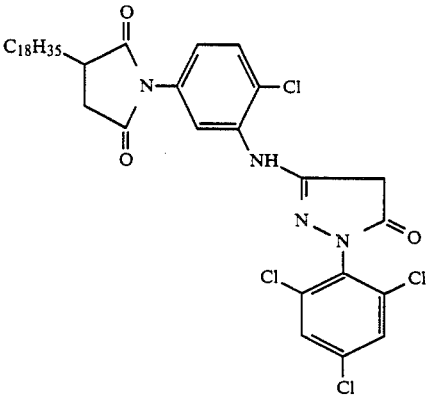

-continued
(C-39)
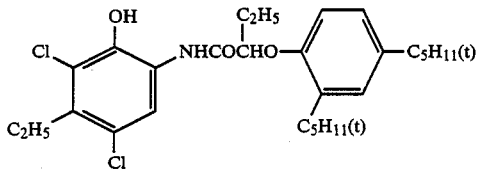
(C-40)
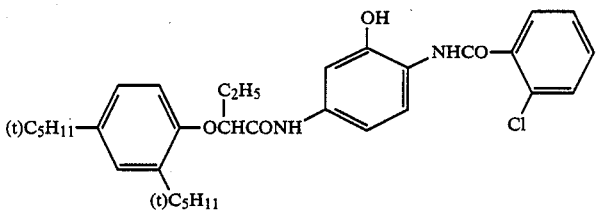
(C-41)
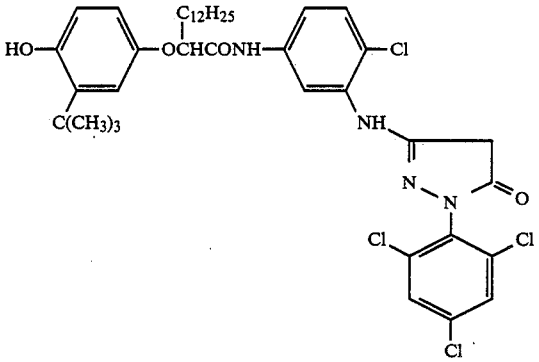
(C-42)
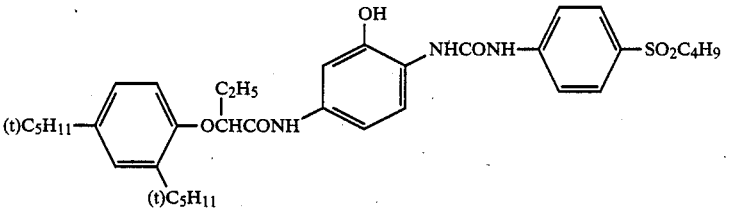
(C-43)
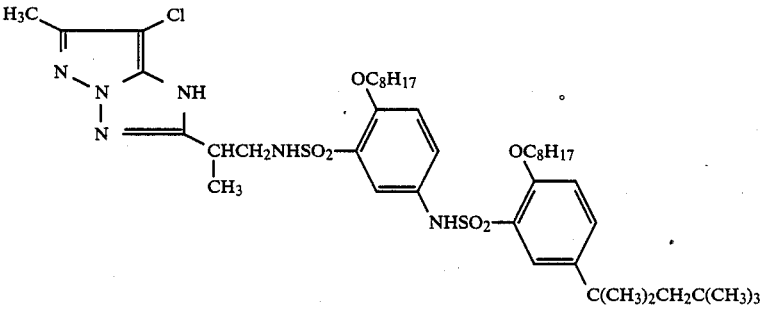

-continued
(C-44)
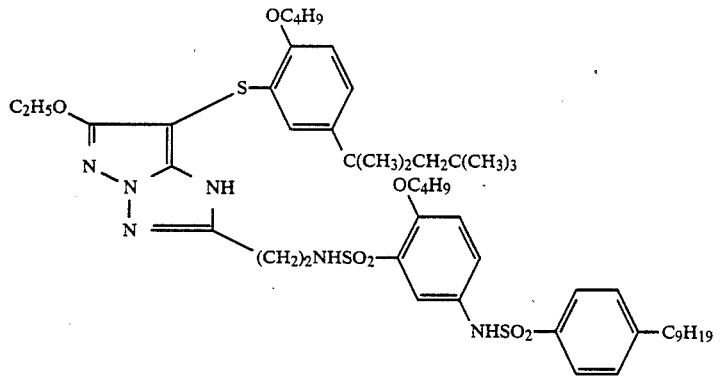
(C-45)
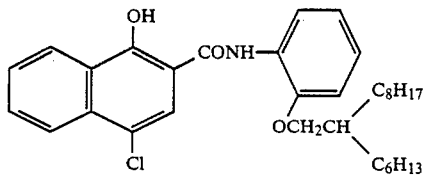
(C-46)
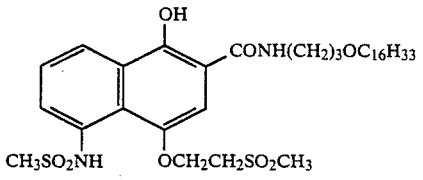
(C-47)
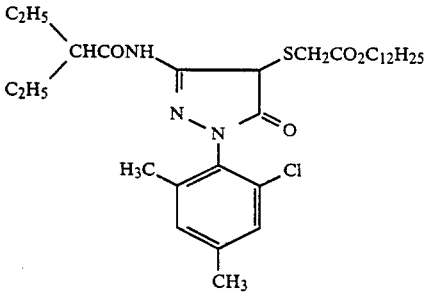
(C-48)
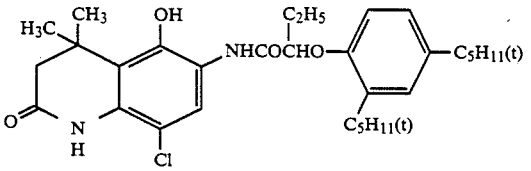
(C-49)
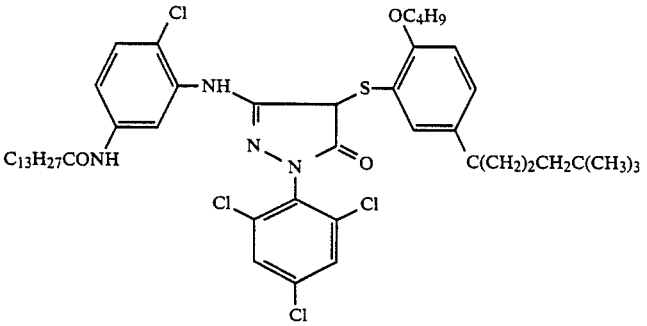

-continued
(C-50)
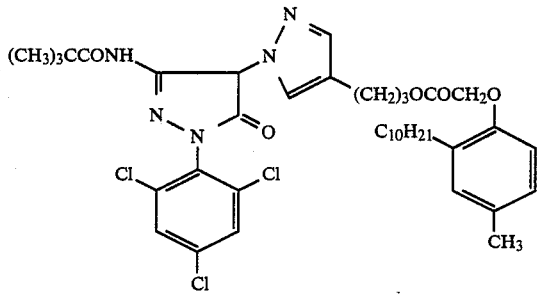
(C-51)
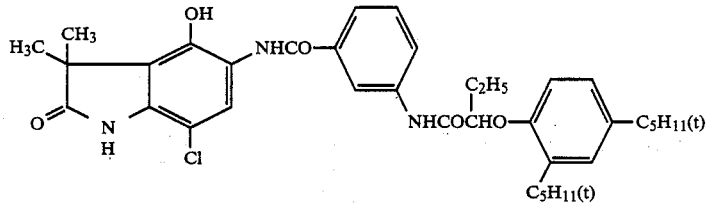
(C-52)
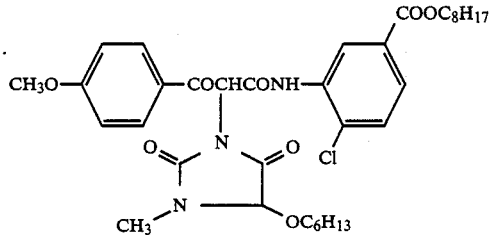
(C-53)
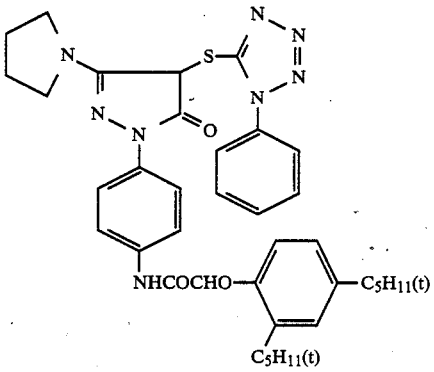
(C-54)
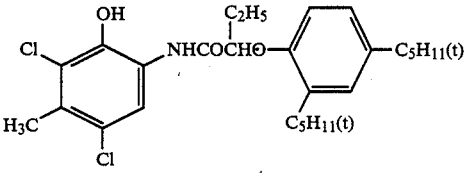
(C-55)
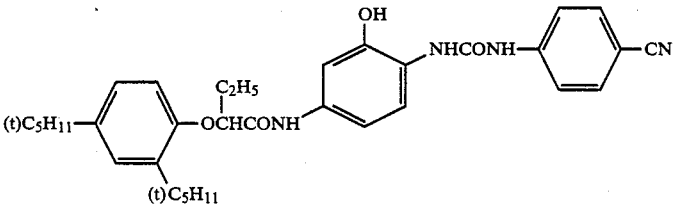

-continued
(C-56)
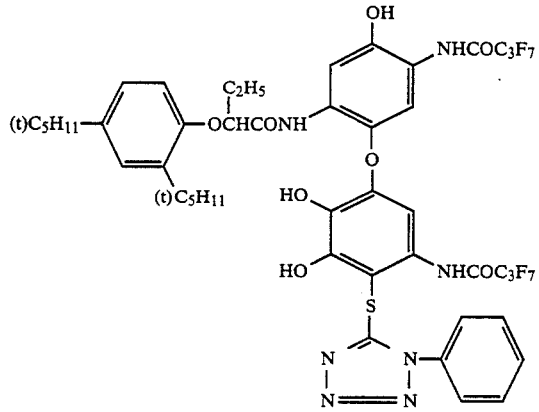
(C-57)
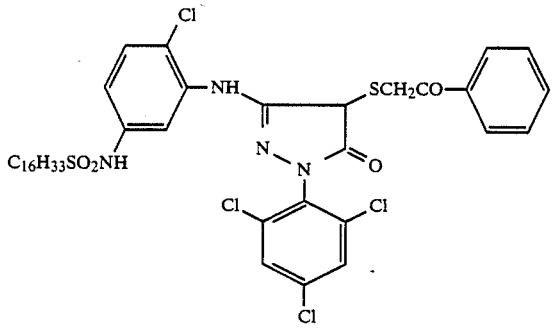
(C-58)
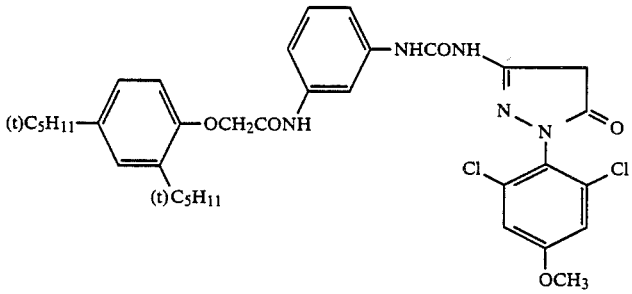
(C-59)
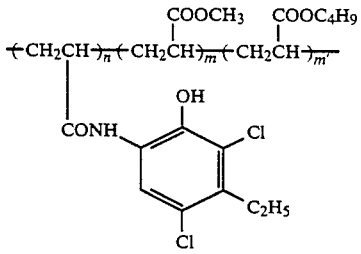
n/m/m' = 40/30/30 (% by weight)
Average molecular weight: about 40,000
(C-60)
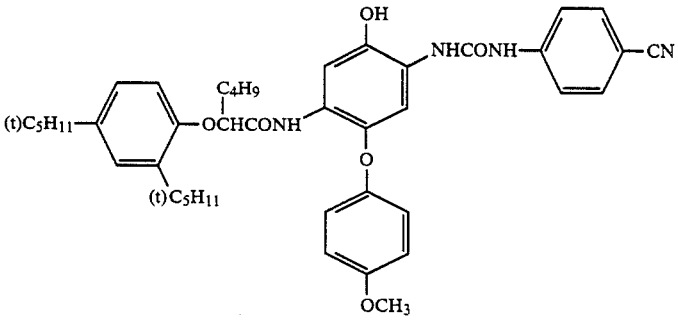

-continued
(C-61)
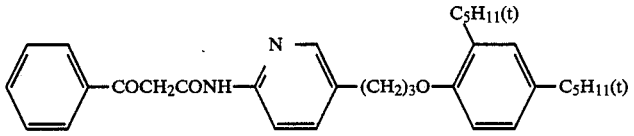
(C-62)
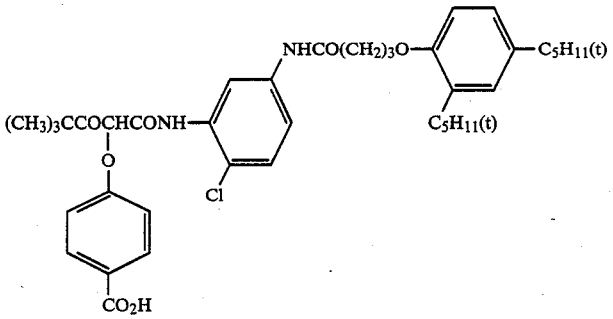
(C-63)
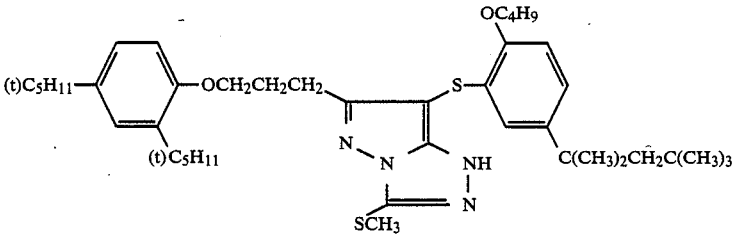
(C-64)
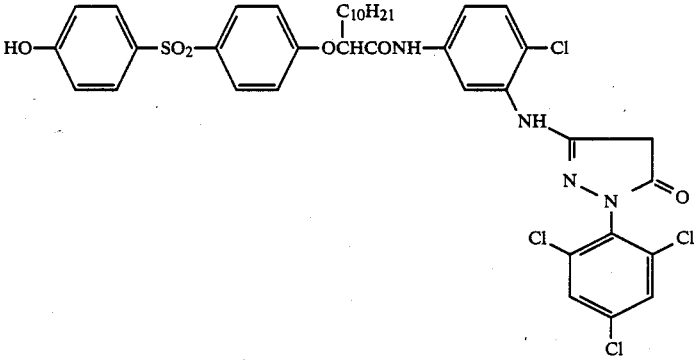
(C-65)
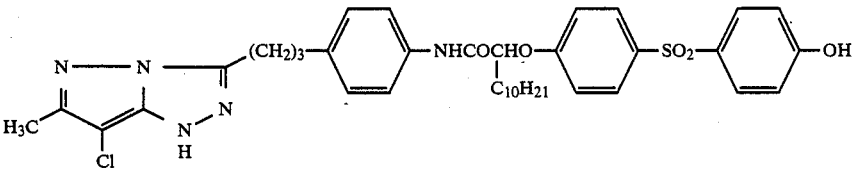
(C-66)
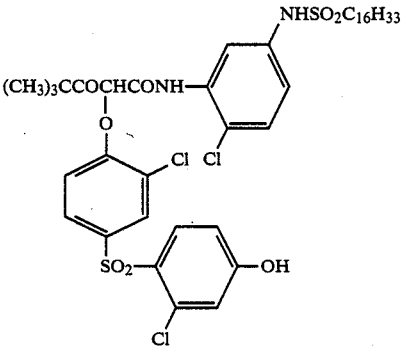

-continued
(C-67)
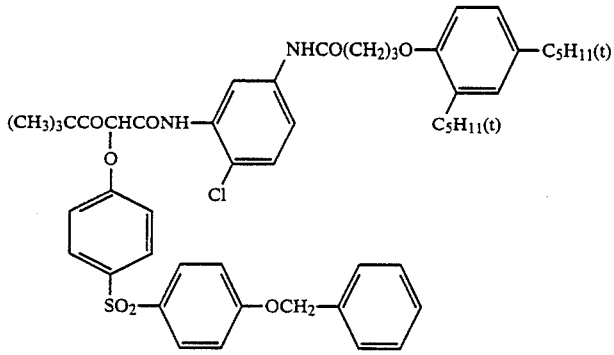
(C-68)
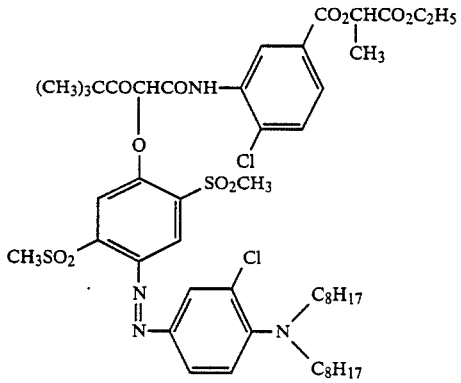
(C-69)
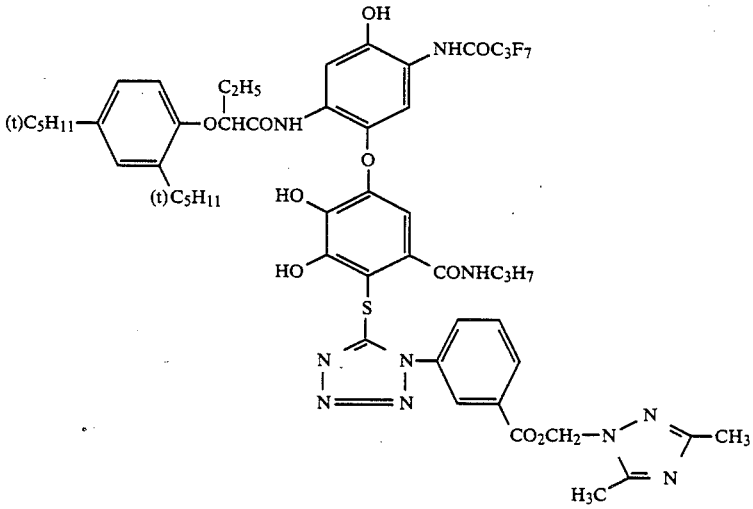
(C-70)
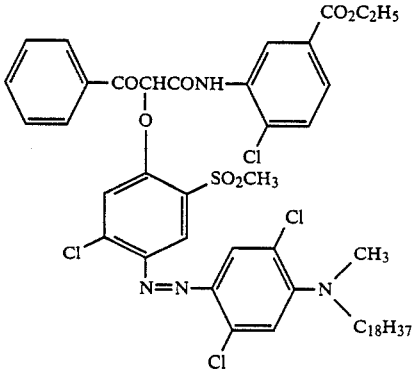

-continued
(C-71)
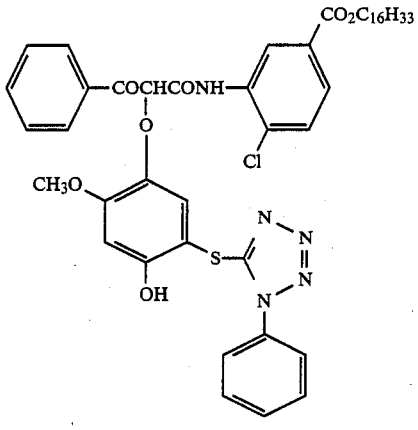
(C-72)
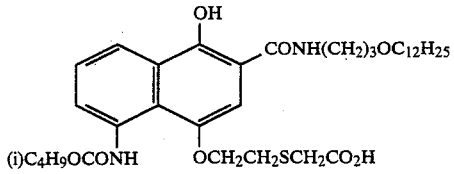
(C-73)
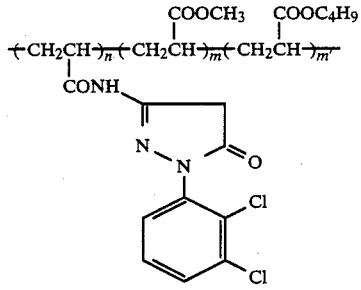
n/(m+m') = 1, m/m' = 1 (ratio by weight)
Molecular weight: about 40,000
(C-74)
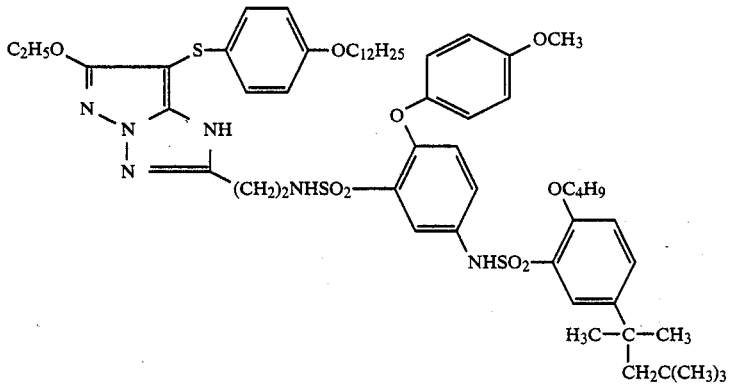
(C-75)
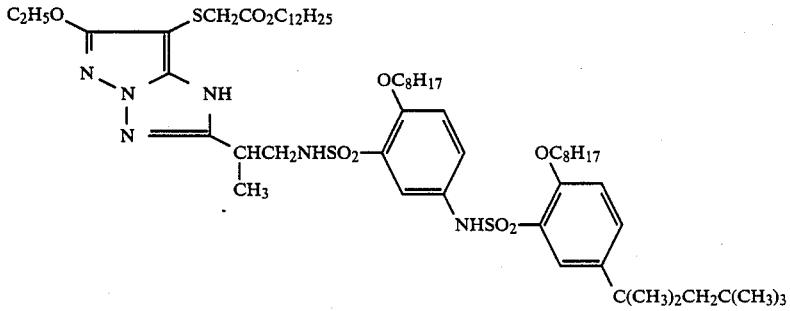

-continued
(C-76)
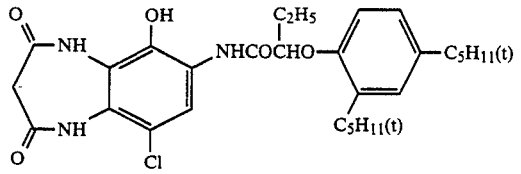
(C-77)
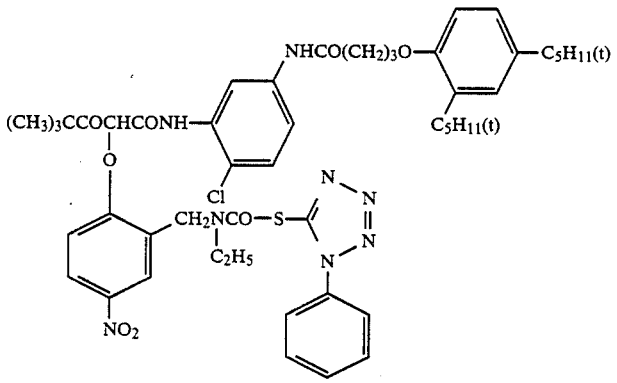
(C-78)
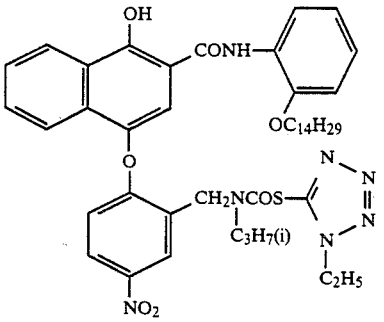
(C-79)
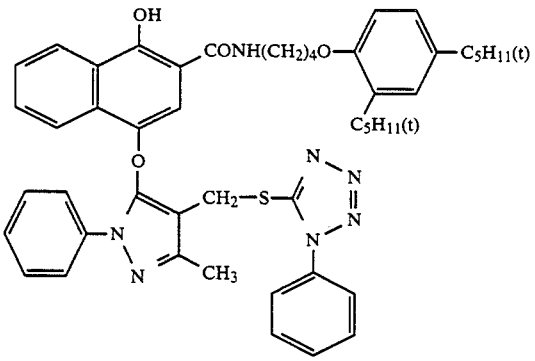
(C-80)
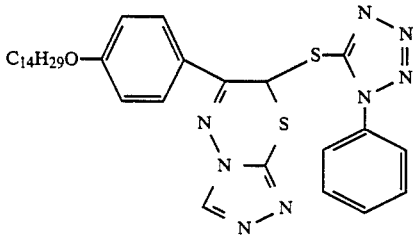

-continued
(C-81)
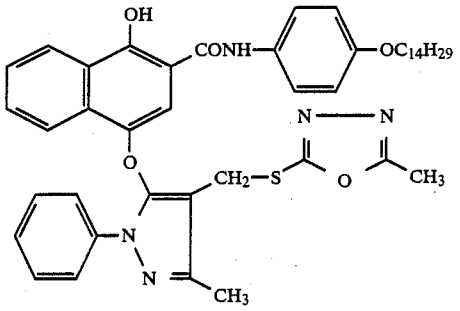
(C-82)
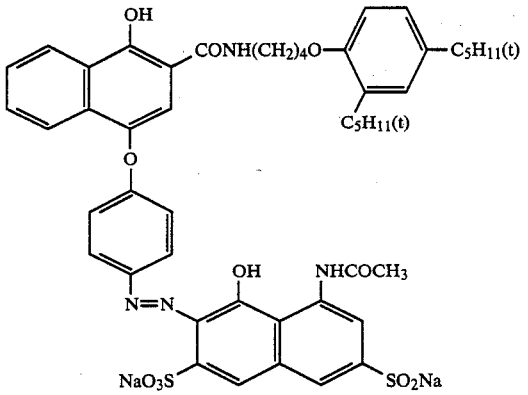
(C-83)
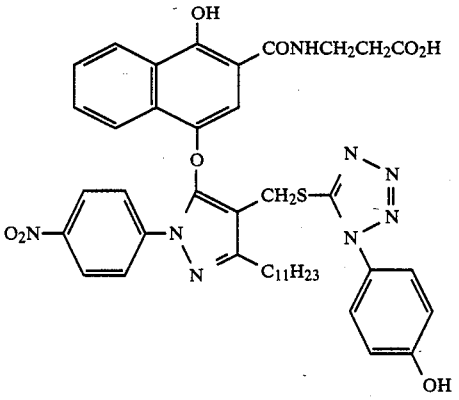
(C-84)
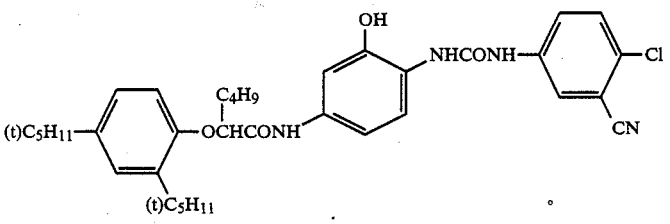
(C-85)
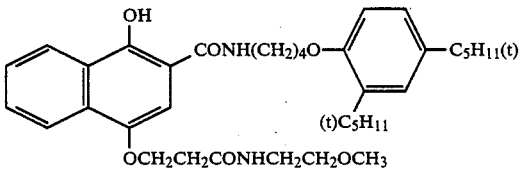

-continued
(C-86)
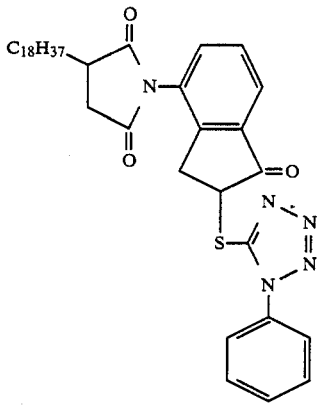
(C-87)
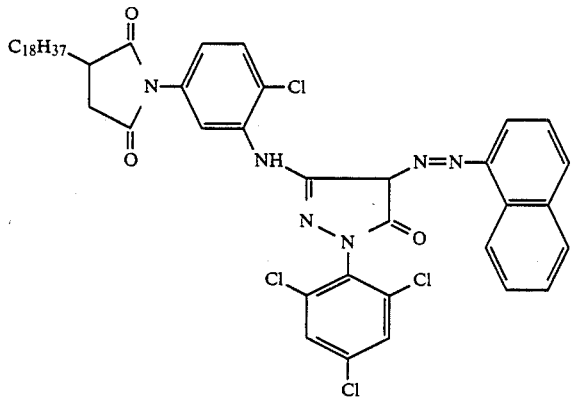
(C-88)
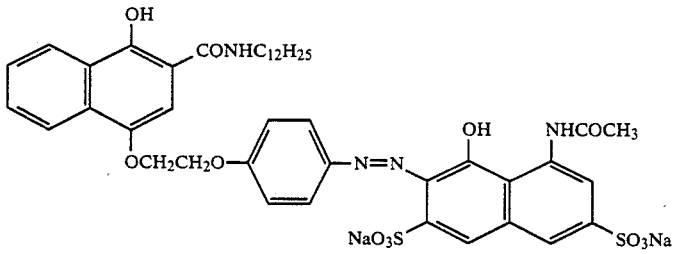
(C-89)
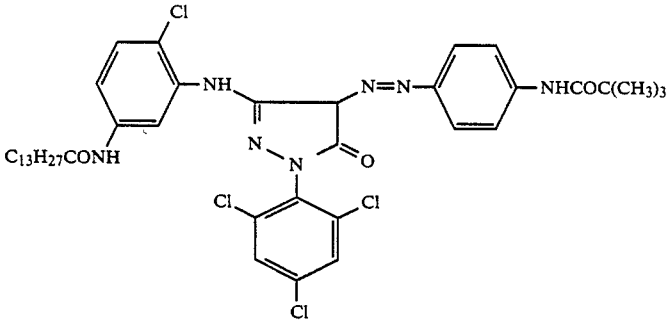

-continued (C-90)

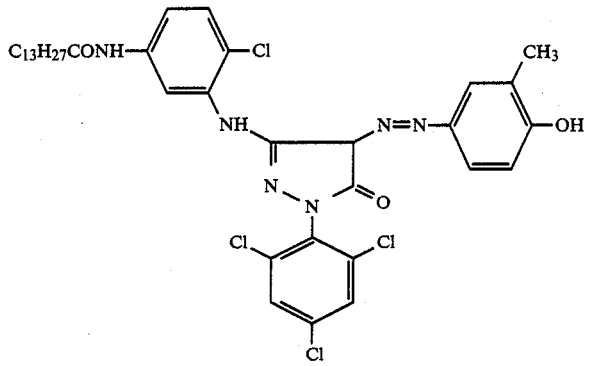

(C-91)

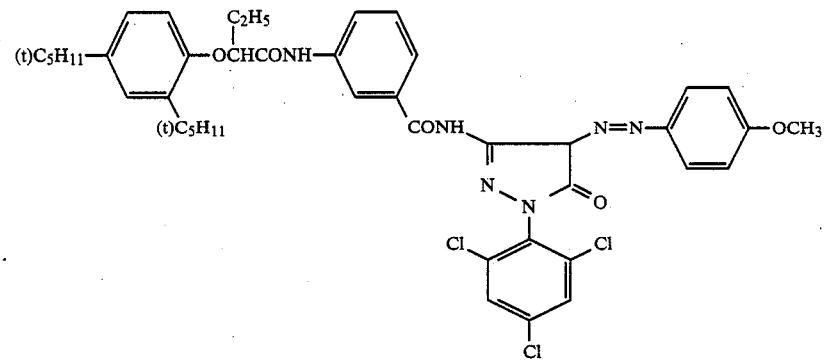

(C-92)

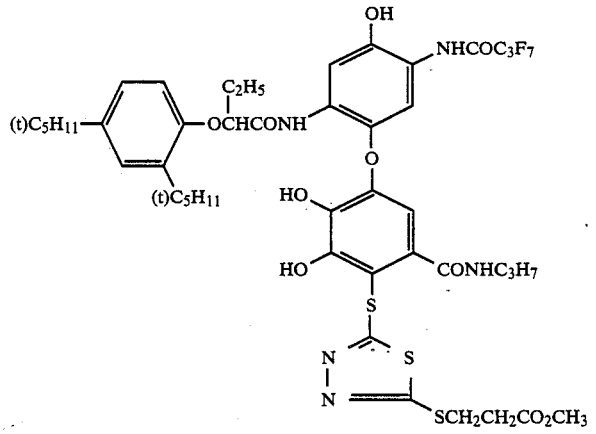

Next, methods for the synthesis of the compounds of formula (I) are given below.

In the synthesis of the compounds of the present invention, the most significant point resides in the means for linking the nitrogen-oxygen group and the electron-accepting group in the molecule. The linking means are typically classified into two methods (1) and (2), where (1) a nitro group is introduced into the electron-accepting part, which is thereafter reduced in a zinc-ammonium chloride system to form a hydroxylamine, and this is linked with a $(Time)_l$PUG group; and (2) an easily substitutable group such as a halogen atom is introduced into the electron-accepting part and this is subjected to nucleophilic substitution with a hydroxylamine or an analog thereof.

Regarding method (1), the compounds of the present invention can be synthesized in accordaince with the method as described in S. R. Sandler & W. Karo, *Organic Functional Group Preparations.* Regarding method (2), the reaction is carried out under a neutral or basic conditions in ethanol, dimethylformamide or dimethyl sulfoxide. In order to explain the content of the present invention in more detail, some typical examples for the synthesis of the compounds of formula (I) are concretely given below.

Unless otherwise indicated herein, all parts, percents, and the like are by weight.

SYNTHESIS EXAMPLE 1

Synthesis of Compound (1)

1-1 Synthesis of 3-t-Butyl-5-pyrazolidone 1.0 kg of ethyl pivaloylacetate was dissolved in 1.0 liter of ethanol, and 320 g of hydrazine hydrate was dropwise added thereto while cooled with water. After completion of the addition, the reaction was carried out overnight at room temperature, and then 5.0 liter of water was added thereto and stirred. The crystal as precipitated was filtered out under reduced pressure and fully washed with water, and then this was further washed with a little amount of methanol and dried with air. Yield: 812 g.

1-2 Synthesis of 4,4-Dibromo-3-t-butyl-5-pyrazolidone 658 g of 3-t-butyl-5-pyrazolidone was dissolved in 2.0 liter of acetic acid. To this solution was dropwise added 1.5 kg of bromine, while being stirred under cooling with water. After completion of the addition, the reaction was carried out overnight, and then 5.0 liter of water was added thereto. The crystal as precipitated was filtered out under reduced pressure and fully washed with water, and then this was further washed with a little amount of methanol and dried with air. Yield: 1.36 kg.

1-3 Synthesis of 4,4-Dimethyl-2-penthiolic Acid 552 g of sodium hydroxide was dissolved in 3.0 liter of water and ice was added thereto, whereby the temperature was lowered to 5° C. or below. Next, 1.19 kg of dibromo-3-t-butyl-5-pyrazolidone was added thereto little by little, while being stirred and kept at 5° C. or below. After completion of the reaction, the reaction solution was made acidic with 6N hydrochloric acid, and then this was extracted twice with ethyl acetate.

The extract obtained was dried with anhydrous sodium sulfate, and then the ethyl acetate was distilled out under reduced pressure. The oily residue was 4,4-dimethyl-2-penthiolic acid. This oil was used in the next reaction without being purified.

1-4 Synthesis of 4,4-Dimethyl-2-penthiolic Acid Chloride 466 g of 4,4-dimethyl-2-penthiolic acid was blended with 3.5 liter of methylene chloride and stirred. To this was added 483 g of thionyl chloride and reacted for 1 hour, and then the reaction mixture was heated under reflux, whereupon hydrogen chloride gas was abundantly produced. After heating under reflux for 2 hours, the solvent was distilled out, and the reaction mixture was further distilled under reduced pressure. The product was a colorless liquid having a boiling point of about 70° C. (20 mm Hg). Yield: 290 g.

1-5 Synthesis of 5-t-Butyl-3-hydroxyisoxazole 308 g of hydroxylamine hydrochloride was dissolved in 2.5 liter of water, and 176 g of sodium bicarbonate was added thereto. Ice was added to the solution and the temperature thereof was kept at 5° C. or below, and 290 g of 4,4-dimethyl-2-penthiolic acid chloride was dropwise added thereto while being vigorously stirred.

The product precipitated in the form of a colorless crystal. The crystal was filtered out under reduced pressure and washed with water. Next, the crystal obtained was dissolved in 2.5 liter of 2N sodium hydroxide and kept overnight at room temperature. The reaction solution was neutralized to give a colorless crystal of 5-t-butyl-3-hydroxyisoxazole. Yield: 190 g.

1-6 Synthesis of N-Methyl-N-octadecyl-3-nitro-4-chlorobenzamide 105.7 g of 3-nitro-4-chlorobenzoic acid and 800 ml of acetonitrile were blended, and 68.6 g of thionyl chloride was added thereto and heated under reflux for 4 hours. After being cooled, the solvent was distilled out and the remaining part was dissolved in chloroform. To the solution was added 63.5 g of triethylamine and the temperature thereof was made 5° C. Next, chloroform solution containing 148.6 g of N-methyl-octadecylamine was dropwise added thereto. After completion of the reaction, water was added to the reaction mixture for liquid separation. The organic layer was dried with anhydrous sodium sulfate. The inorganic materials were filtered off and the solvent was distilled out, and the product was recrystallized from acetonitrile-methanol (1:3). Yield: 186 g.

1-7 Synthesis of 5-t-Butyl-2-(4-N-methyl-N-octadecylcarbamoyl-2-nitrophenyl)-3-isoxazolone 300 ml of dimethylformamide was added to 68.2 g of N-methyl-N-octadecyl-3-nitro-4-chlorobenzamide, 24.8 g of 5-t-butyl-3-hydroxyisoxazole and 24.8 g of potassium carbonate and reacted for 5 hours at 100° C. The solvent was distilled out under reduced pressure and ethyl acetate and water were added thereto and stirred, and then the organic layer was taken out and subjected to silica gel column chromatography to isolate the product. The product was recrystallized from n-hexane/ethyl acetate. Yield: 36.0 g.

1-8 Synthesis of 4-Chloromethyl-5-t-butyl-2-(4-N-methyl-N-octadecylcarbamoyl-2-nitrophenyl)-3-isoxazolone 36 g of 5-t-butyl-2-(4-N-methyl-N-octadecylcarbamoyl-2-nitrophenyl)-3-isoxazolone, 5.7 g of paraformaldehyde and 10.3 g of zinc chloride were blended with 250 ml of acetic acid and reacted for 20 hours at 100° C., while hydrogen chloride gas was blown thereinto. After completion of the reaction, the reaction mixture was cooled and poured into ice-water. The solid as precipitated was taken out by filtration and dissolved in chloroform and purified by column chromatography. Yield: 22.6 g.

1-9 Synthesis of Compound (1)

4 g of 4-chloromethyl-5-t-butyl-2-(4-N-methyl-N-octadecylcarbamoyl-2-nitrophenyl)-3-isoxazolone as synthesized in the above step 1-8 and 1.2 g of 1-phenyl-5-mercaptotetrazole were dissolved in acetone. Next, 1.4 g of potassium carbonate was added thereto and stirred for 3 hours at room temperature. The inorganic materials were filtered out and the product was recrystallized from methanol to obtain 1.1 g of a colorless crystal.

SYNTHESIS EXAMPLE 2

Synthesis of Compound (5)

18.6 g of 4-chloromethyl-5-t-butyl-2-(4-N-methyl-N-octadecylcarbamoyl-2-nitrophenyl)-3-isoxazolone as obtained in the above step 1-8 and 17.0 g of 2,6-bis(2-pyridyl)-4-hexadecyloxypyridine (as obtained by a method similar to that as described in *Journal of the American Chemical Society*, Vol. 103, page 3585 (1981)) were blended and made molten by heating at 120° C. After being stirred for 3 hours, this was cooled. The product was crystallized with chloroform. Thus, 23.5 g of the above-listed Compound (5) was obtained.

SYNTHESIS EXAMPLE 3

Synthesis of Compound (27)

3-1 Synthesis of 5-Phenyl-3-hydroxyisoxazole

This was synthesized in accordance with the method as described in *Chemical and Pharmaceutical Bulletin,* Vol. 14, No. 11, pp. 1277–1286 (1966).

3-2 Synthesis of 5-Phenyl-2-(4-N-methyl-N-octadecylsulfamoyl-2-nitrophenyl)-3-isoxazolone 50.3 g of 2-nitro-4-N-methyl-N-octadecylsulfamoyl-1-chlorobenzene and 19.3 g of 5-phenyl-3-hydroxyisoxazole as synthesized in the above-mentioned step 3-1 were dissolved in dimethylformamide and 16.8 g of potassium carbonate was added thereto and reacted for 5 hours at 80° C. Next, the inorganic materials were filtered out and the solvent was distilled out, and then the product was crystallized with methanol. Yield: 52.2 g.

3-3 Synthesis of 5-Phenyl-4-chloromethyl-2-(4-N-methyl-N-octadecylsulfamoyl-2-nitrophenyl)-3-isoxazolone This was synthesized by the similar method as described in step 1-8, with 39.5 g of 5-phenyl-2-(4-N-methyl-N-octadecylsulfamoyl-2-nitrophenyl)-3-isoxazolone being used in place of 36 g of 5-t-butyl-2-(4-N-methyl-N-octadecylcarbamoyl-2-nitrophenyl)-3-isoxazolone. The yield of the product was 12.3 g.

3-4 Synthesis of Compound (27)

5.6 g of 2-chloro-6-cyano-4-(3-chloro-4-N,N-dioctylsulfamoyl)phenylazophenol was dissolved in 200 ml of dry tetrahydrofuran, and 0.6 g of potassium t-butoxide was added thereto and stirred for 30 minutes at room temperature. To this was gradually and dropwise added 50 ml of a tetrahydrofuran solution containing 6.8 g of 5-phenyl-4-chloromethyl-2-(4-N-methyl-N-octadecylsulfamoyl-2-nitrophenyl)-3-isoxazolone as obtained in step 3-3. After reaction for 30 minutes, the reaction mixture was heated up to 60° C. and further reacted for 15 minutes. This was post-treated in a conventional manner and purified by column chromatography to obtain 3.4 g of the product of Compound (27).

The couplers to be used in the present invention can be synthesized by various methods, for example, those as described in the following patent publications or similar methods. Specifically, the couplers and the methods for the synthesis thereof are described, e.g., in U.S. Pat. Nos. 4,022,620, 3,973,968, 4,314,023, 4,046,575, 4,182,630, 4,146,396, 4,248,961, *Research Disclosure,* No. 180531, U.S. Pat. Nos. 3,894,875, 3,933,501, 3,615,506, 3,935,015, 4,241,168, 3,772,002, 3,227,554, 3,958,993, 3,933,500, 4,149,886, 3,926,436, *Research Disclosure,* No. 17938, U.S. Pat. Nos. 4,248,962, 3,424,583, 4,080,211, 3,370,952, 3,767,412, 4,268,591, 4,366,237, 4,262,087, 4,264,723, 4,310,619, 4,351,897, 4,283,472, 4,338,393, 4,310,618, 3,725,067, 3,061,432, 3,369,897, 4,254,212, 4,333,999, 4,327,173, 4,409,323, 4,390,618, 4,200,466, 4,126,461, 4,367,282, 4,404,274, 4,401,752, 4,409,320, 4,421,845, 4,427,767, 4,438,193, 4,443,536, 4,326,024, 4,420,556, 4,451,559, 4,455,366, 4,474,870, 4,477,563, 4,450,654, 4,532,202, 4,522,915, 4,522,916, 4,430,423, 4,518,682, 4,564,586, 4,565,777, 4,511,649, 4,500,653, 4,500,630, 4,549,899, European patent application No. 173,302A, Japanese patent application (OPI) Nos. 185950/85 and 237448/85.

The present invention can be adopted to multilayer color photographic materials having at least three light-sensitive layers each having a different spectral sensitivity on a support as well as to single color photographic materials having one or more emulsion layers on a support.

The multilayer color photographic materials generally have at least one red-sensitive emulsion layer, at least one green-sensitive emulsion layer and at least one blue-sensitive emulsion layer on a support. The order for the provision of these layers can freely be selected as desired.

The compounds of formula (I) and the couplers of the present invention can be incorporated in the above-mentioned color-sensitive emulsion layers or in the adjacent intermediate layers or the like which do not contain any light-sensitive emulsion.

In the case that the color-sensitive emulsion layer comprises two or more layers each having a different sensitive degree but having the same color sensitivity, these components can be added to any one of the high sensitive layer, middle sensitive layer and low sensitive layer.

The amount of the compound of formula (I) to be added is preferably from $1\times10^{-7}$ to $1\times10^{-1}$ mol/m$^2$, more preferably from $1\times10^{-6}$ to $1\times10^{-3}$ mol/m$^2$. However, the preferred amount of the compound of formula (I) to be added varies depending upon the kind of the PUG therein. For instance, when PUG is a dye or a ligand, the amount is preferably from $1\times10^{-5}$ to $1\times10^{-2}$ mol/m$^2$; and when PUG is a development inhibitor, the amount is preferably from $1\times10^{-7}$ to $1\times10^{-1}$ mol, especially preferably from $1\times10^{-6}$ to $5\times10^{-2}$ mol, per mol of the silver halide. When PUG is a development accelerator or a nucleating agent, preferred amount is same as that of the above-mentioned case where PUG is a development inhibitor. In the case that PUG is a silver halide solvent, the amount is preferably from $1\times10^{-5}$ to $1\times10^{-3}$ mol, especially preferably from $1\times10^{-4}$ to $1\times10^{-3}$ mol, per mol of the silver halide.

The amount of the coupler to be added is preferably from $1\times10^{-7}$ to $1\times10^{-1}$ mol/m$^2$, especially preferably from $1\times10^{-6}$ to $1\times10^{-3}$ mol/m$^2$.

The compounds of formula (I) of the present invention release the photographically useful group or a precursor thereof after having accepted an electron from a reducing substance. Accordingly, when the reducing substance has been imagewise oxodized, the remaining reducing substance in the form of a reverse image is utilized in the reaction.

The reducing substances to be used in the present invention may be either inorganic compounds or organic compounds, and those having an oxidation potential which is lower than the standard redox potential 0.80 V of silver ion/silver are preferred.

Regarding the inorganic compounds, metals, etc., having an oxidation potential of 0.8 V or less are mentioned useful, including, for example, Mn, Ti, Si, Zn, Cr, Fe, Co, Mo, Sn, Pb, W, $H_2$, Sb, Cu and Hg. Further, ions and complexes thereof having an oxidation potential of 0.8 V or less are also usable, including, for example, $Cr^{2+}$, $V^{2+}$, $Cu^{+}$, $Fe^{2+}$, $MnO_4^{2+}$, $I^-$, $Co(CN)_6^{4-}$, $Fe(CN)_6^{4-}$ and $(Fe\text{-}EDTA)^{2-}$. In addition, metal hydrides having an oxidation potential of 0.8 V or less are also usable, including, for example, NaH, LiH, KH, $NaBH_4$, $LiBH_4$, $LiAl(O—C_4H_9—t)_3H$ and $LiAl(OCH_3)_3H$. Further, sulfur- or phosphorus-containing compounds having an oxidation potential of 0.8 V or less are also usable, including, for example, $Na_2SO_3$, NaHS, $NaHSO_3$, $H_3P$, $H_2S$, $Na_2S$ and $Na_2S_2$.

Regarding the organic compounds which can be used as the reducing substance, organic nitrogen-containing compounds such as aliphatic amines or aromatic amines, organic sulfur-containing compounds such as aliphatic thiols or aromatic sulfur-containing compounds such as aliphatic thiols or aromatic thiols and organic phosphorus-containing compounds such as aliphatic phosphines and aromatic phosphines are suitable. In particular, compounds represented by formula (C) below are especially preferred, which correspond with the Kendal-Pelz formula (T. H. James, *The Theory of the Photographic Process*, 4th Ed., page 299).

$$Q_1—V_n—Q_2 \qquad (C)$$

In Formula (C), $Q_1$ and $Q_2$ each represents —O—Sub,

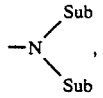

or —S—Sub; Sub has the same meaning as mentioned in formula (A); n represents an integer of from 0 to 8; when n is 0, formula (C) is $Q_1$-$Q_2$; $V_1$ through $V_8$ each has the following meanings: $V_1$ represents $\text{-}(\alpha_1—\beta_1)\text{-}$; $V_2$ represents $\text{-}(\alpha_1—\beta_1)(\alpha_2—\beta_2)\text{-}$; $V_3$ represents $\text{-}(\alpha_1—\beta_1)(\alpha_2—\beta_2)(\alpha_3—\beta_3)\text{-}$; $V_4$ represents $\text{-}(\alpha_1—\beta_1)(\alpha_2—\beta_2)(\alpha_3—\beta_3)(\alpha_4—\beta_4)\text{-}$; $V_5$ represents $\text{-}(\alpha_1—\beta_1)(\alpha_2—\beta_2)(\alpha_3—\beta_3)(\alpha_4—\beta_4)(\alpha_5—\beta_5)\text{-}$; $V_6$ represents $\text{-}(\alpha_1—\beta_1)(\alpha_2—\beta_2)(\alpha_3—\beta_3)(\alpha_4—\beta_4)(\alpha_5—\beta_5)(\alpha_6—\beta_6)\text{-}$; $V_7$ represents $\text{-}(\alpha_1—\beta_1)(\alpha_2—\beta_2)(\alpha_3—\beta_3)(\alpha_5—\beta_5)(\alpha_6—\beta_6)(\alpha_7—\beta_7)\text{-}$; and $V_8$ represents $\text{-}(\alpha_1—\beta_1)(\alpha_2—\beta_2)(\alpha_3—\beta_3)(\alpha_4—\beta_4)(\alpha_5—\beta_5)(\alpha_6—\beta_6)\text{-}(\alpha_7—\beta_7)(\alpha_8—\beta_8)\text{-}$; wherein $\alpha_1$ through $\alpha_8$ and $\beta_1$ through $\beta_8$ each represents

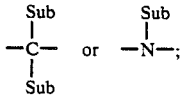

Sub has the same meaning as mentioned in formula (A); $Q_1$, $Q_2$, and $V_n$ may be linked together to form a heterocyclic ring.

Especially preferred compounds from among those of formula (C) are mentioned below.

(C-1)

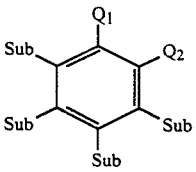

(C-2)

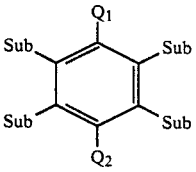

-continued (C-3)

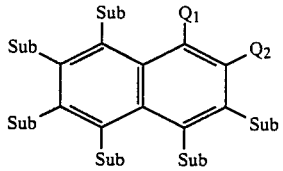

(C-4)

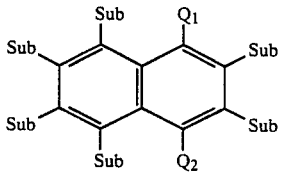

(C-5)

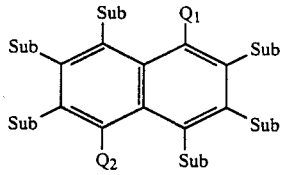

(C-6)

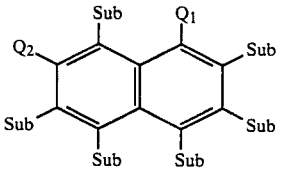

(C-7)

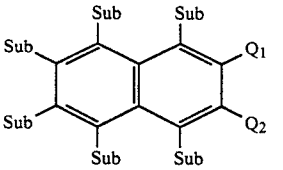

(C-8)

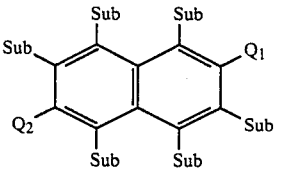

(C-9)

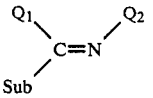

(C-10)

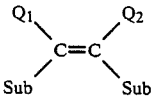

(C-11)

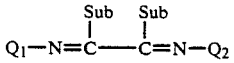

(C-12)

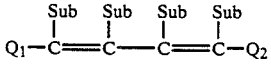

(C-13)

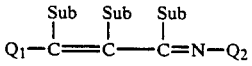

In the above-mentioned formulae (C-1) through (C-13), Sub has the same meaning as that given in the aforesaid $Q_1$, $Q_2$ or formula (A).

Preferred examples of the substituents $Q_1$ and $Q_2$ are as follows:

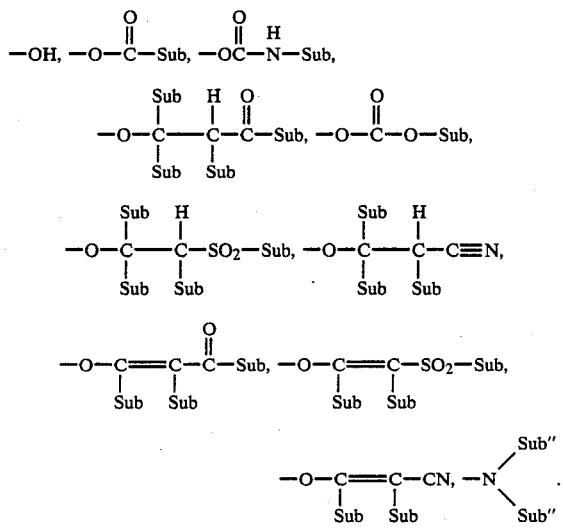

In these groups, Sub has the same meaning as given in formula (A); and Sub″ has the same meaning as Sub and is especially preferably a hydrogen atom, an alkyl group, an aryl group, an acyl group, or a sulfonyl group.

Examples of the compounds which can be used as the reducing substance in the present invention include inorganic reducing agents such as sodium sulfite or sodium hydrogensulfite; benzenesulfinic acids, hydroxylamines, hydrazines, hydrazides, borane/amine complexes, hydroquinones, aminophenols, catechols, p-phenylenediamines, 3-pyrazolidinones, hydroxytetronic acid, ascorbic acid, 4-amino-5-pyrazolones; as well as other reducing agents as described in T. H. James, *The Theory of the Photographic Process,* 4th Ed., pp. 291–334. In addition, reducing agent precursors as described, e.g., in Japanese patent application (OPI) Nos. 138736/81 and 40245/82 and U.S. Pat. No. 4,330,617 can also be utilized.

Examples of especially preferred reducing agents are given below.

3-Pyrazolidones and precursors thereof (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone);

Hydroquinones and precursors thereof (for example, hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-methyl-4-benzoyloxyphenol, 2-t-butyl-4-(4-chlorobenzoyloxy)phenol, sodium hydroquinonedisulfonate, 2-[3,5-bis(2-hexyldecanamido)benzamido]hydroquinone, 2-(3-hexadecanamido)benzamidohydroquinone, 2-(2-hexyldecanamido)hydroquinone);

Color developing agents of paraphenylenediamines (for example, 4-amino-N,N-diethylaniline, 3-methyl-4-amino-N,N-diethylaniline, 4-amino-N-ethyl-N-β-hydroxyethylanine, 3-methyl-4-amino-N-ethyl-N-β-hydroxyethylaniline, 3-methyl-4-amino-N-ethyl-N-β-butoxyethylaniline, 3-methyl-4-amino-N-ethyl-N-β-methanesulfonamidoethylaniline, 4-amino-3-methyl-N-ethyl-N-β-methoxyethylaniline).

As the reducing agent for aminophenols, there may be mentioned, for example, 4-amino-2,6-dichlorophenol, 4-amino-2,6-dibromophenol, 4-amino-2-methylphenol sulfate, 4-amino-3-methylphenol sulfate, 4-amino-2,6-dichlorophenyl hydrochloride, etc. In addition, *Research Disclosure,* Vol. 151 (RD No. 15108) and U.S. Pat. No. 4,021,240 describe 2,6-dichloro-4-substituted sulfonamidophenols, 2,6-dibromo-4-substituted sulfonamidophenols; and Japanese patent application (OPI) No. 116740/84 described p-(N,N-dialkylaminophenyl)sulfamines. In addition to the above-mentioned phenol type reducing agents, naphthol type reducing agents, for example, 4-aminonaphthol derivative and 4-substituted sulfonamidonaphthol derivatives are also useful. Further, conventional color developing agents which can be used in the present invention are known; for instance, U.S. Pat. No. 2,895,825 described aminohydroxypyrazole derivatives; U.S. Pat. No. 2,892,714 describes aminopyrazoline derivatives, and *Research Disclosures* (June, 1980), pp. 227–230 and pp. 236–240 (RD No. 19412, RD No. 19415) describe hydrazone derivatives. These color developing agents can be used singly or in the form of a combination of two or more kinds of them.

The above-mentioned reducing agent can be incorporated in a development processing solution or in a photographic light-sensitive material. In general, paraphenylenediamine type developing agents are used as incorporated in a development processing solution. In this case, an additional reducing agent can be incorporated in a photographic light-sensitive material. In the case of the incorporation of the reducing agent into the photographic light-sensitive material, the above-mentioned reducing agent can be used singly or in the form of a combination of kinds of the agents or in the form of a precursor of the agent. For the incorporation of the precursor of the reducing agent, for example, the precursors as described in U.S. Pat. Nos. 3,342,599, 3,565,627, 3,291,609, 4,157,915, *Research Disclosure,* RD No. 15159, U.S. Pat. Nos. 3,415,651, 3,419,395, 2,930,693, 3,650,749, 4,560,646, 4,554,243, 4,522,917, 4,446,216, 4,439,519, 4,426,444 and Japanese patent application (OPI) No. 10461/84 can be utilized.

In the practice of the present invention, one preferred embodiment is to incorporate a paraphenylenediamine type color developing agent in a treating solution and to incorporate the reducing agent of formula (C) in a photographic light-sensitive material. In this case, the reducing agent is used in an amount falling within a range of from $10^{-2}$ to $10^{2}$ mol, especially from $10^{-1}$ to 10 mol, per mol of the compound of formula (I). In this embodiment, the reducing agent to be incorporated into the photographic light-sensitive material is preferably one which is immobilized by the introduction of a so-called ballast group (especially having 8 or more carbon atoms) thereinto and which is represented by the aforesaid formulae (C-1) through (C-8) (especially (C-1) through (C-4). In particular, ballast-containing hydroquinones and ballast-containing ortho- or para-sulfonamidophenols or naphthols are especially preferred. In this embodiment, the paraphenylenediamine type compound is reacted with exposed silver halide in the emulsion layer of a color photographic material to give an oxidized product, the greater amount of which is reacted with a coupler for coloration and a smaller amount of which acts to oxidize the reducing agent as previously incorporated in the light-sensitive material. In this procedure, no oxidation occurs in the non-exposed part, and the incorporated reducing agent acts to reduce the compound of formula (I), whereby the photographically useful group in the compound is released therefrom.

In the photographic emulsion layers of the photographic light-sensitive materials of the present invention can be used any silver halide of silver bromide, silver iodobromide, silver iodochlorobromide, silver chlorobromide and silver chloride. In particular, preferred silver halides are silver iodobromide or silver iodochlorobromide containing about 30 mol% or less silver iodide. Especially preferred ones are silver iodobromide containing from about 2 mol% to about 25 mol% of silver iodide.

The silver halide particles in the photographic emulsions may be so-called regular particles having cubic, octahedral, tetradecahedral or the like regular crystalline forms, or may be irregular particles having spherical or the like irregular crystalline forms, or otherwise, may be those having twin plane or the like crystal defects or composite particles comprising the combination of the crystalline forms.

The silver halide may comprise fine particles having a particle size of about 0.1 μm or less or may be large sized particles having a particle size with a diameter of a projected area of up to about 10 μm. the silver halide emulsion may be a monodispersed one having a narrow particle size distribution or may be a polydispersed one having a broad particle size distribution.

The silver halide photographic emulsions to be used in the present invention can be prepared in a conventional manner, for example, in accordance with known methods as described in *Research Disclosure,* RD No. 17643 (December, 1978), pp. 22–23 (I. Emulsion Preparation and Types) and RD No. 18716 (November, 1979), page 648.

Further, the photographic emulsions to be used in the present invention can be prepared by other various methods, for example, as described in P. Glafkides, *Chimie et Physique Photographique* (Paul Montel Co., 1967), G. F. Duffin, *Photographic Emulsion Chemistry* (Focal Press Co., 1966) and V. L. Zelikman et al., *Making and Coating Photographic Emulsion* (Focal Press Co., 1964). For instance, the emulsions can be obtained by any method of an acidic method, a neutral method, or an ammonia method; and for the reaction of a soluble silver salt and a soluble halide, a single jet method, a double jet method, or a combination thereof can be utilized. A so-called reverse jet method where the particles are formed in the presence of excess silver ions can also be utilized. Further, a so-called controlled double jet method which is one type of the double jet method can also be utilized, where the pAg value in the liquid phase to form the silver halide particles is kept constant. According to this method, silver halide emulsions having a regular crystalline form and a nearly uniform particle size can be obtained.

Two or more kinds of silver halide emulsions which have separately been prepared can be blended and the resulting mixture can be used.

The silver halide emulsions comprising the above-mentioned regular particles can be obtained by controlling the pAg and pH in the formation of the particles. The details are described, e.g., in *Photographic Science and Engineering,* Vol. 6, pp. 159–165 (1962), *Journal of Photographic Science,* Vol. 12, pp. 242–251 (1964), U.S. Pat. No. 3,655,394, and British Pat. No. 1,413,748.

As the monodispersed emulsion, such typically comprise silver halide particles having an average particle diameter which is larger than about 0.1 μm, at least about 95% by weight of the particles having a particle diameter falling within the range of the average particle diameter ±40%. In the practice of the present invention, the emulsions which comprise silver halide particles having an average particle diameter of from about 0.25 to about 2 μm, at least about 95% by weight or by number of the particles having a particle diameter falling within the range of the average particle diameter ±20%, can be used. The preparation of these emulsions is described in U.S. Pat. Nos. 3,574,628 and 3,655,394 and British Pat. No. 1,413,748. Further, other monodispersed emulsions, for example, as described in Japanese patent application (OPI) Nos. 8600/73, 39027/76, 83097/76, 137133/78, 48521/79, 99419/79, 37635/83, and 49938/83 can also be used preferably in the present invention.

In addition, plate-like (tabular) particles having an aspect ratio of about 5 or more can also be used in the present invention. The plate-like particles can easily be prepared by means of methods as described, e.g., in Gutoff, *Photographic Science and Engineering,* Vol. 14, pp. 248–257 (1970), U.S. Pat. Nos. 4,434,226, 4,414,310, 4,433,048, and 4,439,520, and British Pat. No. 2,112,157. The use of the plate-like particles is effective for the improvement of the color sensitization efficiency with sensitizer dyes, improvement of the graininess, and elevation of the sharpness, which is described in detail, e.g., in U.S. Pat. No. 4,434,226.

Regarding the crystal structure of the silver halide particles in the emulsions of the present invention, the particles may have a uniform crystal constitution or may comprise different inner and outer halogen compositions or may comprise a layer constitution. These emulsion particles are described in British Pat. No. 1,027,146, U.S. Pat. Nos. 3,505,068 and 4,444,877 and Japanese patent application (OPI) No. 143331/85. In addition, the silver halide particles may be epitaxially conjugated particles formed by epitaxial conjugation of crystals each having a different silver halide composition, or as the case may be, they may contain any other compounds than silver halides, such as silver rhodanide or lead oxide, as conjugated with the silver halide host crystals. These emulsion particles are known, as described, e.g., in U.S. Pat. Nos. 4,094,684, 4,142,900, 4,459,353, British Pat. No. 2,038,792, U.S. Pat. Nos. 4,349,622, 4,395,478, 4,433,501, 4,463,087, 3,656,962, 3,852,067, and Japanese patent application (OPI) No. 162540/84.

Further, a mixture comprising various particles each having a different crystalline form can also be used in the present invention.

The emulsions to be used in the present invention are generally those which have been physically ripened, chemically ripened and/or spectrally sensitized. Additives which may be used in these steps are described in *Research Disclosure,* RD No. 17643 and RD No. 18716; and the relevant parts therein are listed in Table A below.

Other known photographic additives which can be used in the present invention are also described in the above two publications, and the relevant parts therein are also listed in Table A.

TABLE A

| No. | Kind of Additives | RD 17643 | RD 18716 |
|---|---|---|---|
| 1. | Chemical Sensitizer | p. 23 | p. 648, right column |
| 2. | Sensitivity Enhancement | | " |
| 3. | Spectral Sensitizer, Supersensitizer | pp. 23–24 | p. 648, right column to p. 649, right column |
| 4. | Whitener | p. 24 | |
| 5. | Antifoggant, Stabilizer | pp. 24–25 | p. 649, right column |
| 6. | Light Absorbent, Filter Dye, UV Absorbent | pp. 25–26 | p. 649, right column to p. 650, left column |
| 7. | Stain Inhibitor | p. 25, right column | p. 650, left to right column |
| 8. | Color Image Stabilizer | p. 25 | |
| 9. | Hardener | p. 26 | p. 651, left column |
| 10. | Binder | p. 26 | " |
| 11. | Plasticizer, Lubricant | p. 27 | p. 650, right column |
| 12. | Coating Assistant Agent, Surfactant | pp. 26–27 | " |
| 13. | Antistatic Agent | p. 27 | " |

Supports which are suitably used in the present invention are described, for example, in the above-mentioned *Research Disclosure,* RD No. 17643, page 28 and RD No. 18716, from page 647, right column to page 648, left column.

The color developers to be used for the development treatment of the photographic materials of the present invention are preferably alkaline aqueous solutions mainly comprising an aromatic primary amine type color developing agent. As the color developing agents, aminophenol type compounds are useful; and in particular, p-phenylenediamine type compounds are especially preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and sulfates, hydrochlorides, phosphates, and p-toluenesulfonates thereof as well as tetraphenyl borates and p-(t-octyl)benzenesulfonates. These diamines are generally stable in the form of salts rather than the free forms, and so, the salts are preferably used.

Aminophenol type derivatives include, for example, o-aminophenol, p-aminophenol, 4-amino-2-methylphenol, 2-amino-3-methylphenol, 2-hydroxy-3-amino-1,4-dimethylbenzene, etc.

In addition, other compounds as described in L. F. A Mason, *Photographic Processing Chemistry* (Focal Press), pp. 226–229, U.S. Pat. Nos. 2,193,015 and 2,592,364 and Japanese patent application (OPI) No. 64933/73 can also be used. If necessary, a combination comprising two or more kinds of different color developing agents can be utilized.

The color developers can contain a pH buffer such as alkali metal carbonates, borates, or phosphates; a development inhibitor or antifoggant such as bromides, iodides, benzimidazoles, benzothiazoles, or mercapto compounds; a preservative such as hydroxylamine, triethanolamine, compounds as described in German patent application (OLS) No. 2,622,950, sulfites or bisulfites; an organic solvent such as diethylene glycol; a development accelerator such as benzyl alcohol, polyethylene glycol, quaternary ammonium salts, amines, thiocyanides, or 3,6-thiaoctane-1,8-diol; a dye-forming coupler; a competing coupler; a nucleating agent such as sodium boronhydride; an auxiliary developing agent such as 1-phenyl-3-pyrazolidone; a tackifier; a chelating agent such as aminopolycarboxylic acids (for example, ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and compounds as described in Japanese patent application (OPI) No. 195845/83), 1-hydroxyethylidene-1,1'-diphosphonic acid, organic phosphonic acids as described in *Research Disclosure,* RD No. 18170 (May, 1979), aminophosphonic acids (for example, aminotris(methylenephosphonic acid), ethylenediamine-N,N,N,',N'-tetramethylenephosphonic acid), phosphonocarboxylic acids as described in Japanese patent application (OPI) Nos. 102726/77, 42730/78, 121127/79, 4024/80, 4025/80, 126241/80, 65955/80, 65956/80, and *Research Disclosure,* RD No. 18170 (May, 1979), etc.

The color developing agent is generally used in a concentration of from about 0.1 g to about 30 g, more preferably from about 1 g to about 15 g, per liter of the color developer. The pH of the color developer is generally about 7 or more, most generally from about 9 to about 13. The use of replenisher where the concentration of the halides and that of the color developing agent are properly regulated for reducing the amount of the replenisher to be added to the color developer during the process of the color development is preferred so as to depress environmental pollution and to reduce the cost.

In development treatment of reversal color photographic materials, they are generally subjected to black-and-white development followed by color development. As the black-and-white developer, any known conventional black-and-white developing agents can be used singly or in the form of a combination of plural kinds of the agents, including, for example, dihydroxybenzenes such as hydroquinone or hydroquinone monosulfonate, 3-pyrazolidones such as 1-phenyl-3-pyrazolidone, or aminophenols such as N-methyl-p-aminophenol.

The photographic emulsion layers are, after having been color-developed, generally bleached. The bleaching treatment can be carried out together with a fixation treatment in a combined bleaching-fixation bath (blix bath); or alternatively can be carried out separtely from the latter. Further, in order to accelerate the treatment, a process comprising bleaching treatment followed by bleaching-fixation treatment can also be utilized. As the bleaching agents to be used in the bleaching treatment or in the bleaching-fixation treatment, there may be mentioned, for example, compounds of polyvalent metals such as iron(III), cobalt(III), chromium(VI) or copper(II) (such as ferricyanides), peracids, quinones and nitroso compounds; bichromates; organic complexes with iron(III) or cobalt(III) (for example, complexes of ethylenediaminetetraacetic acid, diethylenetriaminepentaacetic acid or the like aminopolycarboxylic acids, aminopolyphosphonic acids, phosphonocarboxylic acids or organic phosphonic acids) as well as organic acids such as citric acid, tartric acid or malic acid; persulfates; hydrogen peroxide; permanganates, etc. In particular iron(III) organic complexes and persulfates are especially preferred in view of the rapid processability and less environmental pollution. Aminopolycarboxylic acids or aminopolyphosphonic acids or salts thereof, which are usable for the formation of iron(III) organic complexes, are listed below.

Ethylenediaminetetraacetic acid,
Diethylenetriaminepentaacetic acid,
Ethylenediamine-N-(β-hydroxyethyl)-N,N',N'-triacetic acid,
1,2-Diaminopropanetetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-Diamino-2-propanoltetraacetic acid,
Methyliminodiacetic acid,
Iminodiacetic acid,
Hydroxyliminodiacetic acid,
Dihydroxyethylglycineethylether-diaminetetraacetic acid,
Glycolether-diaminetetraacetic acid,
Ethylenediaminetetrapropionic acid,
Ethylenediaminedipropionic acid,
Phenylenediaminetetraactic acid,
2-Phosphonobutane-1,2,4-triacetic acid,
1,3-Diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid,
1-Hydroxyethylidene-1,1'-disphosphonic acid.

Among these compounds, iron(III) complexes of ethylenediaminetetraacetic acid, diethylenetriaminepentaacetic acid, cyclohexanediaminetetraacetic acid, 1,2-diaminopropanetetraacetic acid, and methyliminodiacetic acid are especially preferred as having a high bleaching ability.

Regarding the iron(III) complexes, one or more ready-made complexes can be used; or alternatively, an iron(III) salt (for example, ferric sulfate, ferric chloride, ferric nitrate, ammonium ferric sulfate, ferric phosphate, etc.) can be reacted with a chelating agent (such as aminopolycarboxylic acids, aminopolyphosphonic acids, phosphonocarboxylic acids, etc.) in a solution to give a ferric complex in situ. In the latter case, where the complex is formed in the treating solution, one or both of the ferric salt and/or the chelating agent may be a mixture of two or more kinds of the compounds. In both cases where the ready-made complex is used or the complex is formed in situ, the chelating agent can be used in an amount higher than the stoichiometric amount thereof. In addition, the above-mentioned ferric complex-containing bleaching solution or bleaching-fixation solution may further contain any other metal ion than iron, for example, calcium, magnesium, aluminum, nickel, bismuth, zinc, tungsten, cobalt, or copper, as well as complexes thereof or hydrogen peroxide.

Examples of the persulfates for the bleaching treatment or bleaching-fixation treatment in the practice of the present invention are alkali metal persulfates such as potassium persulfate or sodium persulfate and ammonium persulfate, etc.

The bleaching solution or bleaching-fixation solution can contain a rehalogenating agent such as bromides (for example, potassium bromide, sodium bromide, ammonium bromide) or chlorides (for example, potassium chloride, sodium chloride or ammonium chloride). If necessary, the solution may further contain one or more inorganic acids or organic acids having a pH buffer property or alkali metal or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate, or tartaric acid, or a corrosion inhibitor such as ammonium nitrate or guanidine.

The amount of the bleaching agent in the bleaching solution is generally from 0.1 to 2 mol per liter of the solution. Regarding the preferred pH range of the bleaching solution, the solution preferably has a pH of from 0.5 to 8.0 when containing a ferric complex, and especially has a pH of from 4.0 to 7.0 when containing a ferric complex of an aminopolycarboxylic acid, aminopolyphosphonic acid, phosphoncarboxylic acid, or organic phosphonic acid; and the solution preferably has a pH of from 1 to 5 when containing a persulfate in a concentration of 0.1 to 2 mol/liter.

As the fixing agent to be used in the fixation or bleaching-fixation in the practice of the present invention, any known fixing agents can be utilized, for example, a water-soluble silver halide solvent including thiocyanates such as sodium thiocyanate or ammonium thiocyanate; and thioether compounds and thioureas such as ethylenebisthioglycolic acid, 3,6-dithia-1,8-octanediol, etc. These can be used singly or in the form of a combination of two or more kinds of them. In addition, a special bleaching-fixation solution can be utilized in the bleaching-fixation treatment, as comprising a combination of a fixing agent and a large amount of a halide such as potassium iodide, which is described in Japanese patent application (OPI) No. 155354/80.

In the fixation or bleaching-fixation treatment, the concentration of the fixing agent is preferably from 0.2 to 4 mol/liter. In the bleaching-fixation treatment, the amount of the ferric complex and that of the fixing agent are from 0.1 to 2 mol, and from 0.2 to 4 mol, respectively, each per liter of the bleaching-fixation solution. The pH of each of the fixation solution and the bleaching-fixation solution is preferably from 4.0 to 9.0, especially preferably from 5.0 to 8.0. The fixation solution and the bleaching-fixation solution may contain, in addition to the above-mentioned additives which can be added to the bleaching solution, a preservative as selected from sulfites (for example, sodium sulfite, potassium sulfite, and ammonium sulfite), bisulfites, hydroxylamines, hydrazines and aldehyde/bisulfite adducts (for example, acetaldehyde/sodium bisulfite adduct). In addition, the solution may further contain a variety of fluorescent whitening agents, anti-foaming agents, surfactants as well as organic solvents such as polyvinyl pyrrolidone or methanol.

A bleaching accelerator can be added to the bleaching solution, the bleaching-fixation solution and the prebaths, if necessary. Examples of the usable bleaching accelerators are described in the following patent publications: specifically, U.S. Pat. No. 3,893,858, West German Pat. Nos. 1,290,812, 2,059,988, Japanese patent application (OPI) Nos. 32736/78, 57831/78, 37418/78, 65732/78, 72623/78, 95630/78, 95631/78, 104232/78, 124424/78, 141623/78, 28426/78, and *Research Disclosure,* RD No. 17129 (July, 1978) describe compounds having mercapto group or disulfide group; Japanese patent application (OPI) No. 140129/75 describes thiazolidine derivatives; Japanese Patent Publication No. 8506/70, Japanese patent application (OPI) Nos. 20832/77, 32735/78, and U.S. Pat. No. 3,706,561 describe thiourea derivatives; West German Patent 1,127,715, Japanese patent application (OPI) No. 16235/83 describe iodides West German Pat. Nos. 966,410 and 2,748,430 describe polyethylene oxides; Japanese Patent Publication No. 8836/70 describes polyanine compounds; and Japanese patent application (OPI) Nos. 42434/74, 59644/74, 94927/78, 35727/79, 26506/80, and 163940/83 describe other usable compounds as well as iodides and bromides. In particular, the compounds having mercapto group or disulfide group are especially preferred among them, as having a higher accelerating activity; and the compounds as described in U.S. Pat. No. 3,893,858, West German Pat. No. 1,290,812, and Japanese patent application (OPI) No. 95630/78 are particularly preferred.

Each of the treating solutions is used at 10° C. to 50° C. in the practice of the present invention. The temperature falling within a range of from 33° C. to 38° C. is standard. However, a higher temperature than this range may be utilized so as to accelerate the treatment or to reduce the treating time; or on the contrary, a lower temperature than that may also be utilized so as to improve the quality of images formed and to improve the stability of the treating solutions. In addition, a treatment with cobalt intensification or hydrogen peroxide intensification, as described in West German Pat. No. 2,226,770 and U.S. Pat. No. 3,674,499, or a combined development bleaching fixation treatment in one bath, as described in U.S. Pat. No. 3,923,511, can be utilized so as to economize the amount of the silver to be used in the light-sensitive materials.

The silver halide color photographic materials of the present invention are generally subjected to a washing and stabilization step after the above-mentioned desilvering step. In this connection, a simple process comprising only the stabilization treatment without any substantial water washing can be applied to the materials.

The washing water to be used in the washing step can optionally contain known additives, if desirable. For instance, a chelating agent such as inorganic phosphoric acids, aminopolycarboxylic acids or organic phosphoric acids; a bactericide or fungicide for inhibiting the growth of various bacteria or algae; a hardener such as magnesium salts or aluminum salts; and a surfactant for inhibiting drying load or unevenness can be used. In addition, the compounds as described in L. E. West, *Water Quality Criteria Phot. Sci. and Eng.,* Vol. 9, No. 6, pp. 344–359 (1965) can also be used.

The washing step can be carried out by the use of two or more baths, if desirable, whereupon a multistage countercurrent system can be utilized for economizing the amount of the washing water.

As the stabilization solution to be used in the stabilization step, there may be mentioned a processing solution to stabilize the color images formed. For instance, a solution having a buffer property of pH 3 to 6 as well as a solution containing an aldehyde (such as formaldehyde) can be used. The stabilizer solution contain, if desirable, a fluorescent whitening agent, chelating agene, a bactericide, a fungicide, a hardener, and/or a surfactant.

The stabilization step can be carried out by the use of two or more baths, if necessary, whereupon a multistage countercurrent stabilization system (for example, comprising 2 to 9 stages) can be utilized for economizing the amount of the stabilizer solution to be use. In addition, the washing step can be omitted in the practice of the stabilization step.

In a continuous treatment, a replenisher is suitably added to each treating solution so as to prevent the variation of the composition of the solution, whereby constantly finished products can be obtained. The amount of the replenisher to be added can be reduced to a half or less of standard replenisher amount, so as to decrease the treatment cost.

Each treating bath can be provided, if necessary, with a heater, a temperature sensor, a liquid level sensor, a circulating pump, a filter, various kinds of floating lids, various kinds of squeezers, a nitrogen stirrer, an air stirrer, etc.

The treating time in each step can be made shorter than the standard time, if necessary, in order to accelerate the rapid treatment, so far as the shortened treatment time does not have any bad influence on the photographic treatment.

The silver halide color photographic materials of the present invention can contain a color developing agent or a precursor thereof so as to simplify and accelerate the photographic treatment. In the incorporation of the agent into the materials, the precursor thereof is preferred since the stability of the materials can be kept higher. Typical examples of the developing agent precursors include, for example, indoaniline type compounds as described in U.S. Pat. No. 3,342,597; Shiff base type compounds as described in U.S. Pat. No. 3,342,599, *Research Disclosure,* RD No. 14850 (August, 1976) and RD No. 15159 (November, 1976); aldol compounds as described in *Research Disclosure,* RD No. 13924; metal salt complexes as described in U.S. Pat. No. 3,719,492; and urethane type compounds as described in Japanese Patent Application (OPI) No. 135628/78. In addition, various kinds of salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, 83565/82 can also be used in the present invention.

The silver halide color photographic materials of the present invention can contain a variety of 1-phenyl-3-pyrazolidones in order to accelerate the color development thereof. Typical examples of the compounds are described, e.g., in Japanese Patent Application (OPI) Nos. 64339/81, 144547/82, 211147/82, 50532/83, 50536/83, 50533/83, 50534/83, 50535/83, and 115438/83.

In the case that the light-sensitive materials of the present invention are color papers, they are generally subjected to bleaching-fixation treatment; or in the case that the materials are color photographic materials for taking pictures, they may be subjected to the treatment, if necessary.

Now, the present invention will be explained in greater detail by reference to the following examples, which, however, are not intended to be interpreted as limiting the scope of the present invention.

EXAMPLE 1

Sample No. 101

Several layers each having the composition as shown below were provided on a triacetyl cellulose film support to obtain a photographic material, Sample No. 101.

First Layer: Emulsion Layer

| | |
|---|---|
| Silver iodobromide emulsion (silver iodide: 5 mol %) | 1.0 g (Ag)/$m^2$ |
| Coupler (C-1) | 0.6 g/$m^2$ |
| Coupler B-1 | 0.77 g/$m^2$ |
| Sensitizing Dye I | $2 \times 10^{-4}$ g/$m^2$ |
| Sensitizing Dye II | $6 \times 10^{-4}$ g/$m^2$ |
| Sensitizing Dye III | $2 \times 10^{-5}$ g/$m^2$ |
| Oil-1 | 0.5 cc/$m^2$ |
| Oil-2 | 0.5 cc/$m^2$ |

Second Layer: Protective Layer

A gelatin layer containing trimethyl methacrylate particles (diameter: about 1.5 μm) was coated.

Gelatin Hardener H-1 and surfactant were added to each of the layers, in addition to the above-mentioned components.

The compounds as used in this sample were as follows:

Coupler B-1 (compound described in U.S. Pat. No. 4,555,477):

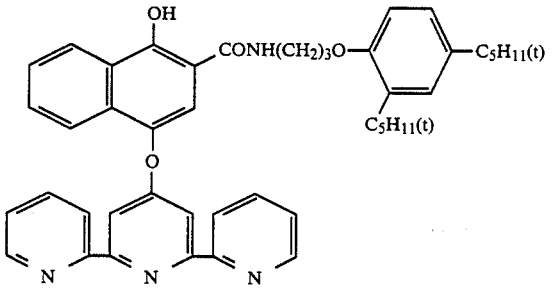

Oil-1: Tricresyl phosphate

Oil-2: Dibutyl phosphate

Sensitizing Dye I:

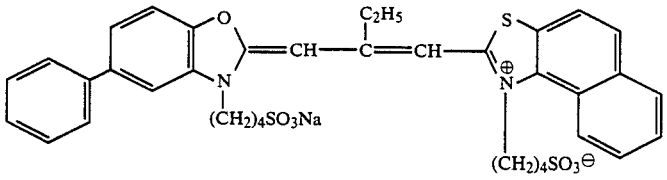

Sensitizing Dye II:

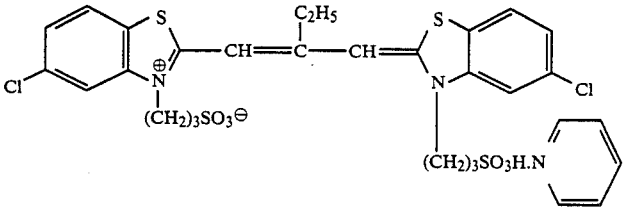

Sensitizing Dye III:

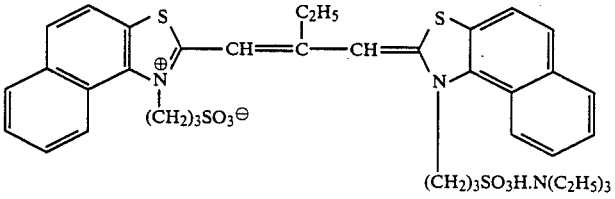

Sample Nos. 102 through 107

In place of Coupler B-1 in Sample No. 101, Coupler P-1 (given below) or the compound of the present invention was used as shown in Table 1 below. To Sample Nos. 103 through 107, an equimolar amount of Coupler (C-20) was further added, whereby the gradation of all samples was made almost the same.

Coupler P-1 (conventional colored coupler):

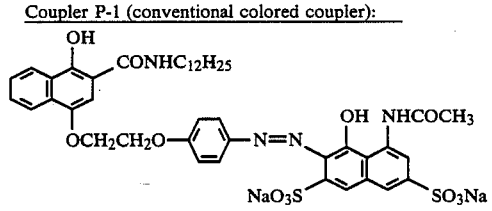

Sample Nos. 101 through 107 thus obtained were subjected to wedge exposure or 20 CMS with a tungsten lamp which had been regulated to have a color temperature of 4,800° K. and which had been provided with a yellow filter, and thereafter subjected to the following treatments.

| | |
|---|---|
| Color Development | 2 min 10 sec |
| Bleaching | 6 min 30 sec |
| Washing with Water | 2 min 10 sec |
| Iron (II) Bath Treatment | 6 min 30 sec |
| Washing with Water | 2 min 10 sec |
| Fixation | 4 min 20 sec |
| Washing with Water | 3 min 15 sec |
| Stabilization | 1 min 05 sec |

The composition of each treating solution as used in each of the above-mentioned steps was as follows:

| Color Developer | |
|---|---|
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |
| **Bleaching Solution** | |
| Ammonium Ferric Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH 6.0 |
| **Iron (II) Bath** | |
| Ammonium Ferrous Sulfate | $1 \times 10^{-2}$ mol |
| Water to make | 1 liter |
| | pH 6.0 |
| **Fixation Solution** | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 liter |
| | pH 6.6 |
| **Stabilizer Solution** | |
| Formaldehyde (40%) | 2.0 ml |
| Polyoxyethylene-p-monononylphenylether (average polymerization degree: about 10) | 0.3 g |
| Water to make | 1.0 liter |

The results are given in Table 1 below, which indicate that the compounds of the present invention having a higher masking effect without decrease in sensitivity are superior to the conventional colored coupler.

TABLE 1

| Sample No. | Masking Compound | Added Amount | Sensitivity* | Masking** |
|---|---|---|---|---|
| 101 (Comparison) | B-1 | Control | ±0 (Control) | 0.1 |
| 102 (Comparison) | P-1 | ⅓ time, by mol | −0.15 | 0.4 |
| 103 (Invention) | (4) | one time, by mol | +0.03 | 0.35 |
| 104 (Invention) | (5) | one time, by mol | +0.02 | 0.40 |
| 105 (Invention) | (9) | one time, by mol | +0.03 | 0.40 |
| 106 (Invention) | (2) | ⅓ time, by mol | +0.03 | 0.40 |
| 107 (Invention) | (3) | ⅓ time, by mol | +0.02 | 0.35 |

Notes:
*This is a relative sensitivity as obtained on the bases of the control value being 0, which is the point logE value of (fog density + 0.2).
**This is represented by the difference between the magenta density in the logE value to give the cyan density of 1.0 and that in the cyan-fogged part.

EXAMPLE 2

Sample Nos. 101 through 105 as obtained in Example 1 were processed in the manner as shown below, including the step to treat in a combined bleaching-fixation bath after having been exposed in the same manner as in Example 1.

In this process, the concentration of iron(II) was 5 mol% (or $1 \times 10^{-2}$ mol/liter) of the total iron salt amount.

The results are given in Table 2 below, which also indicate the higher masking effect of the compounds of the present invention with an extremely small decrease in sensitivity, as with the results obtained in Example 1.

| Processing Steps | Time | Temperature |
|---|---|---|
| Color Development | 3 min 15 sec | 38° C. |
| Bleaching-Fixation | 2 min 00 sec | " |
| Rinsing | 1 min 40 sec | " |
| Stabilization | 40 sec | " |

The composition of each treating solution was as follows:

Color Developer:

Same as that in Example 1.

| Bleaching Fixation Solution: | |
|---|---|
| Ammonium Ferric Ethylenediaminetetraacetate | 80.0 g |
| Disodium Ethylenediaminetetraacetate | 10.0 g |
| Bleaching Accelerator | 1.5 g |

-continued

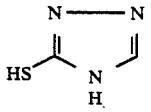

| | |
|---|---|
| Sodium Sulfite | 12.0 g |
| Ammonium Thiosulfate Aqueous Solution (70%) | 240 ml |
| Water to make | 1 liter |
| Aqueous ammonia (28%) to make | pH of 6.8 |
| Rinsing Solution: | |
| Disodium Ethylenediaminetetraacetate | 0.4 g |
| Water to make | 1 liter |
| Sodium hydroxide to make | pH of 7.0 |
| Stabilizer Solution: | |
| Formaldehyde (37% w/v) | 2.0 ml |
| Polyoxyethylene-p-monononylphenylether (average polymerization degree: 10) | 0.3 g |
| Water to make | 1 liter |

TABLE 2

| Sample No. | Sensitivity | Masking |
|---|---|---|
| 101 (Comparison) | ±0 (control) | 0.05 |
| 102 (Comparison) | −0.14 | 0.38 |
| 103 (Invention) | ±0 | 0.40 |
| 104 (Invention) | −0.02 | 0.3 |
| 105 (Invention) | −0.02 | 0.25 |

EXAMPLE 3

Several layers each having the composition as shown below were provided on a cellulose triacetate film support which had been sub-coated to obtain a multilayer color photographic material sample, Sample No. 301.

The composition of each light-sensitive layer was as follows:

Regarding the coated amount, the amount of the coated silver (unit: g/m$^2$) is shown in the silver halide and colloidal silver, and the amount of each of the couplers, additives and gelatin themselves is designated by the unit of g/m$^2$, individually, and the amount of the sensitizing dye is designated by the number of mol per mol of the silver halide in the same layer containing the sensitizing dye.

| | |
|---|---|
| First Layer: Antihalation Layer | |
| Black Colloidal Silver | 0.2 (Ag) |
| Gelatin | 1.3 |
| Colored Coupler P-2 | 0.06 |
| Ultraviolet Absorbent UV-1 | 0.1 |
| Ultraviolet Absorbent UV-2 | 0.2 |
| Dispersion Oil, Oil-1 | 0.01 |
| Dispersion Oil, Oil-2 | 0.01 |
| Second Layer: Intermediate Layer | |
| Fine Silver Bromide Particles (average particle diameter: 0.07 μm) | 0.15 (Ag) |
| Gelatin | 1.0 |
| Colored Coupler P-3 | 0.02 |
| Dispersion Oil, Oil-1 | 0.1 |
| Third Layer: First Red-Sensitive Emulsion Layer | |
| Silver Iodobromide Emulsion (silver iodide: 2 mol %, average particle diameter: 0.3 μm) | 0.4 (Ag) |
| Gelatin | 0.6 |
| Sensitizing Dye IV | $1.0 \times 10^{-4}$ |
| Sensitizing Dye V | $3.0 \times 10^{-4}$ |
| Sensitizing Dye VI | $1 \times 10^{-5}$ |
| Coupler (C-1) | 0.06 |
| Coupler (C-4) | 0.06 |
| Coupler P-3 | 0.03 |
| Dispersion Oil, Oil-1 | 0.03 |
| Dispersion Oil, Oil-3 | 0.012 |
| Fourth Layer: Second Red-Sensitive Emulsion Layer | |
| Silver Iodobromide Emulsion (silver iodide: 5 mol %, average particle diameter: 0.5 μm) | 0.7 (Ag) |
| Sensitizing Dye IV | $1 \times 10^{-4}$ |
| Sensitizing Dye V | $3 \times 10^{-4}$ |
| Sensitizing Dye VI | $1 \times 10^{-5}$ |
| Coupler (C-1) | 0.24 |
| Coupler (C-4) | 0.24 |
| Coupler P-3 | 0.10 |
| Dispersion Oil, Oil-1 | 0.15 |
| Dispersion Oil, Oil-3 | 0.02 |
| Compound Cpd-B | 0.05 |
| Fifth Layer: Third Red-Sensitive Emulsion Layer | |
| Silver Iodobromide Emulsion (silver iodide: 10 mol %, average particle size: 0.7 μm) | 1.0 (Ag) |
| Gelatin | 1.0 |
| Sensitizing Dye IV | $1 \times 10^{-4}$ |
| Sensitizing Dye V | $3 \times 10^{-4}$ |
| Sensitizing Dye VI | $1 \times 10^{-5}$ |
| Coupler (C-6) | 0.05 |
| Coupler (C-7) | 0.01 |
| Coupler P-3 | 0.05 |
| Dispersion Oil, Oil-1 | 0.01 |
| Dispersion Oil, Oil-2 | 0.05 |
| Compound Cpd-B | 0.02 |
| Sixth Layer: Intermediate Layer | |
| Gelatin | 1.0 |
| Compound Cpd-A | 0.03 |
| Dispersion Oil, Oil-1 | 0.05 |
| Seventh Layer: First Green-Sensitive Emulsion Layer | |
| Silver Iodobromide Emulsion (silver iodide: 4 mol %, average particle diameter: 0.3 μm) | 0.30 (Ag) |
| Sensitizing Dye VII | $5 \times 10^{-4}$ |
| Sensitizing Dye VIII | $0.3 \times 10^{-4}$ |
| Sensitizing Dye IX | $2 \times 10^{-4}$ |
| Gelatin | 1.0 |
| Coupler (C-9) | 0.2 |
| Coupler (C-5) | 0.03 |
| Coupler P-2 | 0.03 |
| Dispersion Oil, Oil-1 | 0.5 |
| Eighth Layer: Second Green-Sensitive Emulsion Layer | |
| Silver Iodobromide Emulsion (silver iodide: 5 mol %, average particle diameter: 0.5 μm) | 0.4 (Ag) |
| Sensitizing Dye VII | $5 \times 10^{-4}$ |
| Sensitizing Dye VIII | $2 \times 10^{-4}$ |
| Sensitizing Dye IX | $0.3 \times 10^{-4}$ |
| Coupler (C-9) | 0.25 |
| Coupler P-2 | 0.03 |
| Coupler P-4 | 0.015 |
| Coupler (C-5) | 0.01 |
| Compound Cpd-B | 0.01 |
| Dispersion Oil, Oil-1 | 0.2 |
| Ninth Layer: Third Green-Sensitive Emulsion Layer | |
| Silver Iodobromide Emulsion (silver iodide: 6 mol %, average particle diameter: 0.7 μm) | 0.85 (Ag) |
| Gelatin | 1.0 |
| Sensitizing Dye X | $3.5 \times 10^{-4}$ |
| Sensitizing Dye XI | $1.4 \times 10^{-4}$ |
| Coupler (C-11) | 0.01 |
| Coupler (C-12) | 0.03 |
| Coupler (C-13) | 0.20 |
| Coupler P-2 | 0.02 |
| Coupler (C-15) | 0.02 |
| Compound Cpd-B | 0.01 |
| Dispersion Oil, Oil-1 | 0.20 |
| Dispersion Oil, Oil-2 | 0.05 |
| Tenth Layer: Yellow Filter Layer | |
| Gelatin | 1.2 |

-continued

| | |
|---|---|
| Yellow Colloidal Silver | 0.08 (Ag) |
| Compound Cpd-C | 0.1 |
| Dispersion Oil, Oil-1 | 0.3 |
| Eleventh Layer: First Blue-Sensitive Emulsion Layer | |
| Monodispersed Silver Iodobromide Emulsion (silver iodide: 4 mol %, average particle diameter: 0.3 μm) | 0.4 (Ag) |
| Gelatin | 1.0 |
| Sensitizing Dye XII | $2 \times 10^{-4}$ |
| Coupler (C-14) | 0.9 |
| Coupler (C-5) | 0.07 |
| Dispersion Oil, Oil-1 | 0.2 |
| Twelfth Layer: Second Blue-Sensitive Emulsion Layer | |
| Silver Iodobromide Emulsion (silver iodide: 10 mol %, average particle diameter: 1.5 μm) | 0.5 (Ag) |
| Gelatin | 0.6 |
| Sensitizing Dye XII | $1 \times 10^{-4}$ |
| Coupler (C-14) | 0.25 |
| Dispersion Oil, Oil-1 | 0.07 |

-continued

| | |
|---|---|
| Thirteenth Layer: First Protective Layer | |
| Gelatin | 0.8 |
| Ultraviolet Absorbent UV-1 | 0.1 |
| Ultraviolet Absorbent UV-2 | 0.2 |
| Dispersion Oil, Oil-1 | 0.01 |
| Dispersion Oil, Oil-2 | 0.01 |
| Fourteenth Layer: Second Protective Layer | |
| Fine Silver Bromide Particles (average particle diameter: 0.07 μm) | 0.5 |
| Gelatin | 0.45 |
| Polymethyl Methacrylate Particles (diameter: 1.5 μm) | 0.2 |
| Hardener H-1 | 0.4 |
| Formaldehyde Scavenger S-1 | 0.5 |
| Formaldehyde Scavenger S-2 | 0.5 |

A surfactant was added to each layer as a coating assistant agent in addition to the above-mentioned components.

The chemical structure or chemical name of each compound as used in this example is given below.

UV-1:

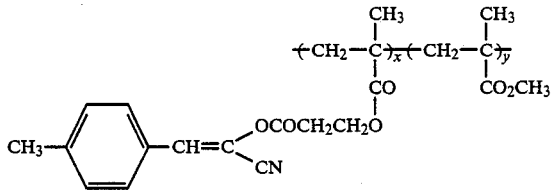

(x/y = 7/3, by weight)

UV-2:

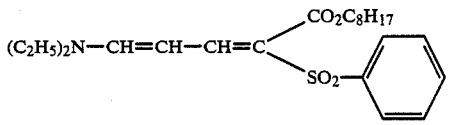

Oil-3:

Bis(2-ethylhexyl) phthalate

P-2:

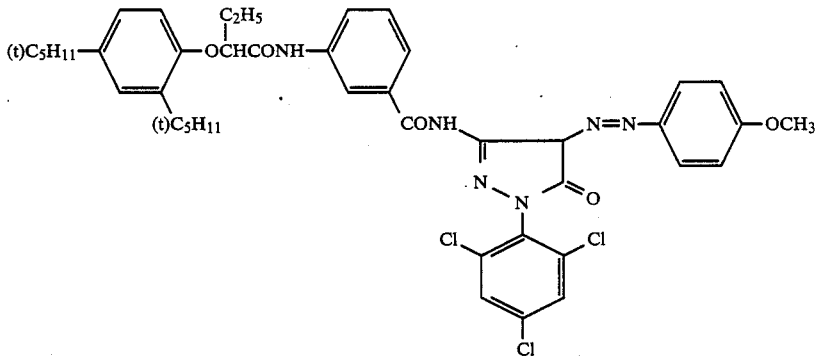

P-3:

-continued
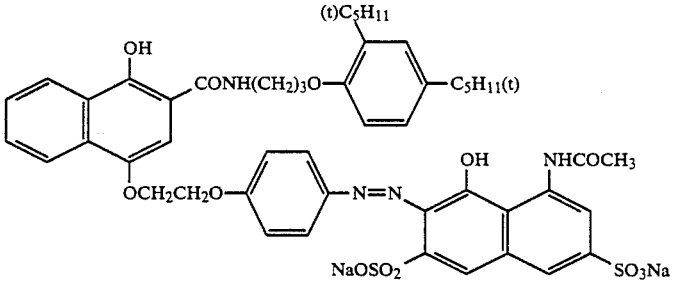
P-4:
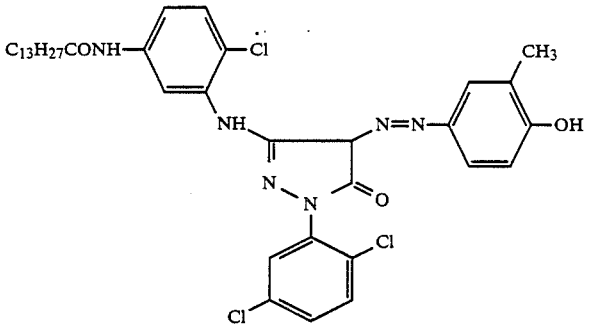
Cpd-A:
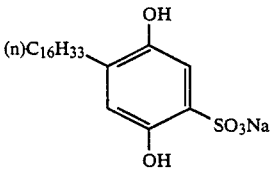
Cpd-B:
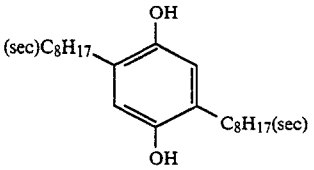
Cpd-C:
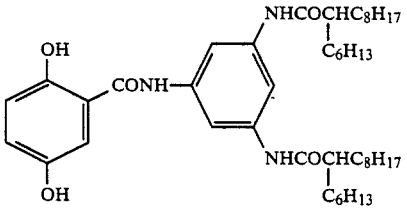
Sensitizing Dye IV:
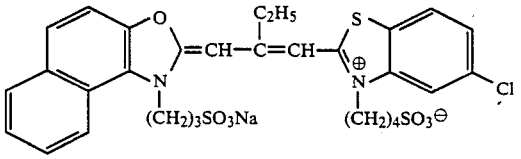

-continued
Sensitizing Dye V:
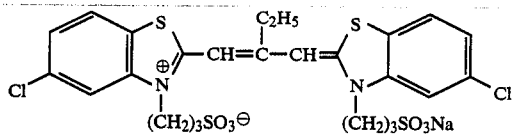
Sensitizing Dye VI:
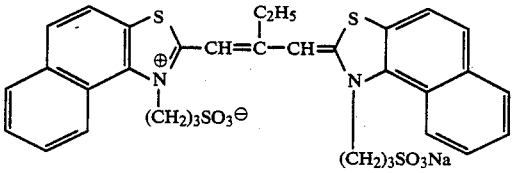
Sensitizing Dye VII:
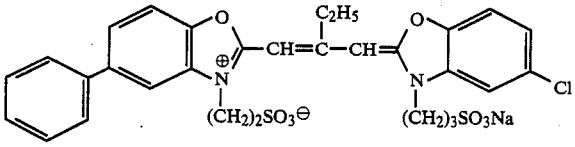
Sensitizing Dye VIII:
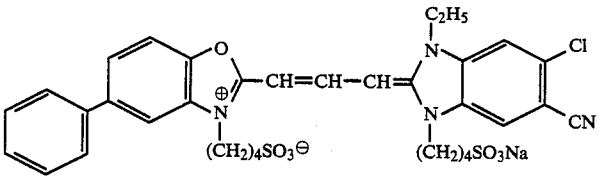
Sensitizing Dye IX:
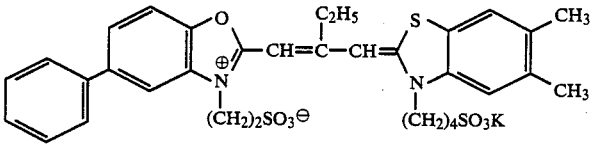
Sensitizing Dye X:
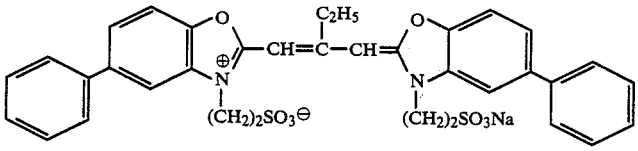
Sensitizing Dye XI:
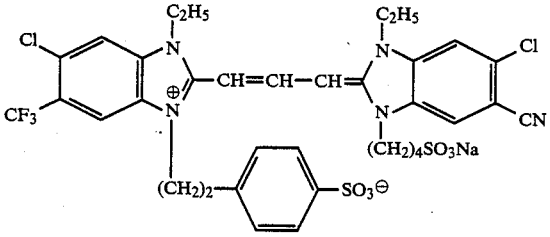
Sensitizing Dye XII:
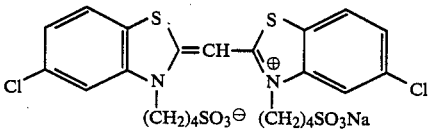

-continued

H-1:

$CH_2{=}CHSO_2CH_2CONH{-}CH_2$
$CH_2{=}CHSO_2CH_2CONH{-}CH_2$

S-1:

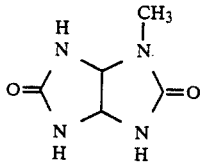

S-2:

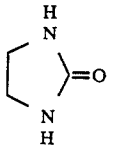

Sample Nos. 302 through 305:

In the manufacture of Sample Nos. 302 through 305, Coupler P-3 as added to the fourth and fifth layers of Sample No. 301 was replaced by an equimolar amount of the compound as shown in Table 4 below. In Sample Nos. 303 to 305 of the present invention, an equimolar amount of Coupler (C-7) was further added, whereby the gradation of all samples was made almost the same.

Sample Nos. 301 through 305 thus manufactured were cut into a size of 35 mm in width and then exposed to a white light and a red light through a step wedge, and thereafter the thus exposed samples were processed by the use of an automatic developing machine in accordance with the procedure shown below.

TABLE 3

| Processing Steps (temperature: 38° C.) | | | |
|---|---|---|---|
| Steps | Treating Time | Tank Capacity (l) | Amount of Replenisher* (ml) |
| Color Development | 3 min 15 sec | 18 | 19 |
| Bleaching | 2 min 00 sec | 18 | 18 |
| Fixation | 3 min 15 sec | 18 | 33 |
| Washing (1) | 1 min 30 sec | 9 | — |
| Washing (2) | 1 min 30 sec | 9 | 25 |
| Stabilization | 1 min 05 sec | 9 | 33 |

*The amount is per 1 m of the photographic material sample of 35 mm in width.

In washing steps (1) and (2) in the above process, a washing water was run from the bath (2) to the bath (1) in a countercurrent water flow system.

Next, the composition of each treating solution is given below.

Color Developer:

The composition of each of the mother solution and the replenisher of the color developer was as follows:

| | Mother Solution | Replenisher |
|---|---|---|
| Diethylenetriaminepentaacetic Acid | 0.8 g | 0.8 g |
| 1-Hydroxyethylidene-1,1-diphosphonic Acid | 3.3 g | 3.3 g |
| Sodium Sulfite | 4.0 g | 4.5 g |
| Potassium Carbonate | 30.0 g | 39.0 g |
| Potassium Bromide | 1.4 g | 0.3 g |
| Potassium Iodide | 1.3 mg | 0 |
| Hydroxylamine Sulfate | 2.4 g | 3.0 g |
| 4-(N—Ethyl-N—β-hydroxyethylamino)-2-methylaniline Sulfate | 4.5 g | 6.4 g |
| Water to make | 1.0 l | 1.0 l |
| pH | 10.0 | 10.15 |

(The regulation of the pH value was made by the use of potassium hydroxide or sulfuric acid.)

| Bleaching Solution | Mother Solution | Replenisher |
|---|---|---|
| Ammonium Ferric Ethylenediamine-tetraacetate | 100 g | 110 g |
| Disodium Ethylenediamine-tetraacetate | 10 g | 11 g |
| Aqueous Ammonia | 3 ml | 2 ml |
| Ammonium Nitrate | 10.0 g | 12.0 g |
| Ammonium Bromide | 150 g | 170 g |
| Water to make | 1 l | 1 l |
| pH | 6.0 | 5.8 |

| Fixation Solution | Mother Soulution | Replenisher |
|---|---|---|
| Disodium Ethylenediamine-tetraacetate | 1.0 g | 1.2 g |
| Sodium Sulfite | 4.0 g | 5.0 g |
| Sodium Bisulfite | 4.6 g | 5.8 g |
| Ammonium Thiosulfate Aqueous Solution (70%) | 175 ml | 200 ml |
| Water to make | 1 l | 1 l |
| pH | 6.6 | 6.6 |

| Stabilizer Solution: | Mother Solution | Replenisher |
|---|---|---|
| Formaldehyde (37% w/v) | 2.0 ml | 3.0 ml |
| Polyoxyethylene-p-monononyl-phenylether (average polymerization degree: 10) | 0.3 g | 0.45 g |
| Water to make | 1 l | 1 l |

The results are given in Table 4 below.

TABLE 4

| Sample No. | Added Amount of Masking Coupler | Sensitivity* | Masking** |
|---|---|---|---|
| 301 (Comparison) | P-2 (control) | −0.10 | 0.12 |
| 302 (Comparison) | B-1 (3 times by mol) | ±0 (control) | 0.03 |
| 303 (Invention) | (4) (3 times by mol) | +0.01 | 0.10 |
| 304 (Invention) | (5) (3 times by mol) | +0.02 | 0.09 |
| 305 (Invention) | (9) (3 times by mol) | +0.02 | 0.10 |

*Sensitivity when exposed with white light.

**This is represented by the difference between the magenta density in the logE value to give the cyan density of 1.0 and that in the cyan-fogged part in the samples as exposed through a red filter.

The results shown in Table 4 indicate the higher masking effect in the samples of the present invention without decrease in sensitivity.

EXAMPLE 4

In order to evaluate the compounds of the present invention and comparative compounds in terms of the effectiveness of the fog inhibitor precursor in the compounds, an emulsion layer to which the fog inhibitor or precursor thereof as shown in Table 5 below had been added, as having been dissolved and emulsified into the coupler solvent together with the coupler, was coated on a cellulose triacetate film support having a subbing layer, to give photographic light-sensitive material, Sample Nos. 401 through 412.

| | |
|---|---|
| (1) Emulsion Layer: | |
| Negative 1.5 μm Silver Iodobromide Emulsion | $1.60 \times 10^{-2}$ mol(Ag)/m$^2$ |
| Magenta Coupler (C-21) | $1.33 \times 10^{-3}$ mol/m$^2$ |
| Fog Inhibitor or Precursor | Shown in Table 5 |
| Gelatin | 2.50 g/m$^2$ |
| (2) Protective Layer | |
| Gelatin | 1.30 g/m$^2$ |

Each of the compounds as used has the following structural formula:

Comparative Compounds:

EX-2

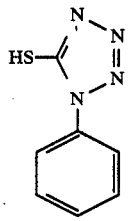

EX-3

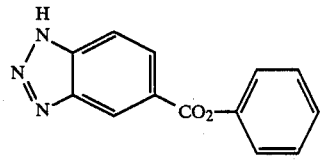

EX-4

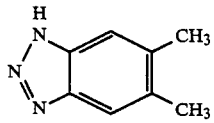

(compound as described in U.S. Pat. No. 4,139,379):

-continued

EX-5

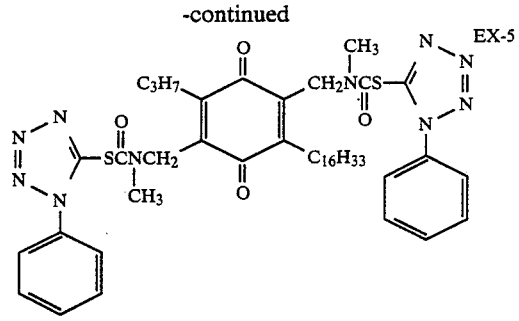

These film samples were imagewise exposed for sensitometry and then subjected to the following color development treatment:

| Steps in Color Development | Time | Temperature |
|---|---|---|
| 1. Color Development | 3 min 15 sec | 38° C. |
| 2. Bleaching | 6 min 30 sec | 38° C. |
| 3. Washing | 2 min | 38° C. |
| 4. Fixation | 4 min | 38° C. |
| 5. Washing | 4 min | 38° C. |
| 6. Stabilization | 1 min | 38° C. |

The composition of each treating solution as used in the above steps was as follows:

| | |
|---|---|
| Color Developer: | |
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 liter |
| | pH 10.1 |
| Bleaching Solution: | |
| Water | 800 ml |
| Ammonium Ferric Ethylenediaminetetra-acetate | 100 g |
| Disodium Ethylenediaminetetraacetate | 10 g |
| Potassium Bromide | 150 g |
| Acetic Acid | 10 g |
| Water to make | 1 liter |
| | pH 6.0 |
| Fixation Solution: | |
| Water | 800 ml |
| Ammonium Thiosulfate | 150 g |
| Sodium Sulfite | 10 g |
| Sodium Hydrogensulfite | 2.5 g |
| Water to make | 1 liter |
| | pH 6.0 |
| Stabilizer Solution: | |
| Water | 800 ml |
| Formaldehyde (37%) | 5 ml |
| Driwel | 3 ml |
| Water to make | 1 liter |

The photographic characteristics of the samples as tested are given in Table 5 below.

TABLE 5

| Sample No. | Antifoggant | Coated Amount (mol/m$^2$) | Fog | Gamma | Relative Sensitivity* | Maximum Color Density |
|---|---|---|---|---|---|---|
| 401 (Comparison) | None | — | 0.13 | 0.67 | 100 | 1.43 |
| 402 (Comparison) | EX-2 | $3 \times 10^{-6}$ | 0.04 | 0.18 | 48 | 0.75 |

TABLE 5-continued

| Sample No. | Antifoggant | Coated Amount (mol/m²) | Fog | Gamma | Relative Sensitivity* | Maximum Color Density |
|---|---|---|---|---|---|---|
| 403 (Comparison) | EX-3 | $2 \times 10^{-4}$ | 0.06 | 0.30 | 58 | 0.81 |
| 404 (Comparison) | EX-4 | $4 \times 10^{-5}$ | 0.05 | 0.22 | 48 | 0.78 |
| 405 (Comparison) | EX-5 | $2 \times 10^{-4}$ | 0.10 | 0.65 | 100 | 1.42 |
| 406 (Invention) | (1) | $3 \times 10^{-6}$ | 0.06 | 0.63 | 99 | 1.40 |
| 407 (Invention) | (6) | $2 \times 10^{-4}$ | 0.06 | 0.66 | 100 | 1.42 |
| 408 (Invention) | (23) | $4 \times 10^{-5}$ | 0.06 | 0.65 | 100 | 1.41 |
| 409 (Invention) | (14) | $1 \times 10^{-6}$ | 0.06 | 0.66 | 100 | 1.40 |
| 410 (Invention) | (15) | $5 \times 10^{-5}$ | 0.06 | 0.65 | 98 | 1.39 |
| 411 (Invention) | (25) | $1 \times 10^{-4}$ | 0.07 | 0.66 | 100 | 1.40 |
| 412 (Invention) | (12) | $5 \times 10^{-5}$ | 0.06 | 0.65 | 99 | 1.40 |

(Note)
*This is represented by the reciprocal of the exposure for attaining the color density of (fog + 0.2) on the basis of the control value of 100 in the case of Sample No. 401 containing no antifoggant.

The results shown in Table 5 indicate that both the sensitivity and the color density deteriorated in the comparative samples containing the antifoggant itself while the fog decreased; whereas in the samples of the present invention containing the fog inhibitor precursor, the fog decreased without much deterioration of the sensitivity or of the color density. Further, it is noted therefrom that the known compound EX-5 was alsmot functionless.

EXAMPLE 5

Sample No. 501:

In the manufacture of Sample No. 301 in Example 3, Coupler P-2 in the seventh, eighth and ninth layers was replaced by a twice molar amount of P-5 to give Sample No. 501.

Sample Nos. 502 to 507:

Compound P-5 as added to Sample No. 501 was replaced by an equimolar amount of Compound (19), (27), (35), or (36) of the present invention to give Sample Nos. 502 through 507, respectively. Compound (a) was further added in an amount of 1.5 times the amount of the compound of the present invention to Sample Nos. 506 and 507.

TABLE 6

| Sample No. | Masking Compound | Additive | Sensitivity* | Masking** |
|---|---|---|---|---|
| 301 (Comparison) | P-1 | — | ±0 (control) | 0.08 |
| 501 (Comparison) | P-3 | — | +0.02 | 0.05 |
| 502 (Invention) | (19) | — | +0.03 | 0.10 |
| 503 (Invention) | (27) | — | +0.04 | 0.11 |
| 504 (Invention) | (35) | — | +0.05 | 0.09 |
| 505 (Invention) | (36) | — | +0.04 | 0.10 |
| 506 (Invention) | (19) | (a) | +0.04 | 0.15 |
| 507 (Invention) | (35) | (a) | +0.05 | 0.17 |

*Sensitivity by exposure with white light.
**This is represented by the difference between the yellow density in the logE value to give the magenta density of 1.5 and that in the magenta-fogged part in the samples as exposed through green filter.

Table 6 indicates the higher masking effect in the samples of the present invention without the decrease in sensitivity.

EXAMPLE 6

Sample Nos. 301 through 305 in Example 3 and Sample Nos. 501 through 505 in Example 5 were exposed in the same manner as in these Examples, respectively, and P-5 (coupler as described in U.S. Pat. No. 4,427,763):

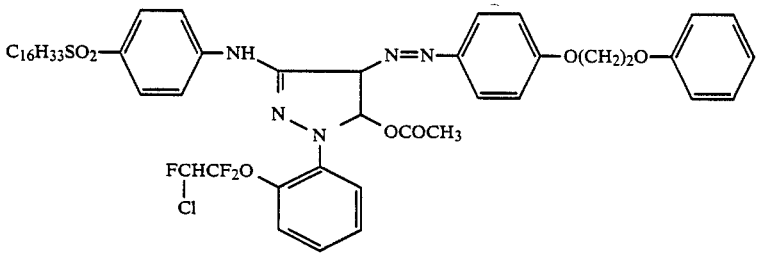

Compound (a):

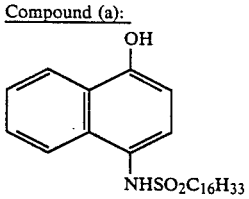

These samples were subjected to wedge exposure with a white light through a green filter and then to the same development treatment as in Example 3. The results are given in Table 6 below.

then subjected to the following development treatment (A) or (B).

| Development Treatment (A): | Time | Temperature |
|---|---|---|
| Color Development | 3 min 15 sec | 38° C. |

-continued

| Development Treatment (A): | Time | Temperature |
|---|---|---|
| Bleaching | 30 sec | 38° C. |
| Bleaching-Fixation | 1 min 30 sec | 38° C. |
| Rinsing | 1 min 40 sec | 38° C. |
| Stabilization | 40 sec | 38° C. |

The composition of each treating solution as used in each of the steps was as follows:

Color Developer:

Same as that used in Example 1.

| | |
|---|---|
| Bleaching Solution: | |
| Ammonium Bromide | 100 g |
| Ammonium Ferric Ethylenediaminetetra-acetate | 120 g |
| Disodium Ethylenediaminetetraacetate | 10.0 g |
| Ammonium Nitrate | 10.0 g |
| Bleaching Accelerator | 2.0 g |

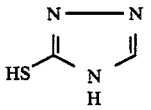

| | |
|---|---|
| Aqueous Ammonia | 17.0 ml |
| Water to make | 1 liter |
| pH | 6.5 |
| Bleaching-Fixation Solution: | |
| Ammonium Bromide | 50.0 g |
| Ammonium Ferric Ethylenediaminetetra-acetate | 50.0 g |
| Disodium Ethylenediaminetetraacetate | 5.0 g |
| Ammonium Nitrate | 5.0 g |
| Sodium Sulfite | 12.0 g |
| Ammonium Thiosulfate Aqueous Solution (70%) | 240 ml |
| Aqueous Ammonia | 10.0 ml |
| Water to make | 1 liter |
| pH | 7.3 |
| Rinsing Solution, Stabilizer Solution: | |
| Same as those used in Example 2. | |

| Development Treatment (B): | Time | Temperature |
|---|---|---|
| Color Development | 3 min 15 sec | 38° C. |
| Bleaching-Fixation | 2 min 00 sec | " |
| Rinsing | 1 min 40 sec | " |
| Stabilization | 40 sec | " |

In the above steps, the color developer used was the same as that in Example 1, the bleaching-fixation solution and the rinsing solution as used were the same as those in Example 2.

| Stabilizer: | |
|---|---|
| Ethylenediaminetetraacetic Acid | 0.35 g |
| 5-Chloro-2-methyl-4-isothiazolin-3-one | 0.1 g |
| Polyoxyethylene-p-monononylphenylether (average polymerization degree: 10) | 0.3 g |
| Water to make | 1 liter |

The samples of the present invention indicated a higher masking effect without much decrease in sensitivity in both treatment (A) and treatment (B), as compared with the other comparative samples in these Examples.

EXAMPLE 7

Sample No. 601 was prepared by providing the layers having the following construction on a subcoated cellulose triacetate film base. The composition of each layer was as follows:

Regarding the coated amount, the amount of the coated silver (unit: $g/m^2$) is shown in the silver halide and colloidal silver, and the amount of each of the couplers, additives and gelatin themselves is designated by the unit of $g/m^2$, individually, and the amount of the sensitizing dye is desingated by the number of mols per mol of the silver halide in the same layer containing the sensitizing dye.

| | |
|---|---|
| First Layer: Antihalation Layer | |
| Black Colloidal Silver | 0.2 |
| Gelatin | 1.3 |
| ExM-9 | 0.06 |
| Ultraviolet Absorbent UV-1 | 0.03 |
| Ultraviolet Absorbent UV-2 | 0.06 |
| Ultraviolet Absorbent UV-3 | 0.06 |
| Solv-1 | 0.15 |
| Solv-2 | 0.15 |
| Solv-3 | 0.05 |
| Second Layer: Intermediate Layer | |
| Gelatin | 1.0 |
| Ultraviolet Absorbent UV-1 | 0.03 |
| ExC-4 | 0.02 |
| ExF-1 | 0.004 |
| Solv-1 | 0.1 |
| Solv-2 | 0.1 |
| Third Layer: Low Sensitivity Red-Sensitive Emulsion Layer | |
| Silver Iodobromide Emulsion (AgI: 4 mol % dispersed uniformly, sphere equivalent diameter: 0.5 μm, variation coefficient of sphere equivalent diameter: 20% tabular particles, diameter/thickness: 3.0/1) | 1.2 (Ag) |
| Silver Iodobromide Emulsion (AgI: 3 mol % dispersed uniformly, sphere equivalent diameter 0.3 μm, variation coefficient of sphere equivalent diameter: 15%, spherical particles, diameter/thickness: 1.0/1) | 0.6 (Ag) |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Fourth Layer: High Sensitivity Red-Sensitive Emulsion Layer | |
| Silver Iodobromide Emulsion (AgI: 6 mol %, core shell ratio: 1/1, inner high AgI content, sphere equivalent diameter: 0.7 μm, variation coefficient of sphere equivalent diameter 15%, tabular particles, diameter/thickness: 5.0/1) | 1.2 (Ag) |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Intermediate Layer | |
| Gelatin | 0.5 |
| Cpd-1 | 0.1 |
| Solv-1 | 0.05 |
| Sixth Layer: Low Sensitivity Green-Sensitive Emulsion Layer | |
| Silver Iodobromide Emulsion (AgI: 4 mol %, core-shell ratio: 1:1, surface high AgI content, sphere equivalent diameter: 0.5 μm, variation coefficient of sphere equivalent diameter 15%, tabular particles, diameter/thickness: 4.0/1) | 0.35 (Ag) |
| Silver Iodobromide Emulsion (AgI: 3 mol % dispersed uniformly, sphere equivalent diameter: 0.3 μm, variation coefficient of sphere | 0.20 (Ag) |

-continued

| | |
|---|---|
| equivalent diameter 25%, spherical particles, diameter/thickness: 1.0/1) | |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: High Sensitivity Green-Sensitive Emulsion Layer | |
| Silver Iodobromide Emulsion (AgI: 4 mol %, core-shell ratio: 1/3, inner high AgI content, sphere equivalent diameter: 0.7 μm, variation coefficient of sphere equivalent diameter: 20%, tabular particles, diameter/thickness: 5.0/1) | 1.3 (Ag) |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Intermediate Layer | |
| Gelatin | 0.5 |
| Cpd-1 | 0.05 |
| Solv-1 | 0.02 |
| Ninth Layer: Donor Layer of Interlayer Effect for Red-Sensitive Layer | |
| Silver Iodobromide Emulsion (AgI: 2 mol %, core-shell ratio 2/1, inner high AgI content, sphere equivalent diameter: 1.0 μm, variation coefficient of sphere equivalent diameter 15%, tabular particles, diameter/thickness: 6.0/1) | 0.35 (Ag) |
| Silver Iodobromide Emulsion (AgI: 2 mol %, core-shell ratio: 1/1, inner high AgI content, sphere equivalent diameter: 0.4 μm, variation coefficient of sphere equivalent diameter: 20%, tabular particles, diameter/thickness: 6.0/1) | 0.20 (Ag) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow Colloidal Silver | 0.05 (Ag) |
| Gelatin | 0.5 |
| Cpd-2 | 0.13 |
| Cpd-1 | 0.10 |
| Eleventh Layer: Low Sensitivity Blue-Sensitive Emulsion Layer | |

-continued

| | |
|---|---|
| Silver Iodobromide Emulsion (AgI: 4.5 mol % dispersed uniformly, sphere equivalent diameter 0.7 μm, variation coefficient of sphere equivalent diameter: 15%, tabular particles, diameter/thickness: 7.0/1) | 0.3 (Ag) |
| Silver Iodobromide Emulsion (AgI: 3 mol % dispersed uniformly, sphere equivalent diameter: 0.3 μm, variation coefficient of sphere equivalent diameter: 25%, tabular particles, diameter/thickness: 7.0/1) | 0.15 (Ag) |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExC-17 | 1.0 |
| Solv-1 | 0.20 |
| Twelfth Layer: High Sensitivity Blue-Sensitive Emulsion Layer | |
| Silver Iodobromide Emulsion (AgI: 10 mol %, inner high AgI content, sphere equivalent diameter 1.0 μm, variation coefficient of sphere equivalent diameter: 25%, multi-twinned crystal tabular particles, diameter/thickness: 2.0/1) | 0.5 (Ag) |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| Ultraviolet Absorbent UV-4 | 0.1 |
| Ultraviolet Absorbent UV-5 | 0.15 |
| Solv-1 | 0.01 |
| Solv-2 | 0.01 |
| Fourteenth Layer: Second Protective Layer | |
| Fine Silver Iodobromide Emulsion (AgI: 2 mol % dispersed uniformly sphere equivalent diameter: 0.07 μm) | 0.5 (Ag) |
| Gelatin | 0.45 |
| Polymethylmethacrylate Particles (diameter: 1.5 μm) | 0.2 |
| Hardener H-1 | 0.4 |
| Cpd-3 | 0.5 |
| Cpd-4 | 0.5 |

In addition to the above components, an emulsion stabilizer Cpd-3 (0.04 g/m$^2$) and a surfactant Cpd-4 (0.02 g/m$^2$) were added to each layer. Furthermore, Compounds Cpd-5 (0.5 g/m$^2$) and Cpd-6 (0.5 g/m$^2$) were also added to each layer.

The chemical structure of each compound used herein is given below.

UV-1:

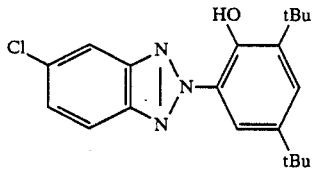

UV-2:

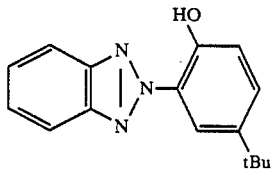

-continued
UV-3:
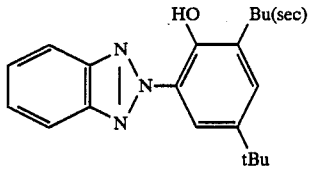
UV-4:
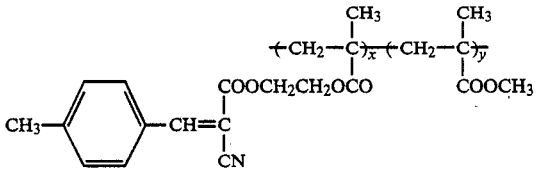
x/y = 7/3 (by weight)
UV-5:
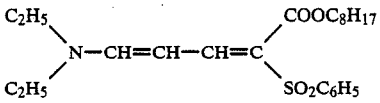
Solv-1: Tricresyl phosphate
Solv-2: Dibutyl phthalate
Solv-3:
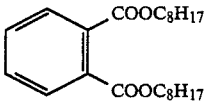
Solv-4:
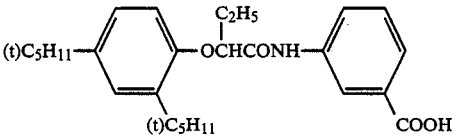
Cpd-1:
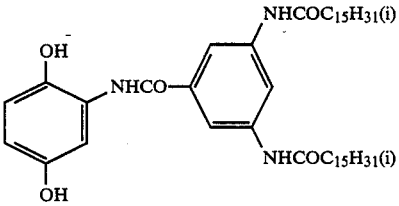
Cpd-2:
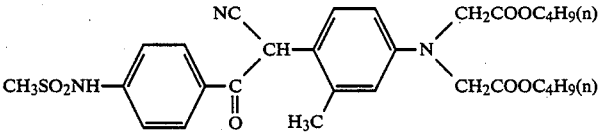
Cpd-3:
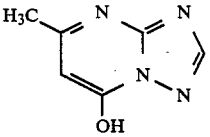
Cpd-4:
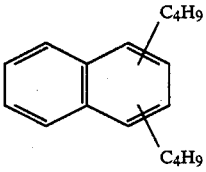

-continued
Cpd-5:
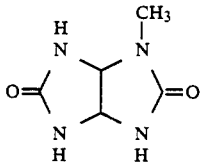
Cpd-6:
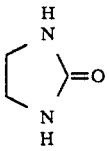
ExC-1:
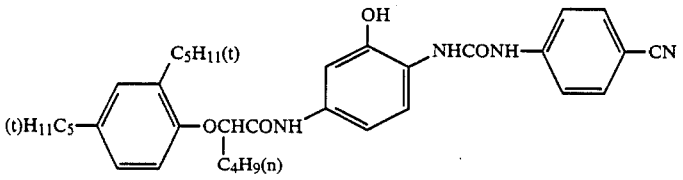
ExC-2:
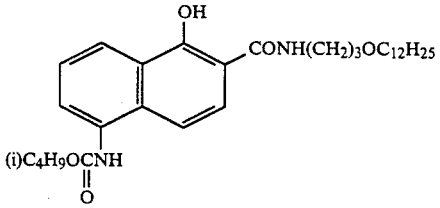
ExC-3:
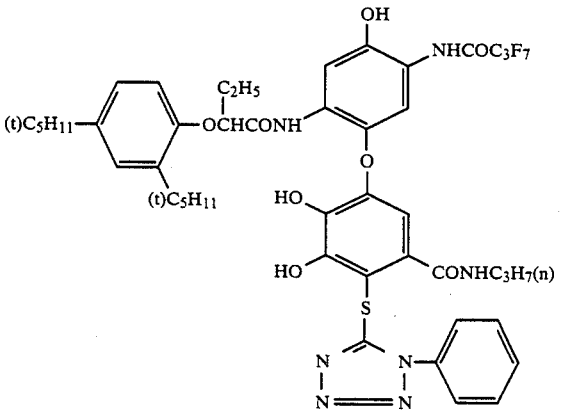
ExC-4:
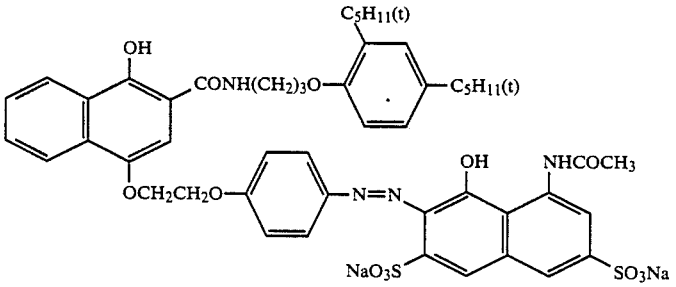

-continued
ExC-5:
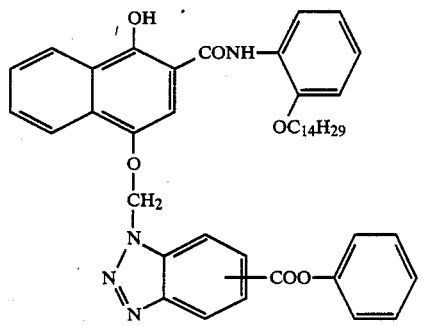
ExC-6:
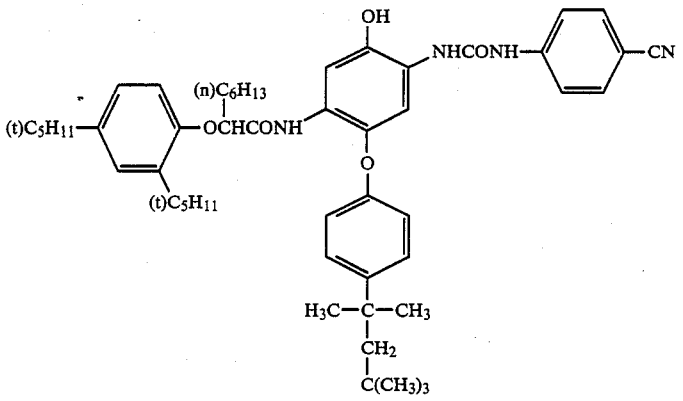
ExC-7:
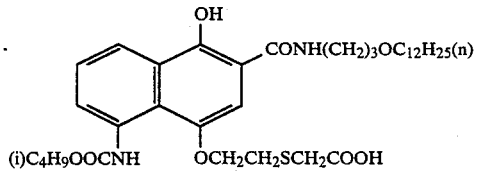
ExM-8:
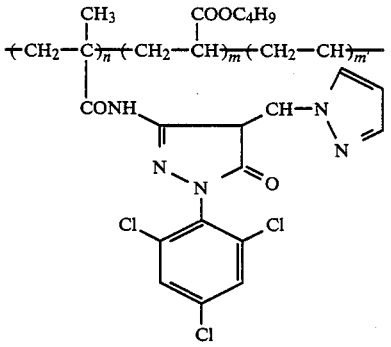
n = 50, m = 25, m' = 25,
molecular weight: about 20,000

-continued
ExM-9:
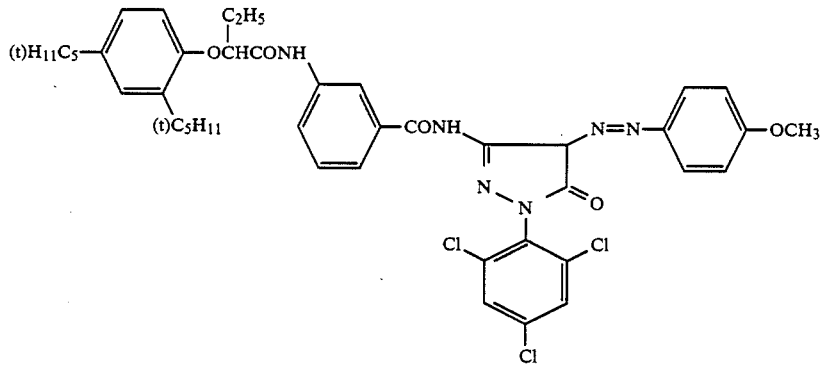
ExM-10:
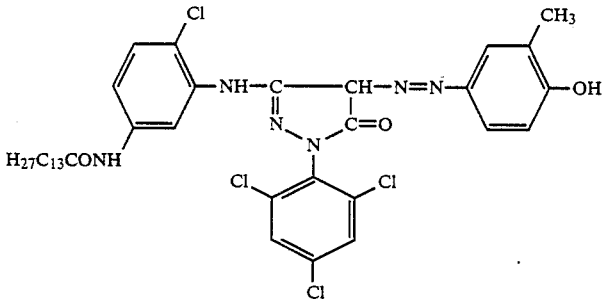
ExY-11:
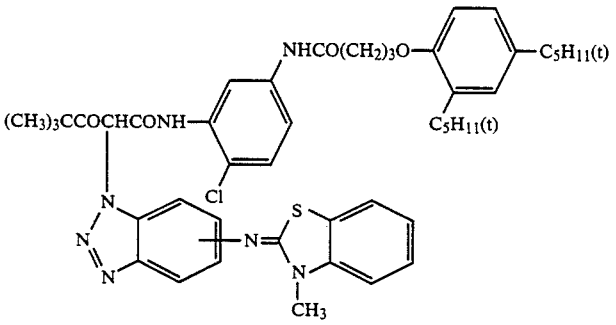
ExM-12:
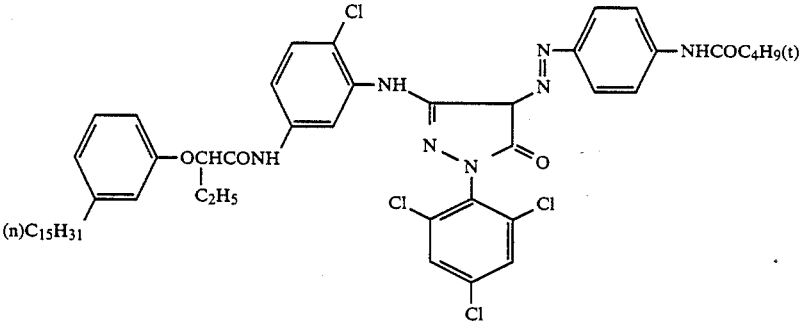
ExY-13:
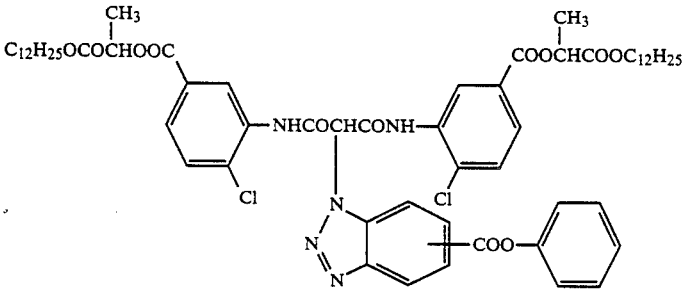

-continued
ExM-14:
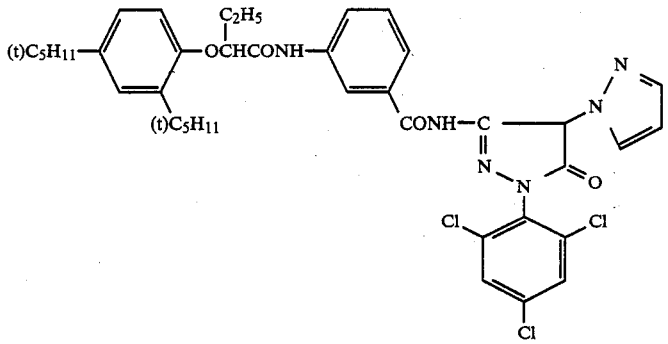
ExY-15:
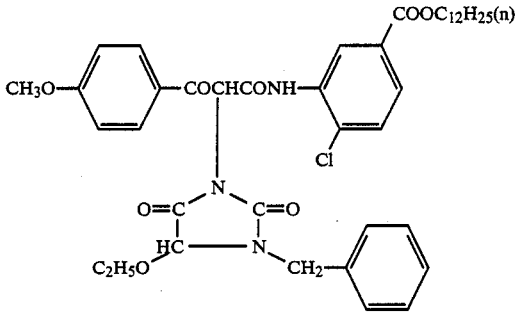
ExC-16:
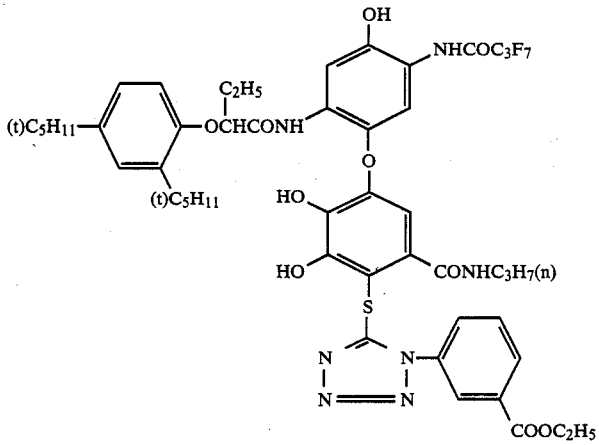
ExY-17:
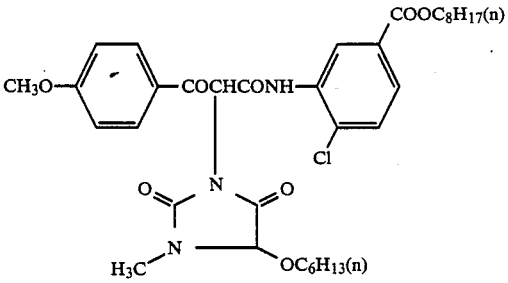
ExS-1:
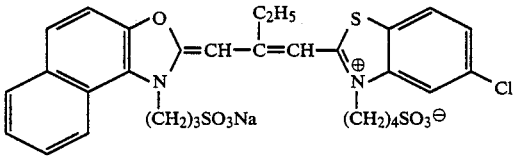

-continued

ExS-2:

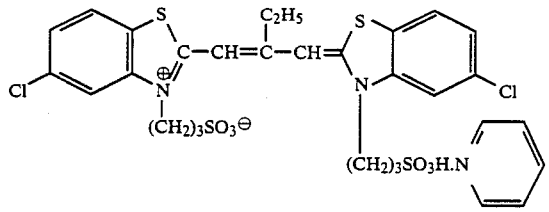

ExS-3:

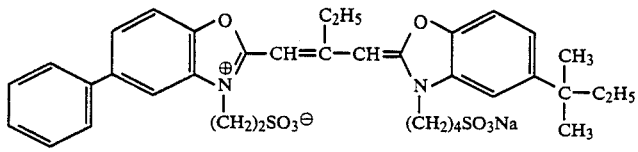

ExS-4:

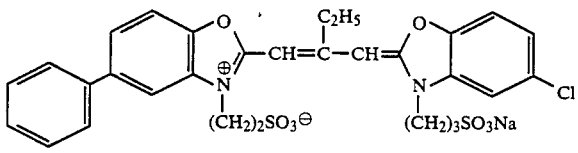

ExS-5:

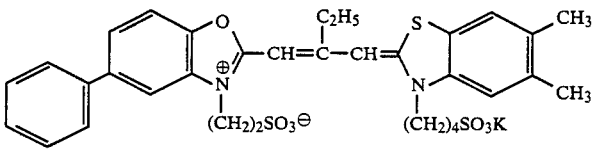

ExS-6:

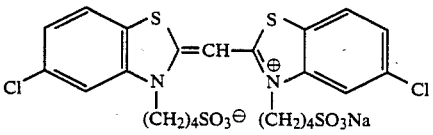

H-1:

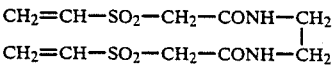

ExF-1:

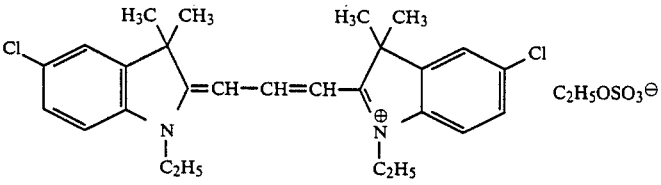

Sample Nos. 602 through 608 were prepared in the same manner as in the preparation of Sample No. 301 excwpt that Comparative Compounds EX-2 to EX-5 and the compounds of the present invention were added to the seventh layer according to Table 7 below.

Comparative Compounds EX-2 to EX-4 were first dissolved in methanol to make a 1% solution, and Comparative Compound EX-5 and the compounds of the present invention were first dissolved in the dispersion oil and ethyl acetate as an auxiliary solvent, and thereafter they were emulsified by a homogenizer, then added to the emulsion layer.

The thus-obtained Sample Nos. 601 to 608 were imagewise exposed to a white light for sensitometry, and then subjected to the following color development treatment.

| Steps in Color Development | Time | | Temperature (°C.) |
|---|---|---|---|
| Color Development | 2 min | 30 sec | 40 |
| Bleaching-Fixation | 3 min | 00 sec | 40 |
| Washing (1) | | 20 sec | 35 |
| Washing (2) | | 20 sec | 35 |
| Stabilization | | 20 sec | 35 |
| Drying | | 50 sec | 65 |

The composition of each treating solution used herein was as follows:

| Color Developer: | |
|---|---|
| Diethylenetriaminetetraacetic Acid | 2.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |

-continued

| | | |
|---|---|---|
| Potassium Iodide | 1.5 | mg |
| Hydroxylamine Sulfate | 2.4 | g |
| 4-[N—Ethyl-N—(β-hydroxyethyl)amino]-2-methylaniline Sulfate | 4.5 | g |
| Water to make | 1 | liter |
| pH | 10.05 | |
| Bleaching-Fixation Solution: | | |
| Ammonium Ferric Ethylenediaminetetraacetate Dihydrate | 50.0 | g |
| Disodium Etylenediaminetetraacetate | 5.0 | g |
| Sodium Sulfite | 12.0 | g |
| Ammonium Thiosulfate Aqueous Solution (70%) | 260.0 | ml |
| Acetic Acid (98%) | 5.0 | ml |
| Bleaching Accelerator | 0.01 | mol |

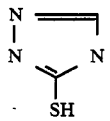

| | | |
|---|---|---|
| Water to make | 1.0 | liter |
| pH | 6.0 | |

Washing Water:

City water was passed through a mixed bed column filled with an H-type strongly acidic cation exchange resin (Umberlite IR-120B, made by Rhom & Haas Co., Ltd.) and OH-type anion exchange resin (Umberlite IR-400) to reduce the concentrations of calcium ion and magnesium ion to 3 mg/liter or less, respectively. Then, 20 mg/liter of sodium dichloroisocyanurate and 1.5 g/liter of sodium sulfate were added thereto, thus the washing water having a pH of from 6.5 to 7.5 was obtained.

| Stabilizing Solution: | | |
|---|---|---|
| Formaldehyde (37%) | 2.0 | ml |
| Polyoxyethylene-p-monononylphenyl Ether (average polymerization degree: 10) | 0.3 | g |
| Disodium Ethylenediaminetetraacetate | 0.05 | g |
| Water to make | 1 | liter |
| | pH 5.0–8.0 | |

Furthermore, while the color developing time was prolonged to 3 min 15 sec, the same processing was repeated.

After the processing, the magenta density was measured by a self-resistering densitometer to obtain a fog density, a gamma value, and a sensitivity. The results obtained are shown in Table 6 below.

TABLE 6

| Sample No. | Antifoggant | Coated Amount (mol/m²) | Developing Time: 2 Min and 30 Sec Fog | Gamma | Relative Sensitivity* | Developing Time: 3 Min and 15 Sec Fog | Gamma | Relative Sensitivity* |
|---|---|---|---|---|---|---|---|---|
| 601 | None | — | 0.10 | 0.55 | 100 | 0.16 | 0.64 | 115 |
| 602 | EX-2 | $3 \times 10^{-6}$ | 0.03 | 0.32 | 45 | 0.05 | 0.49 | 62 |
| 603 | EX-3 | $2 \times 10^{-4}$ | 0.05 | 0.36 | 48 | 0.07 | 0.53 | 65 |
| 604 | EX-4 | $4 \times 10^{-5}$ | 0.07 | 0.48 | 59 | 0.09 | 0.58 | 72 |
| 605 | EX-5 | $2 \times 10^{-4}$ | 0.05 | 0.40 | 50 | 0.08 | 0.55 | 68 |
| 606 | (1) | $3 \times 10^{-6}$ | 0.05 | 0.50 | 89 | 0.08 | 0.60 | 108 |
| 607 | (6) | $1 \times 10^{-4}$ | 0.06 | 0.51 | 92 | 0.08 | 0.61 | 110 |
| 608 | (25) | $3 \times 10^{-5}$ | 0.06 | 0.52 | 94 | 0.09 | 0.61 | 110 |

*Reciprocal of the amount of exposed light providing a fog of +0.02 on the basis of the control value of 100 in the case of Sample No. 601 (developing time: 2 min 30 sec).

Sample Nos. 601 to 605 are the comparative samples, and Sample Nos. 606 to 608 are the samples of the present invention.

The results shown in Table 6 indicate the similar results as in Example 4, i.e., in the samples of the present invention, the fog inhibiting effect is remarkable without much deterioration of the sensitivity and the gamma value.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising (1) at least one coupler and (2) at least one compound represented by formula (I)

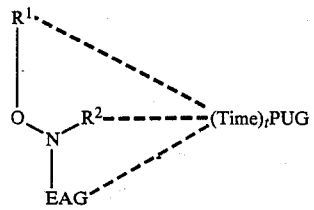

(I)

wherein EAG represents a group capable of accepting an electron from a reducing substance; $R^1$ and $R^2$ each represents a chemical bond or a divalent substituent, or $R^1$ and $R^2$ each represents a substituent other than a hydrogen atom, and when $R^1$ or $R^2$ is bonded to $\text{-(Time)}_t\text{PUG}$, $R^1$ or $R^2$ is a single bond or a divalent substituent, and $R^1$ and $R^2$ may be bonded to each other to form a cyclic structure; Time represents a group capable of releasing PUG which is released by the cleavage of a single bond between the oxygen atom and the nitrogen atom in the compound; t represents 0 or 1; PUG represents a dye moiety which masks to correct subabsorption of a dye formed from said coupler, wherein said dye moiety is temporarily shifted to a short wavelength; the dotted lines mean that at least one of them forms a chemical bond and wherein the release of PUG is triggered by the cleavage of the N—O single bond which occurs when EAG accepts an electron, and wherein the shifted dye moiety is non-diffusible and after being temporarily shifted to a shorter wavelength is shifted to a longer wavelength after release.

2. A silver halide color photographic material as in claim 1, wherein said compound is represented by formula (II)

(II)

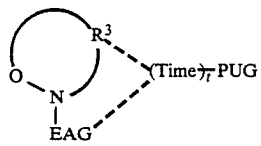

wherein $R^3$ represents an atomic group which is required for forming a 3-membered to 8-membered single or condensed heterocyclic ring, which is linked with the nitrogen atom and the oxygen atom in the compound; EAG represents a group capable of accepting an electron from a reducing substance; Time represents a group capable of releasing PUG, which is released by the cleavage of the single bond between the oxygen atom and the nitrogen atom in the compound; t represents 0 or 1; PUG represents a photographically useful group; and the dotted lines mean that at least one of them forms a chemical bond.

3. A silver halide color photographic material as in claim 1, wherein said compound represented by formula (I) is selected from compounds represented by formula (III):

(III)

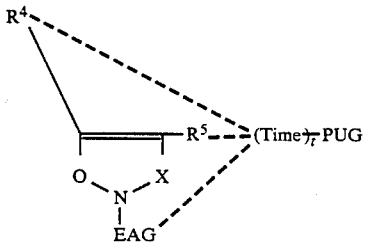

wherein $R^4$ and $R^5$ each represents a chemical bond, a hydrogen atom, or a divalent substituent, or $R^4$ and $R^5$ each represents a substituent other than a hydrogen atom, and when $R^4$ or $R^5$ is bonded to $\text{-(Time)}_t\text{-PUG}$, $R^4$ or $R^5$ is a single bond or a divalent substituent, and $R^1$ and $R^2$ may be bonded to each other to form a cyclic structure; X represents a divalent linking group; EAG represents a group capable of accepting an electron from a reducing substance; Time represents a group capable of releasing PUG, which is released by the cleavage of the single bond between the oxygen atom and the nitrogen atom in the compound; t represents 0 or 1; PUG represents a dye moiety which masks to correct subabsorption of a dye formed from said coupler, wherein said dye moiety is temporarily shifted to a short wavelength; and the dotted lines mean that at least one of them forms a chemical bond and wherein the release of PUG is triggered by the cleavage of the N—O single bond which occurs when EAG accepts an electron.

4. A silver halide color photographic material as in claim 1, wherein said coupler is at least one of a yellow coupler, a magenta coupler, and a cyan coupler.

5. A silver halide color photographic material as in claim 1 comprising a combination of a magenta coupler and a compound represented by formula (I) having PUG representing a yellow dye moiety which is temporarily shifted to short wavelength.

6. A silver halide color photographic material as in claim 1 comprising a combination of a cyan coupler and a compound represented by formula (I) having PUG representing a magenta dye moiety which is temporarily shifted to short wavelength.

7. A silver halide color photographic material as in claim 1, wherein said compound represented by formula (I) is added in an amount of from $1\times10^{-7}$ to $1\times10^{-1}$ mol/m$^2$.

8. A silver halide color photographic material as in claim 7, wherein said compound represented by formula (I) is added in an amount of from $1\times10^{-6}$ to $1\times10^{-3}$ mol/m$^2$.

9. A silver halide color photographic material as in claim 1, wherein said coupler is employed in an amount of from $1\times10^{-7}$ to $1\times10^{-1}$ mol/m$^2$.

10. A silver halide color photographic material as in claim 9, wherein said coupler is employed in an amount of from $1\times10^{-6}$ to $1\times10^{-3}$ mol/m$^2$.

11. A silver halide color photographic material as in claim 1, wherein said material further comprises a reducing substance represented by formula (C):

$$Q_1\text{—}V_n\text{—}Q_2 \qquad \text{(C)}$$

wherein $Q_1$ and $Q_2$ each represents —O-Sub,

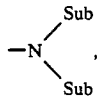

or —S-Sub; Sub represents a chemical bond ($\pi$-bond) or a substituent; n represents an integer of from 0 to 8; $V_1$ represents $\text{-}(\alpha_1\text{—}\beta_1)\text{-}$; $V_2$ represents $\text{-}(\alpha_1\text{—}\beta_1)(\alpha_2\text{—}\beta_2)\text{-}$; $V_3$ represents $\text{-}(\alpha_1\text{—}\beta_1)(\alpha_2\text{—}\beta_2)(\alpha_3\text{—}\beta_3)\text{-}$; $V_4$ represents $\text{-}(\alpha_1\text{—}\beta_1)(\alpha_2\text{—}\beta_2)(\alpha_3\text{—}\beta_3)(\alpha_4\text{—}\beta_4)\text{-}$; $V_5$ represents $\text{-}(\alpha_1\text{—}\beta_1)(\alpha_2\text{—}\beta_2)(\alpha_3\text{—}\beta_3)(\alpha_4\text{—}\beta_4)(\alpha_5\text{—}\beta_5)\text{-}$; $V_6$ represents $(\alpha_1\text{—}\beta_1)(\alpha_2\text{—}\beta_2)(\alpha_3\text{—}\beta_3)(\alpha_4\text{—}\beta_4)(\alpha_5\text{—}\beta_5)(\alpha_6\text{—}\beta_6)$; $V_7$ represents $(\alpha_1\text{—}\beta_1)(\alpha_2\text{—}\beta_2)(\alpha_3\text{—}\beta_3)(\alpha_4\text{—}\beta_4)(\alpha_5\text{—}\beta_5)(\alpha_6\text{—}\beta_6)(\alpha_7\text{—}\beta_7)$; and $V_8$ represents $(\alpha_1\text{—}\beta_1)(\alpha_2\text{—}\beta_2)(\alpha_3\text{—}\beta_3)(\alpha_4\text{—}\beta_4)(\alpha_5\text{—}\beta_5)(\alpha_6\text{—}\beta_6)(\alpha_7\text{—}\beta_7)(\alpha_8\text{—}\beta_8)$; wherein $\alpha_1$ through $\alpha_8$ and $\beta_1$ through $\beta_8$ each represents

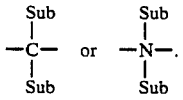

12. A silver halide color photographic material as in claim 11, wherein said reducing substance is selected from compounds represented by formulae (C-1) to (C-13):

(C-1)

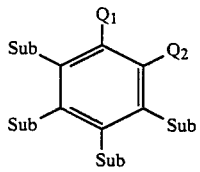

(C-2)

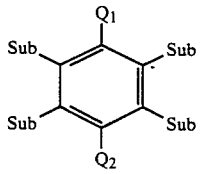

-continued (C-3)

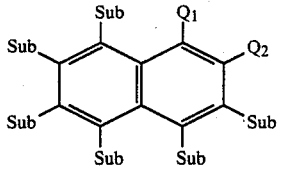

(C-4)

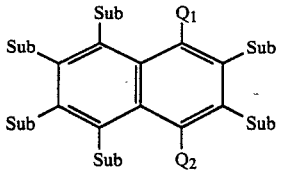

(C-5)

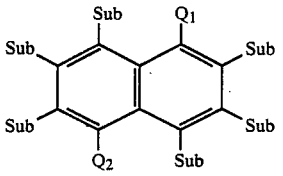

(C-6)

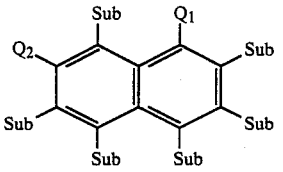

(C-7)

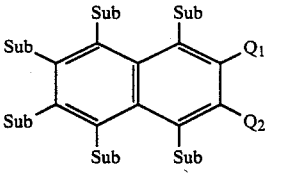

(C-8)

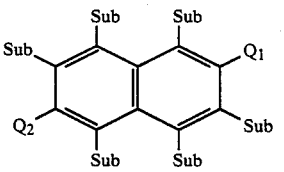

(C-9)

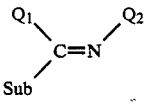

(C-10)

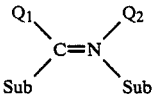

(C-11)

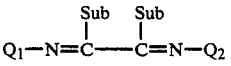

(C-12)

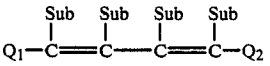

(C-13)

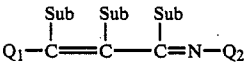

wherein $Q_1$, $Q_2$, and Sub each has the same meaning for formula (C) in claim 11.

13. A method for forming an image comprising imagewise exposing to light and then processing a silver halide color photographic material with a developing solution containing a paraphenylenediamine as a developing agent, said material comprising a color coupler and (1) at least one compound represented by formula (I)

(I)

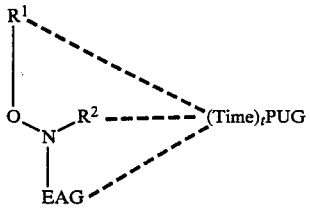

wherein EAG represents a group capable of accepting an electron from a reducing substance; $R^1$ and $R^2$ each represents a substituent other than a hydrogen atom, and when $R^1$ and $R^2$ is bonded to —(Time)$_t$—PUG, $R^1$ or $R^2$ is a single bond or divalent substituent, and $R^1$ and $R^2$ may be bonded to each other to form a cyclic structure; Time represents a group capable of releasing PUG, which is released by the cleavage of the single bond between the oxygen atom and the nitrogen atom in the compound; t represents 0 or 1; PUG represents a dye moiety which masks to correct subabsorption of a dye formed from said coupler, wherein said dye moiety is temporarily shifted to a short wavelength; the dotted lines mean that at least one of them forms a chemical bond, wherein the release of PUG is triggered by the cleavage of the N—O single bond which occurs when EAG accepts an electron, and wherein the shifted dye moiety is non-diffusible and after being temporarily shifted to a shorter wavelength is shifted to a longer wavelength after release.

14. A method for forming an image as in claim 13, wherein said material further comprises a reducing agent immobilized by the introduction of a ballast group, said reducing agent is selected from compounds represented by formulae (C-1) to (C-13)

(C-1)

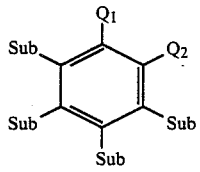

(C-2)

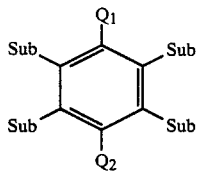

(C-3)

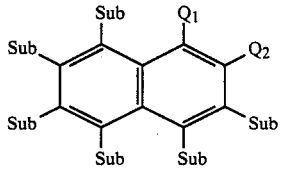

-continued (C-4)

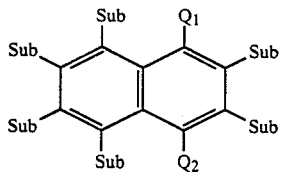

(C-5)

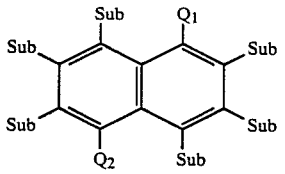

(C-6)

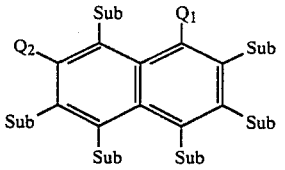

(C-7)

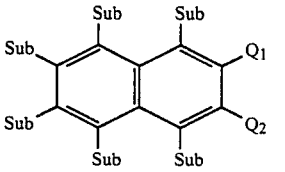

(C-8)

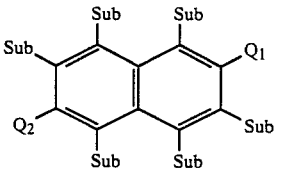

(C-9)

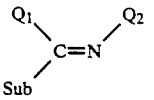

(C-10)

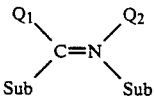

(C-11)

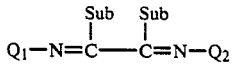

(C-12)

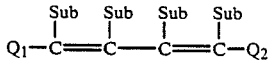

(C-13)

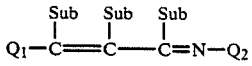

wherein $Q_1$ and $Q_2$ each represents —O-Sub,

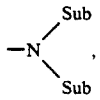

or —S-Sub; Sub represents a chemical bond ($\pi$-bond) or a substituent.

15. A silver halide color photographic material comprising (1) at least one coupler and (2) at least one compound represented by formula (I)

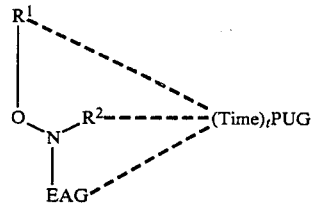

(I)

wherein EAG represents a group capable of accepting an electron from a reducing substance; $R^1$ and $R^2$ each represents a chemical bond or a divalent substituent, or $R^1$ and $R^2$ each represents a substituent other than a hydrogen atom, and when $R^1$ or $R^2$ is bonded to $-(Time)_t-PUG$, $R^1$ or $R^2$ is a single bond or a divalent substituent, and $R^1$ and $R^2$ may be bonded to each other to form a cyclic structure; Time represents a group capable of releasing PUG which is released by the cleavage of the single bond between the oxygen atom and the nitrogen atom in the compound; t represents 0 or 1; PUG represents a dye moiety which masks to correct subabsorption of a dye formed from said coupler, wherein said dye moiety is a ligand capable of forming a dye upon a complex-forming reaction with a metal ion; the dotted lines mean that at least one of them forms a chemical bond and wherein the release of PUG is triggered by the cleavage of the N—O single bond which occurs when EAG accepts an electron.

16. A method for forming an image comprising imagewise exposing to light and then processing a silver halide color photographic material with a developing solution containing a paraphenylenediamine as a developing agent, said material comprising a color coupler and (1) at least one compound represented by formula (I)

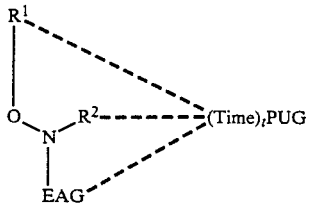

(I)

wherein EAG represents a group capable of accepting an electron from a reducing substance; $R^1$ and $R^2$ each represents a substituent other than a hydrogen atom, and when $R^1$ and $R^2$ is bonded to $-(Time)_t-PUG$, $R^1$ or $R^2$ is a single bond or divalent substituent, and $R^1$ and $R^2$ may be bonded to each other to form a cyclic structure; Time represents a group capable of releasing PUG, which is released by the cleavage of the single bond between the oxygen atom and the nitrogen atom in the compound; t represents 0 or 1; PUG represents a dye moiety which masks to correct subabsorption of a dye formed from said coupler, wherein said dye moiety is a ligand capable of forming a dye upon a complex-forming reaction with a metal ion; the dotted lines mean that at least one of them forms a chemical bond, wherein the release of PUG is triggered by the cleavage of the N—O single bond which occurs when EAG accepts an electron.

* * * * *